US007246722B2

(12) United States Patent
Walters et al.

(10) Patent No.: US 7,246,722 B2
(45) **Date of Patent: *Jul. 24, 2007**

(54) BOTTOM DISPENSING AEROSOL DEVICE

(75) Inventors: Peter J. Walters, Barrington, IL (US); Jason A. Ksiazk, Arlington Heights, IL (US); Sean H. Cho, South Elgin, IL (US)

(73) Assignee: Seaquist Perfect Dispensing Foreign, Cary, IL (US)

( * ) Notice: Subject to any disclaimer, the term of this patent is extended or adjusted under 35 U.S.C. 154(b) by 109 days.

This patent is subject to a terminal disclaimer.

(21) Appl. No.: 11/104,234

(22) Filed: Apr. 12, 2005

(65) Prior Publication Data

US 2005/0224518 A1 Oct. 13, 2005

Related U.S. Application Data

(60) Provisional application No. 60/561,987, filed on Apr. 13, 2004.

(51) Int. Cl.
*B67D 5/06* (2006.01)

(52) U.S. Cl. ..... 222/185.1; 222/182; 222/402.21; 222/153.11

(58) Field of Classification Search ..... 222/182, 222/185.1, 402.1, 153.11, 162, 402.21, 402, 222/1

See application file for complete search history.

(56) References Cited

U.S. PATENT DOCUMENTS

| | | | |
|---|---|---|---|
| 1,265,177 | A | 7/1918 | Coleman |
| 2,765,959 | A | 10/1956 | Elliott |
| 2,821,048 | A | 1/1958 | Efford et al. |
| 2,910,391 | A | 10/1959 | Toulmin |
| 2,935,232 | A | 5/1960 | Thomas |
| 3,003,662 | A | 10/1961 | Meshberg |
| 3,039,659 | A | 6/1962 | Sagarin |
| 3,272,392 | A | 9/1966 | Meshberg |
| 3,618,827 | A | 11/1971 | Melocchi |
| 3,759,431 | A | 9/1973 | Vos |
| 3,887,115 | A | 6/1975 | Petterson |
| 3,888,392 | A | 6/1975 | Van Coney |
| 3,893,596 | A | 7/1975 | Beres et al. |
| 3,979,163 | A | 9/1976 | Beard |
| 4,186,853 | A | 2/1980 | White |
| 4,328,911 | A | 5/1982 | Knickerbocker |
| 4,378,081 | A | 3/1983 | van Lit |
| 4,416,398 | A | 11/1983 | Knickerbocker |

(Continued)

FOREIGN PATENT DOCUMENTS

| | | | |
|---|---|---|---|
| GB | 2031525 | A | 4/1980 |

(Continued)

*Primary Examiner*—Philippe Derakshnai
(74) *Attorney, Agent, or Firm*—Frijouf, Rust & Pyle P.A.

(57) ABSTRACT

A bottom dispensing aerosol device is disclosed comprising an aerosol container with an aerosol valve located at a bottom portion of the aerosol container. A coupling mounts an undercap to the aerosol container with a top portion of the undercap being adjacent to a bottom portion of the aerosol container. A bottom portion of the undercap supports the aerosol container on a supporting surface in an inverted position. An actuator is provided for opening the aerosol valve for discharging the aerosol product from the aerosol container when the bottom portion of the undercap is supporting the aerosol container in the inverted position on a supporting surface.

21 Claims, 38 Drawing Sheets

U.S. PATENT DOCUMENTS

| | | | |
|---|---|---|---|
| 4,416,399 | A | 11/1983 | Parr et al. |
| 4,426,025 | A | 1/1984 | Knickerbocker |
| D293,213 | S | 12/1987 | Crapser |
| D293,214 | S | 12/1987 | Crapser |
| 5,263,616 | A | 11/1993 | Ablanalp |
| 5,335,832 | A | 8/1994 | de Laforcade |
| 5,385,272 | A | 1/1995 | Aoun |
| 5,791,524 | A | 8/1998 | Demarest |
| 5,957,336 | A | 9/1999 | Radassao et al. |
| 6,010,042 | A | 1/2000 | Boucher et al. |
| 6,491,187 | B2 | 12/2002 | Walters |

FOREIGN PATENT DOCUMENTS

| | | |
|---|---|---|
| GB | 2238580 | 6/1991 |
| WO | WO98/38881 | 9/1998 |

BOTTOM DISPENSING AEROSOL DEVICE

CROSS-REFERENCE TO RELATED APPLICATIONS

This application claims benefit of U.S. Patent Provisional application Ser. No. 60/561,987 filed Apr. 13, 2004. All subject matter set forth in U.S. provisional application Ser. No. 60/561,987 is hereby incorporated by reference into the present application as if fully set forth herein.

BACKGROUND OF THE INVENTION

1. Field of the Invention

This invention relates to aerosol dispensing devices and more particularly to an improved aerosol dispensing device for dispensing an aerosol product in a generally downwardly direction when the aerosol container is supported in the inverted position on a supporting surface.

2. Background of the Related Art

An aerosol dispensing device comprises an aerosol valve located within an aerosol container. The aerosol valve is biased into a closed position. A valve stem cooperates with the aerosol valve for opening the aerosol valve. An actuator engages with the valve stem to open the aerosol valve for dispensing an aerosol product from the aerosol container. The aerosol product is dispensed from the aerosol valve through a spray nozzle.

Various types of actuators have been utilized by the prior art for actuating an aerosol dispensing device. The first and the most basic type of actuator for an aerosol dispensing device is an actuator button that is affixed to the valve stem. A depression of the actuator button depresses the valve stem to open the aerosol valve for dispensing the aerosol product from the aerosol container. A protective cap is utilized for engaging with a rim of the aerosol container for inhibiting accidental actuating of the aerosol button.

The second type of actuator for an aerosol dispensing device is an aerosol overcap. The aerosol overcap replaces the conventional protective cap and includes an actuator for actuating the aerosol valve of the aerosol dispensing device. The aerosol overcap comprises a base engagable with the rim of the aerosol container for mounting the overcap to the aerosol container. The aerosol over cap includes an actuator pivotably mounted to the overcap base and engaging with the valve stem. The movement of the actuator of the aerosol overcap causes a depression of the valve stem to open the aerosol valve for dispensing the aerosol product from the aerosol container.

A third type of actuator for actuating an aerosol dispensing device is a trigger device. In this third type of actuators, a base is mounted either to the container rim or the mounting cup rim for supporting a trigger. The trigger is engagable with the valve stem. A movement of the trigger from an extended position to a protracted position depresses the valve stem to open the aerosol valve for dispensing the aerosol product from the aerosol container.

Aerosol dispenser devices traditionally dispense lower viscosity aerosol products such as hair spray, paint, deodorant, and the like in a spray form. The spray nozzle and aerosol valve is traditionally located on the top of the aerosol container for dispensing the aerosol products through the spray nozzle in an upright position.

Typically, high viscosity aerosol products like shaving gels as well as foaming aerosol products such as shave cream are stored in an upright position and are dispensed in an upright to horizontal position. Other high viscosity foaming aerosol products such as hair mousse and rug cleaner are stored in an upright position but are dispensed in an inverted position.

The high viscosity foaming aerosol products that are dispensed in an inverted position are not designed to dispense in an upright position. If these foaming aerosol products are actuated in a upright oriented position, only the aerosol propellant would escape from the aerosol container and the aerosol product would remain in the aerosol container. This loss of the aerosol propellant may deplete the aerosol propellant prior to the complete dispensing of the aerosol product from the aerosol container.

U.S. Pat. No. 1,265,177 to Coleman discloses a receptacle including a cylindrical body having an outwardly flaring supporting flange fixed to its lower end. A bottom wall is secured in the cylindrical body above the point of connection of the flange. The flange is provided with an observation opening in one side thereof. A valve casing is connected to the bottom wall and depending therefrom. A rotary valve member is mounted in the casing to control the discharge of the contents of the receptacle. The valve has a stem rotatably supported in the flange.

U.S. Pat. No. 2,765,959 to Elliott discloses a dispensing receptacle for cans of pressurized material of the type having a tiltable valve controlling spout. The can containing receptacle has an open bottom and an open top and a closure for the top. Means hold a can in the container with the dispensing spout extending through the open bottom. The means includes shoulders in the receptacle and a spring between the closure and the bottom of the can biasing the can against the shoulders. The can is telescoped within the receptacle. Laterally movable means extends through the side wall of the receptacle for engaging and tilting the tiltable valve controlling spout. The last mentioned means comprises a stem removably abutting the spout. Spring means biases the stem outwardly of the receptacle. A push bottom on the outer end of the stem moves the stem inwardly to tilt the spout.

U.S. Pat. No. 3,272,392 discloses a dispensing package for materials under pressure comprising a container having a material under pressure therein. Valve means is mounted on the container for dispensing the material on the operation thereof. The valve means includes a projecting stem portion movable relative to the container for operating the valve means and having a passage therein for passing the material. Actuating means is operable to move the stem portion relative to the container for operating the valve means. The actuating means comprises a part connected to the stem portion. The part has means therein cooperating with the passage in the stem portion for communicating the latter outwardly of the dispensing package. The part is movable relative to the container on the application of pressure applied from a position predeterminately located relative to the container in a direction substantially transverse to the axis of the stem portion for operating the valve means.

U.S. Pat. No. 3,759,431 to Vos discloses a pressurized package of the class that includes a container for receiving a product. Propellant means in the container discharges the product from the container. A dispensing assembly is mounted on the container characterized by an actuating lever. The actuating lever shifts to displace a flexible resilient valve body member from a position in which its discharge orifice-containing surface is in scaled engagement at least partially effected by the internal container pressure with a valve cap to a position in which it is aligned with an exit opening of the overcap.

U.S. Pat. No. 3,979,163 discloses a cleaning and scrubbing tool having a cleaning head and aerosol can handle in which a suitably operational scrub pad is supported by head bracket extension in free cleaning liquid passing relation, interlocked with portions of the pad by localized deflection of the extension, suitably by locally heating or solvating the extension to deflectable condition within the pad interior.

U.S. Pat. No. 4,416,398 discloses a plural spray rate aerosol assembly for use with an aerosol container having a plural spray rate valve. The assembly comprises an actuator button having a terminal orifice connected through a valve stem to the plural spray rate valve for enabling a first discharge rate of the aerosol product from the terminal orifice upon opening the valve in a first position and for enabling a second discharge rate of the aerosol product from the terminal orifice upon opening the valve in a second position. An overcap is rotatably secured to the aerosol container and includes a finger actuator movably mounted relative to the overcap. A non-symmetrical aperture is disposed in either the actuator button or the finger actuator for cooperation with a non-symmetrical element in the other of the actuator button and the finger actuator. The non-symmetrical element is inhibited from entering the non-symmetrical aperture for transferring the finger movement of the operator to open the valve in the first position upon a first selected orientation of the finger actuator relative to the actuator button. The non-symmetrical element enters the non-symmetrical aperture for transferring the finger movement of the operator to open the valve in the second position upon a second selected orientation of the finger actuator relative to the actuator button.

U.S. Pat. No. 5,385,272 to Aoun discloses a hand held, free standing, bottom dispensing dispenser, generally made of plastic, for the dispensing of thick liquids such as lotions, shampoos. and processed foodstuff, having a resiliently walled reservoir that sits atop a stand that offers fulcrum for a mechanical linkage. The linkage has a top portion engaged to the reservoir side wall allowing the user's hand to grasp and manipulate the linkage while grasping and manipulating the reservoir. A bottom portion is coupled to a dispensing valve disposed and adapted to open and close a discharge element affixed to an outlet in the bottom end of the reservoir. Thus, when hand pressure is applied to the linkage top portion at the same time the reservoir is squeezed and the motion transmitted by the linkage to the dispensing valve opens the latter to dispense a portion of the content. When pressure is relieved, the resilient reservoir side wall rebounds back to its initial shape and, the reservoir side wall being engaged to the linkage moves the latter back to its initial position. Thus while causing the dispensing valve to gradually close, the reservoir side wall outward movement induces in the reservoir an air flow that draws the fluid in the discharge element in therewith. The dispenser content is always located in the lower part of the reservoir near its aperture, ready to be dispensed therefore making possible the dispensing of virtually all the content.

U.S. Pat. No. 5,957,336 to Radassao et al. discloses a viscous fluid dispenser including an upper extent constructed from a flexible material and having a top face and a peripheral side wall with an inverted frustoconical configuration defining a lower peripheral edge. Further provided is a lower extent constructed from a rigid material and having a planar bottom face coupled with respect to the lower peripheral edge of the upper extent. The bottom face of the lower extent has at least one bore formed therein. Next provided is a lid hingably coupled to the lower extent for selectively closing the bore.

U.S. Pat. No. 6,010,042 to Boucher et al. discloses a base end dispensing container, especially suitable for dispensing viscous flowable liquid consumable products. The container includes an elongated, squeezable, container having an inner chamber for holding the viscous flowable liquid consumable products. A base dispensing valve, a top end valve operating mechanism and an attached support structure support the container in an upright position a distance front a surface upon which the container is placed. The base end dispensing valve includes a sloping container floor terminating at a substantially flat section, upon which a rotationally operable valve gate rests. The substantially flat floor section of the container includes at least one dispensing opening intermediate the interior chamber of the container and the outside of the container. The valve gate is selectively operated between an open and shut position by the top end valve operating mechanism via a valve driven shaft which connects the valve operating mechanism with the rotationally operable valve gate.

U.S. Pat. No. D293,213 discloses a design patent for an aerosol overcap physically located on a top portion of the aerosol container for discharging an aerosol product in a conventional upright manner.

One recently designed aerosol dispenser is stored in an inverted position whereat the overcap, spray nozzle and the aerosol valve are located on the bottom of the aerosol container. Although this aerosol dispenser is stored in an inverted position, the aerosol container is turned upright to dispense the aerosol product from the aerosol container.

In U.S. Pat. No. 6,491,187, the present inventor Peter J. Walters discloses a novel inverted aerosol dispensing device comprising an undercap secured to a bottom portion of an aerosol container for supporting the aerosol container on a supporting surface. The novel inverted aerosol dispensing device included an actuator movably mounted relative to the undercap for moving the valve stem upon displacement of the actuator for discharging the aerosol product from the valve stem in a generally downwardly direction through the undercap.

Therefore it is an object of the present invention to provide a further improvement to the novel inverted aerosol dispensing device set forth in U.S. Pat. No. 6,491,187.

Another object of the present invention is to provide a bottom dispensing aerosol device that incorporates an undercap mounted to a bottom portion of the aerosol container for storing the inverted aerosol dispensing device in an inverted position.

Another object of the present invention is to provide a bottom dispensing aerosol device that is capable of dispensing an aerosol product in downward direction when the aerosol container is supported in the inverted position on a supporting surface.

Another object of the present invention is to provide a bottom dispensing aerosol device that is capable of dispensing viscous or foaming aerosol product in downward direction.

Another object of the present invention is to provide a bottom dispensing aerosol device incorporating an undercap rotatably mounted to a bottom portion of the aerosol container for enabling discharge of the aerosol product in an unlocked rotational position and for inhibiting discharge of the aerosol product in a locked rotational position.

Another object of the present invention is to provide a bottom dispensing aerosol device that is suitable for use with plastic containers.

Another object of the present invention is to provide a bottom dispensing aerosol device that is economical to manufacture and is economical to install on the aerosol dispensing device.

The foregoing has outlined some of the more pertinent objects of the present invention. These objects should be construed as being merely illustrative of some of the more prominent features and applications of the invention. Many other beneficial results can be obtained by applying the disclosed invention in a different manner within the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to a bottom dispensing aerosol device comprising an aerosol container extending between a top portion and a bottom portion for containing an aerosol product and an aerosol propellant therein. An aerosol valve is located at the bottom portion of the aerosol container. The aerosol valve has a valve stem for displacing the aerosol valve from a biased closed position to an open position upon a movement of the valve stem to discharge the aerosol product from a terminal orifice. An undercap has a sidewall extending between a top portion and a bottom portion. A coupling mounts the undercap to the aerosol container with the top portion of the undercap being adjacent to the bottom portion of the aerosol container. The bottom portion of the undercap terminates in a base surface for supporting the aerosol container on a supporting surface to store the aerosol dispensing device in an inverted position. An actuator is provided for moving the valve stem to actuate the aerosol valve for discharging the aerosol product from the valve stem when the base surface of the undercap is supporting the aerosol container in the inverted position on the supporting surface.

In another embodiment of the invention, the bottom dispensing aerosol device comprises an aerosol container extending between a top portion and a bottom portion for containing an aerosol product and an aerosol propellant therein. An aerosol valve is located at the bottom portion of the aerosol container. The aerosol valve has a valve stem for displacing the aerosol valve from a biased closed position to an open position upon a movement of the valve stem to discharge the aerosol product from a terminal orifice. An undercap has a sidewall extending between a top portion and a bottom portion. A coupling rotatably mounts the undercap to the aerosol container with the top portion of the undercap being adjacent to the bottom portion of the aerosol container. The bottom portion of the undercap terminates in a base surface for supporting the aerosol container on a supporting surface to store the aerosol dispensing device in an inverted position. An actuator is provided for moving the valve stem to actuate the aerosol valve. The undercap is rotatable into a unlocked rotational position relative to the aerosol container for enabling the actuator to move the valve stem upon movement of the actuator for discharging the aerosol product from the valve stem when the base surface of the undercap is supporting the aerosol container in the inverted position on the supporting surface. The undercap is rotatable into a locked rotational position relative to the aerosol container for inhibiting the actuator from moving the valve stem.

In one embodiment of the invention, the coupling rotatably mounts the undercap to the aerosol container for enabling rotational movement between the aerosol container and the undercap. In another embodiment of the invention, the coupling linearly mounts the undercap to the aerosol container for enabling linear movement between the aerosol container and the undercap. In still a further embodiment of the invention, the coupling rotatably and linearly mounts the undercap to the aerosol container for enabling rotational and linear movement between the aerosol container and the undercap.

The undercap may comprise a unitary structure or may comprise a distinct first undercap portion and a distinct second undercap portion with a coupling interconnecting the first undercap portion to the second undercap portion. The first undercap portion is connected to the aerosol container with the second undercap portion defining the base surface for supporting the aerosol container on a supporting surface.

In one specific example of the invention, the terminal orifice is located within the undercap for dispensing the aerosol product inside the undercap when the base surface of the undercap is disposed on the supporting surface. The undercap has an access aperture located in the sidewall of the undercap for enabling access to the terminal orifice. In an alternate embodiment of the invention, the terminal orifice is located in proximity to the sidewall of the undercap for dispensing the aerosol product outside of the undercap when the base surface of the undercap is disposed on the supporting surface.

In one example of the invention, the aerosol valve is a tilt aerosol valve for discharging the aerosol product from the terminal orifice upon a tilting of the valve stem. The actuator is connected for tilting the valve stem upon movement of the actuator. The actuator may be located within the undercap with an access aperture defined in the sidewall of the undercap for enabling an object inserted through the access aperture to move the actuator for actuating the aerosol valve.

In another example of the invention, the aerosol valve is a vertical action aerosol valve for discharging the aerosol product from the terminal orifice upon a linear movement of the valve stem. The actuator is connected for linearly moving the valve stem upon movement of the actuator. Preferably, the coupling enables linear movement of the aerosol container relative to the undercap for discharging the aerosol product from the terminal orifice upon depression of the top end of the aerosol container when the base surface is located on the supporting surface.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
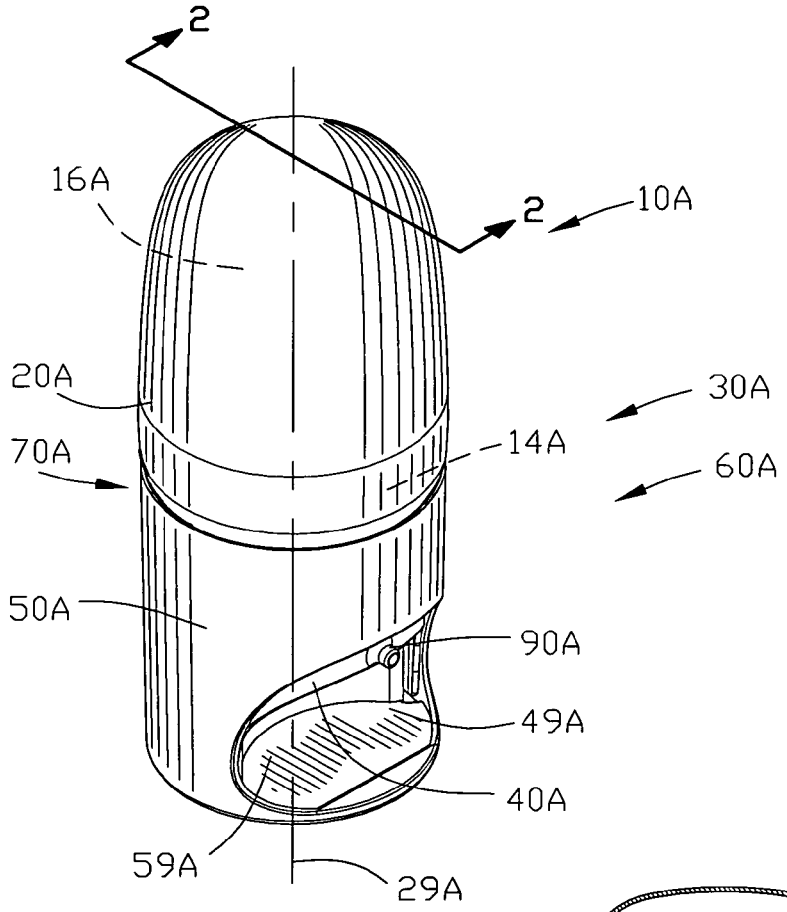
FIG. 1 is a top isometric view of a first embodiment of a bottom dispensing aerosol device incorporating the present invention with the undercap being rotated into an unlocked rotational position.

FIG. 1 is a top isometric view of a first embodiment of a bottom dispensing aerosol device 10A for dispensing an aerosol product 14A incorporating the present invention. The bottom dispensing aerosol device 10A dispenses the aerosol product 14A by an aerosol propellant 16A from an aerosol container 20A.

The bottom dispensing aerosol device 10A of the present invention enables the aerosol container 20A to be stored in an inverted position on a supporting surface 18A. Furthermore, the bottom dispensing aerosol device 10A of the present invention dispenses the aerosol product 14A under the pressure of the aerosol propellant 16A in a generally downward direction through an undercap 30A while the bottom dispensing aerosol device 10A is in an inverted position and while the bottom dispensing aerosol device 10A is resting on the supporting surface 18A.

Figure 2:
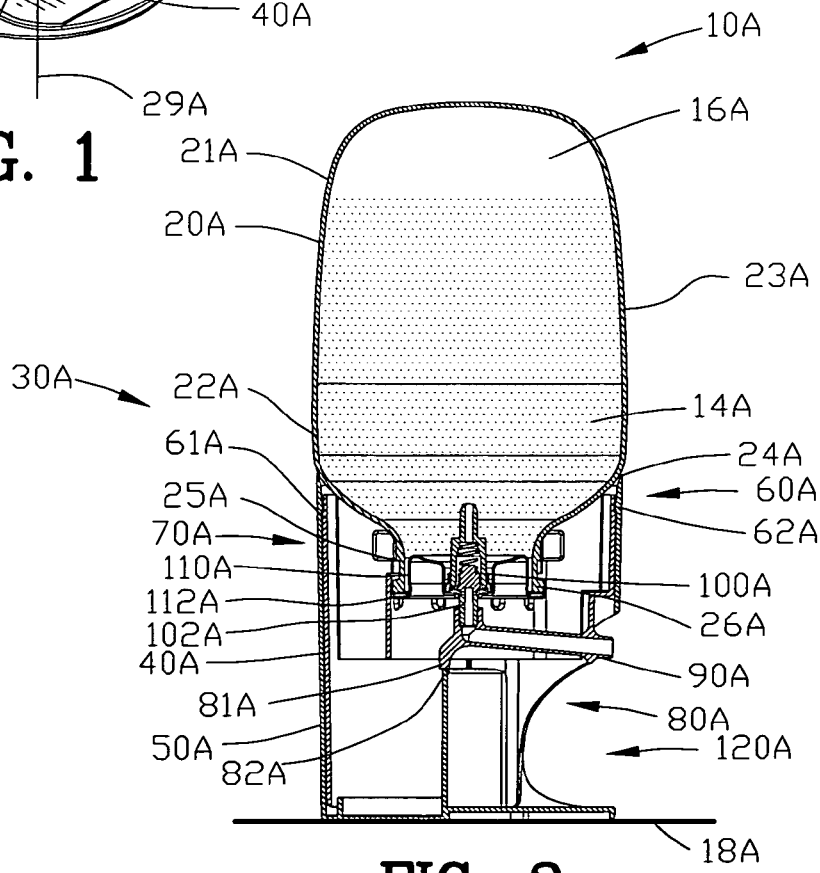
FIG. 2 is a sectional view along line 2—2 in FIG. 1.
Figure 3:
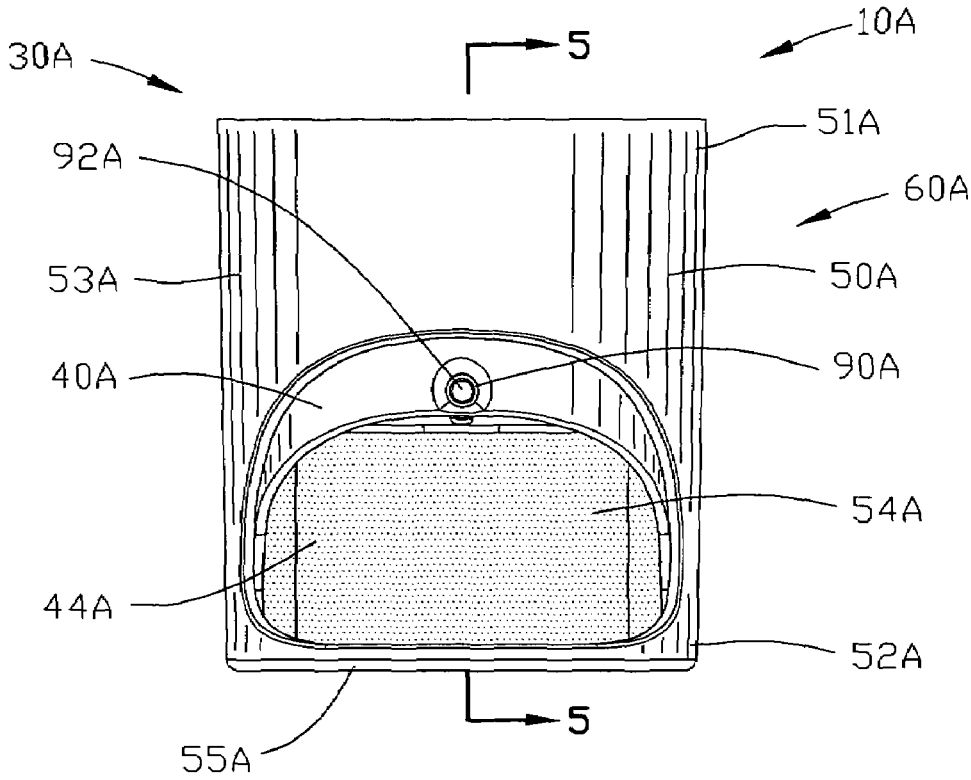
FIG. 3 is an enlarged front view of the undercap of FIG. 1.
Figure 4:
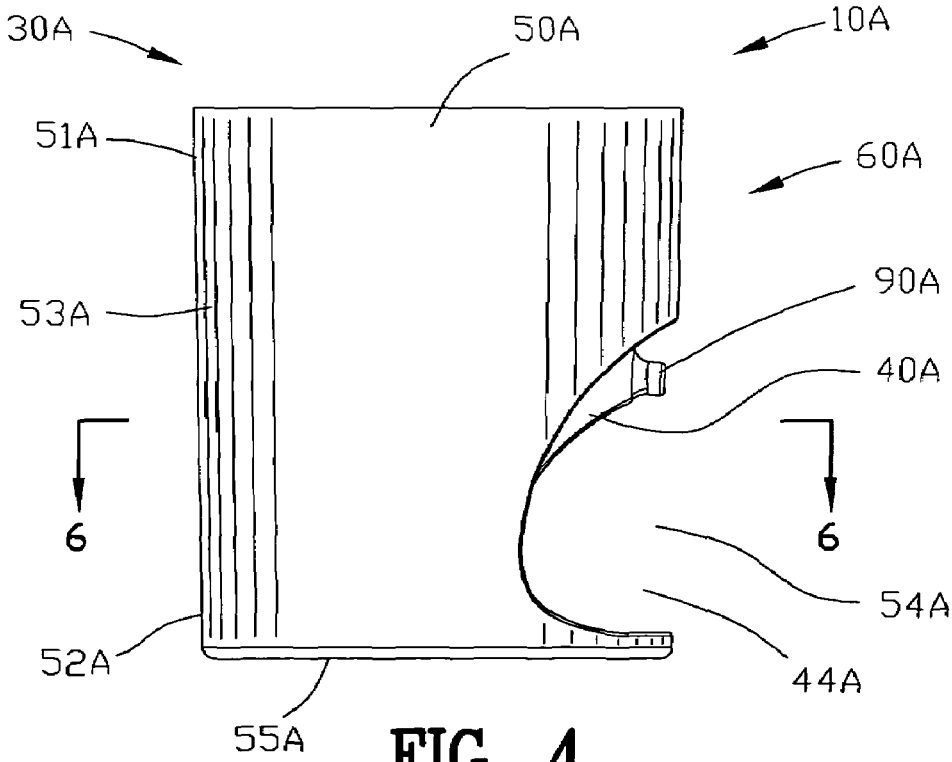
FIG. 4 is a side view of FIG. 3.
Figure 5:
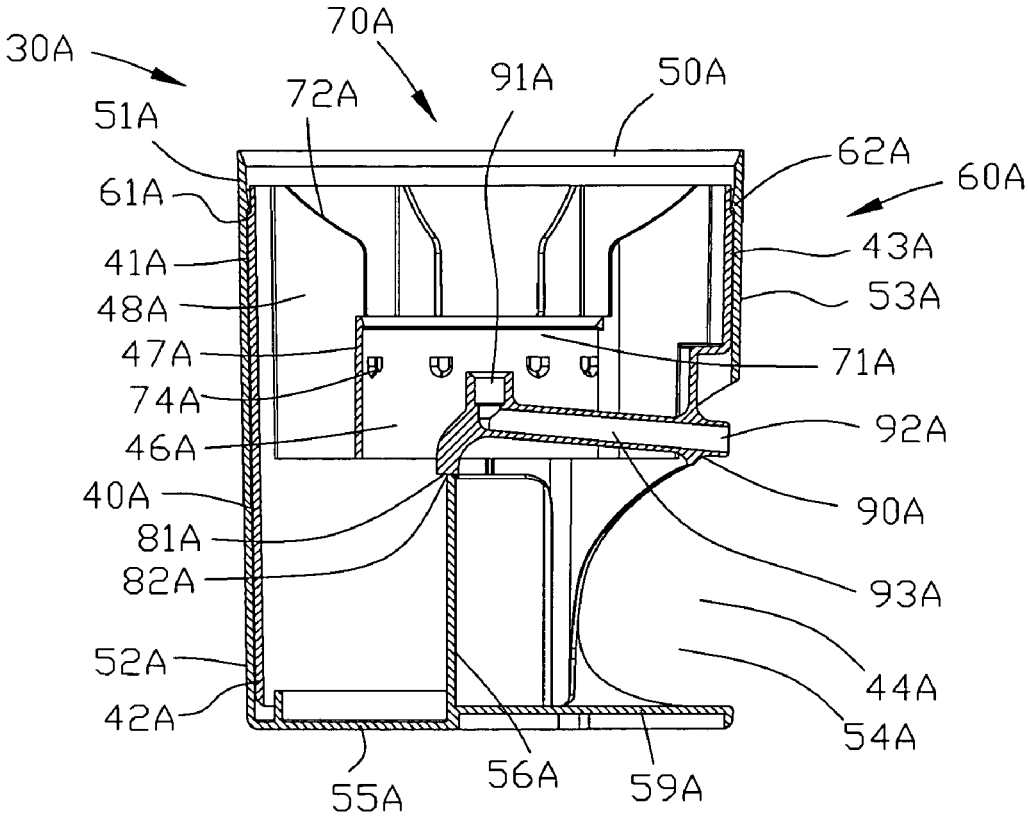
FIG. 5 is a sectional view along line 5—5 in FIG. 3.
Figure 6:
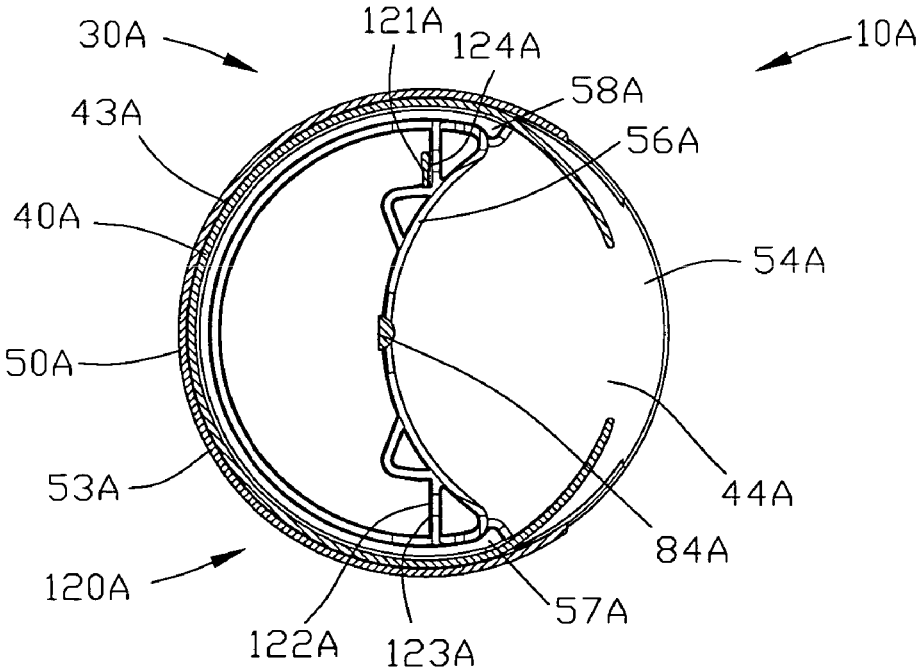
FIG. 6 is a sectional view along line 6—6 in FIG. 4.
Figure 7:
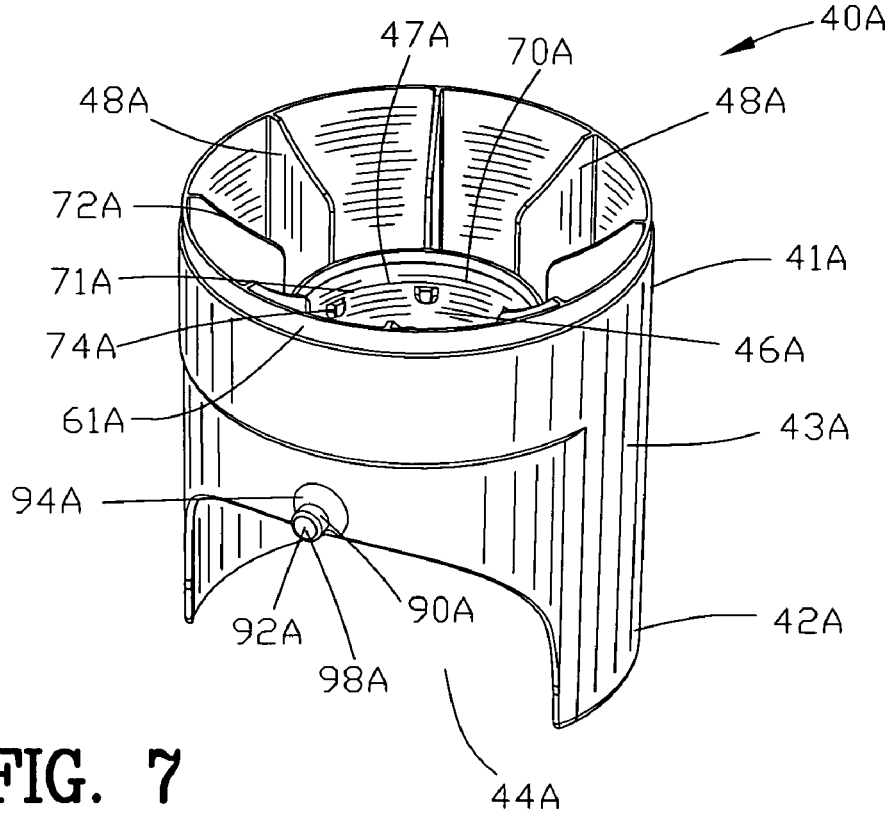
FIG. 7 is a top isometric view of a first undercap portion of the undercap of FIGS. 1–6.
Figure 8:
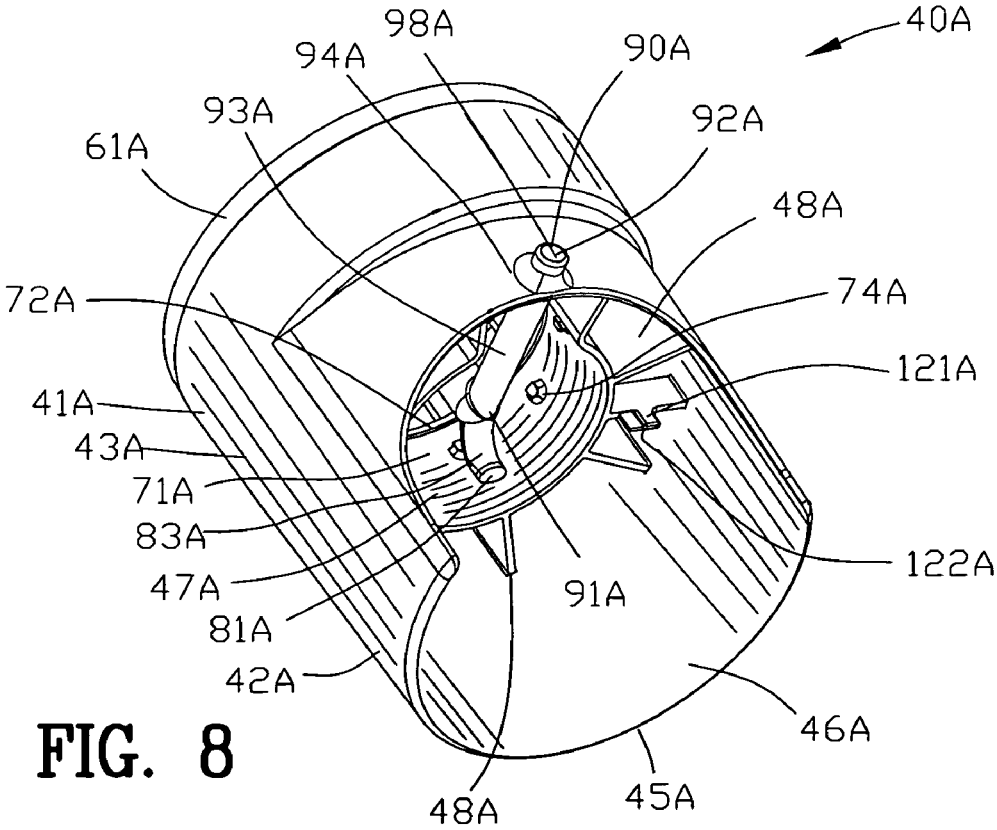
FIG. 8 is a bottom isometric view of the first undercap portion of FIG. 7.
Figure 9:
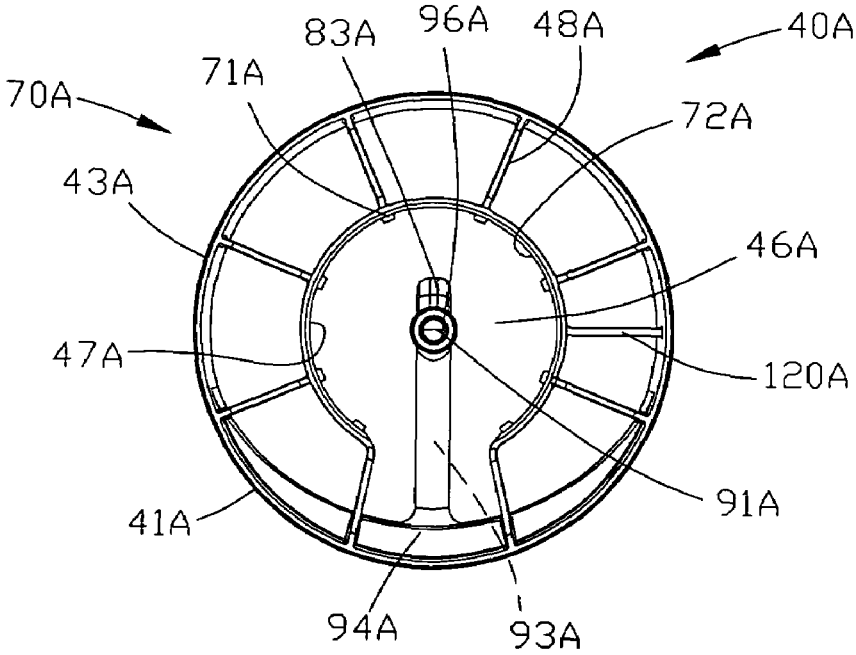
FIG. 9 is a top view of the first undercap portion of FIG. 7.
Figure 10:
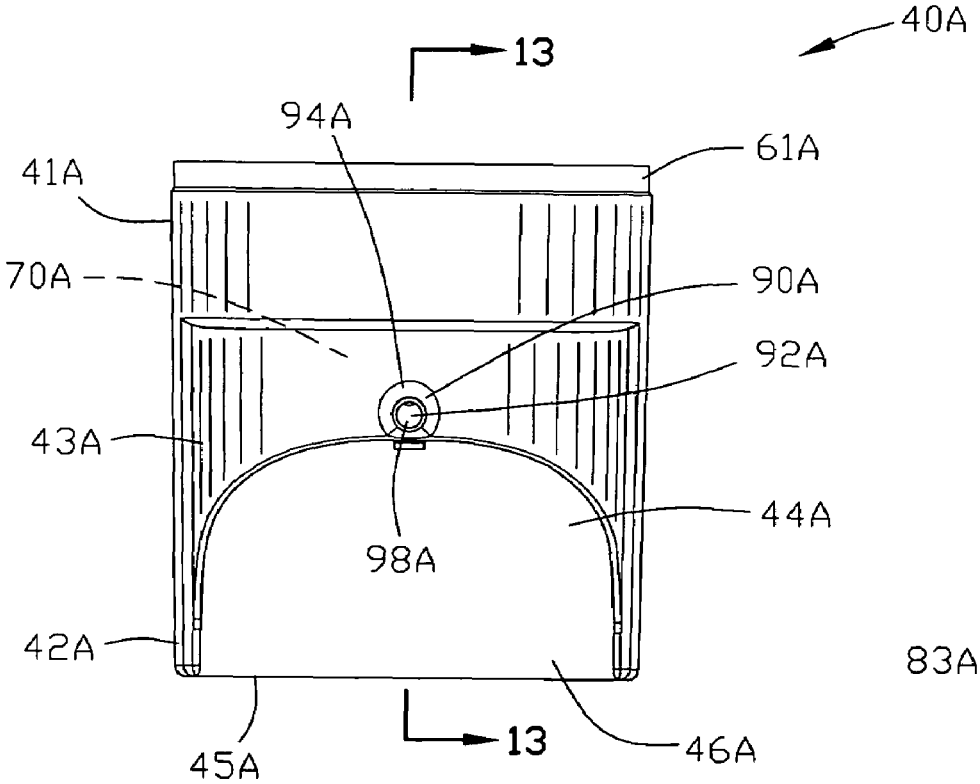
FIG. 10 is a front view of FIG. 9.
Figure 11:
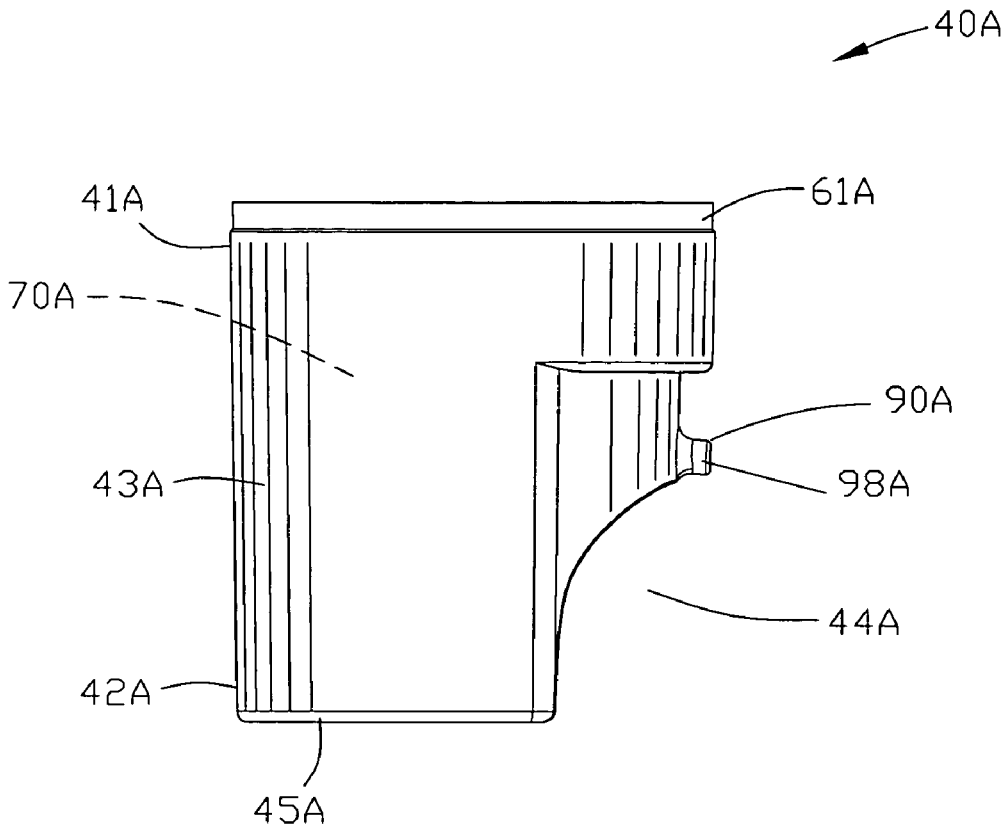
FIG. 11 is a side view of FIG. 10.
Figure 12:
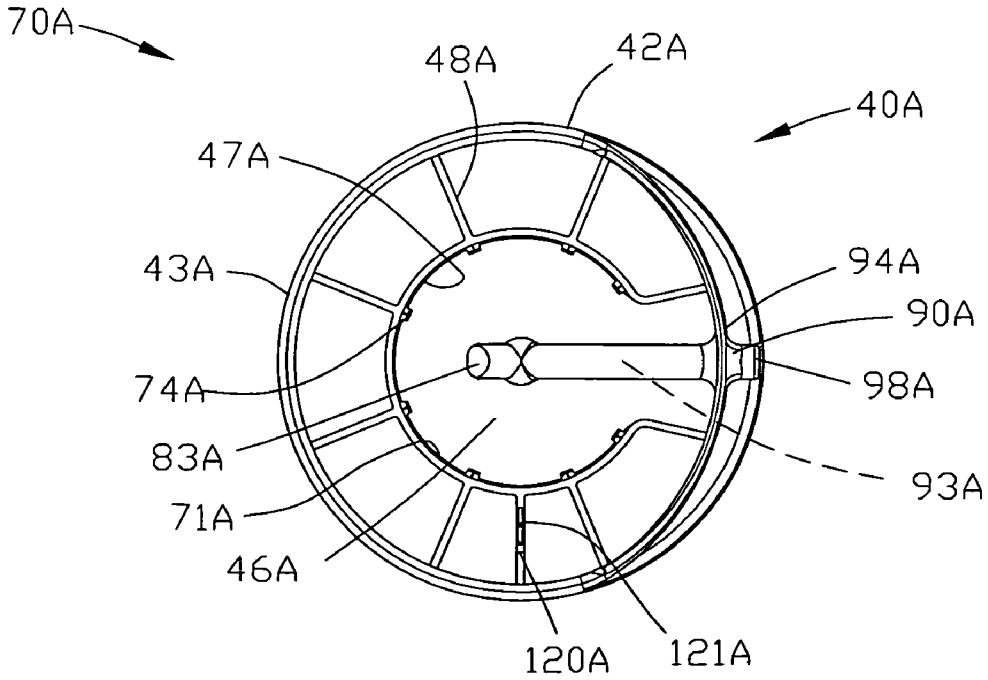
FIG. 12 is a bottom view of FIG. 10.
Figure 13:
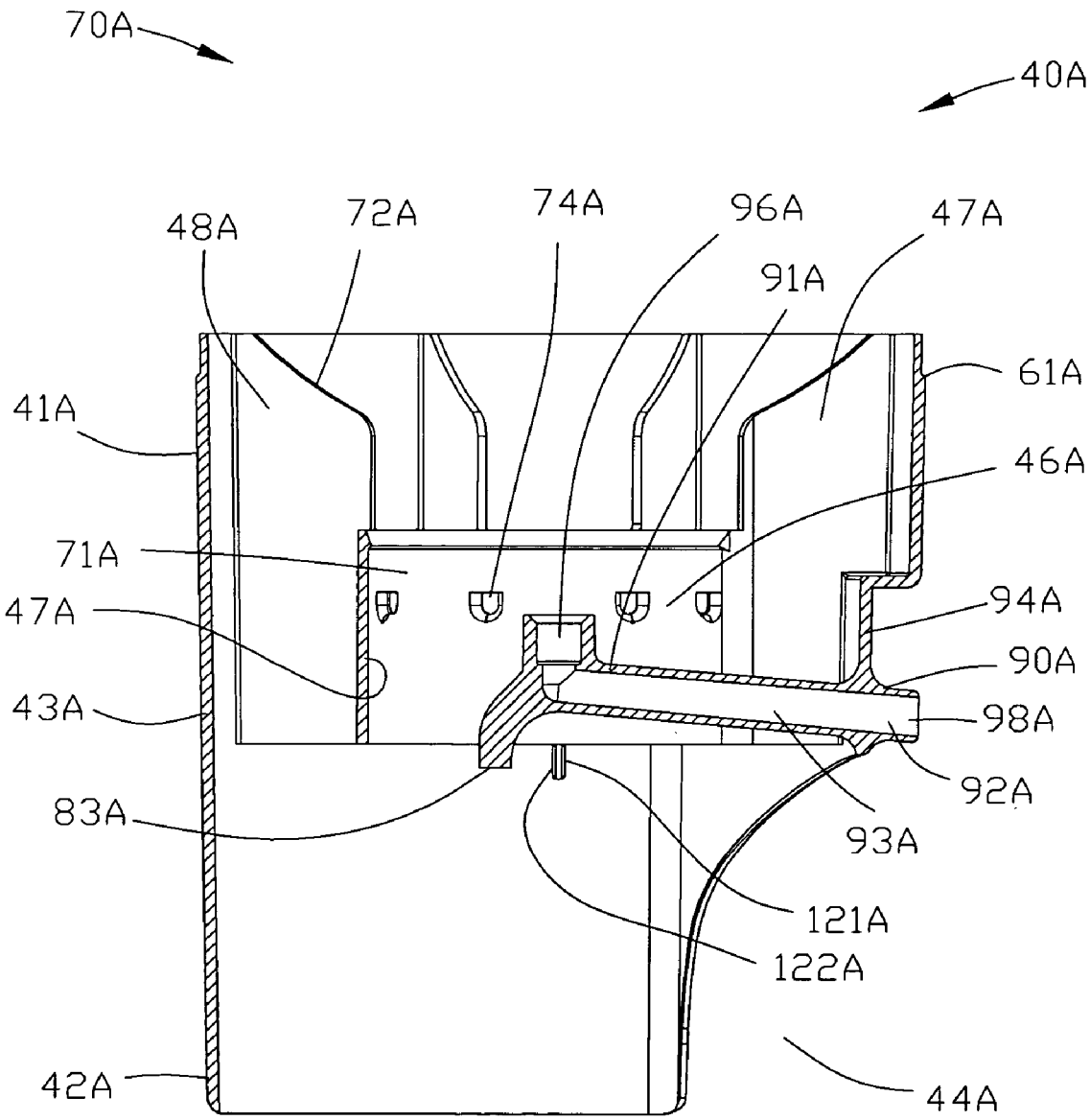
FIG. 13 is an enlarged sectional view along line 13—13 in FIG. 10.
Figure 14:
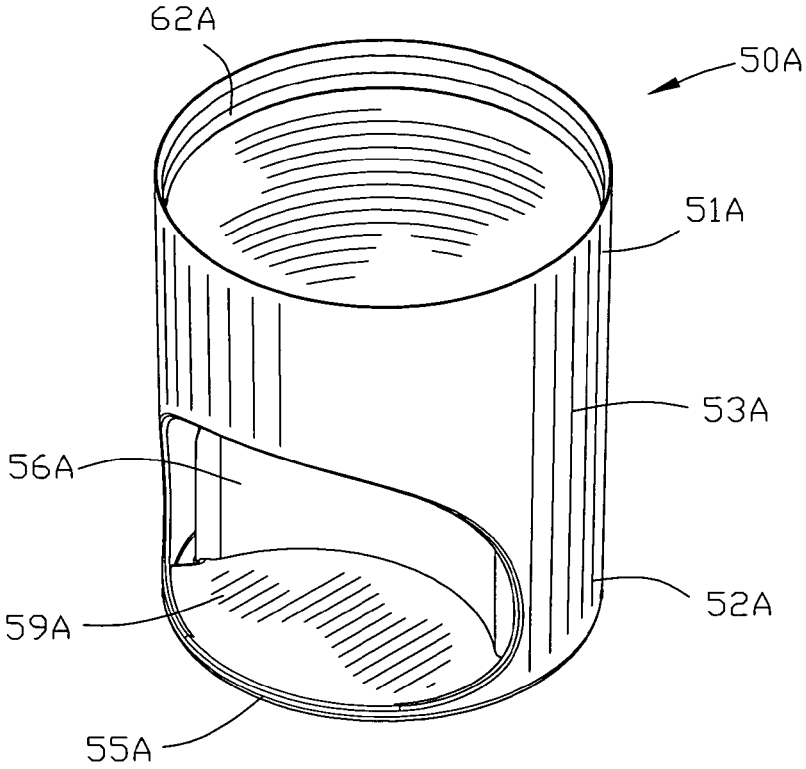
FIG. 14 is a top isometric view of a second undercap portion of the undercap of FIGS. 1–6.
Figure 15:
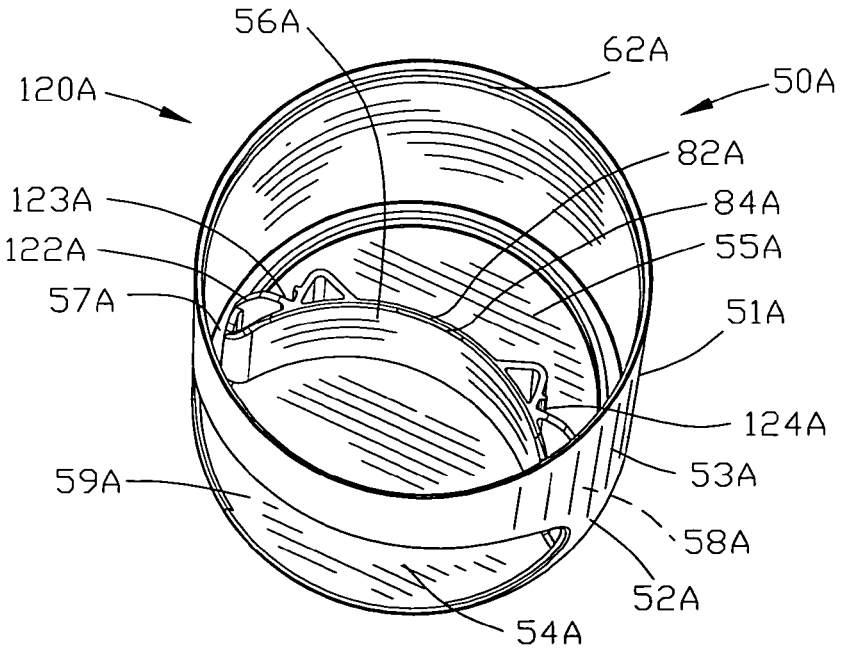
FIG. 15 is a further top isometric view of the first undercap portion of FIG. 14.
Figure 16:
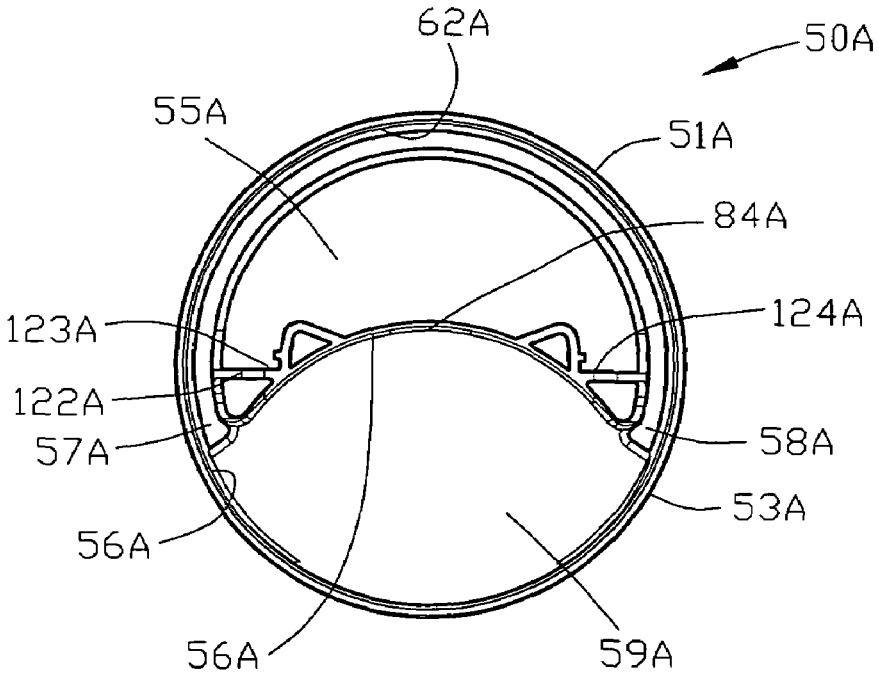
FIG. 16 is a top view of the first undercap portion of FIG. 14.
Figure 17:
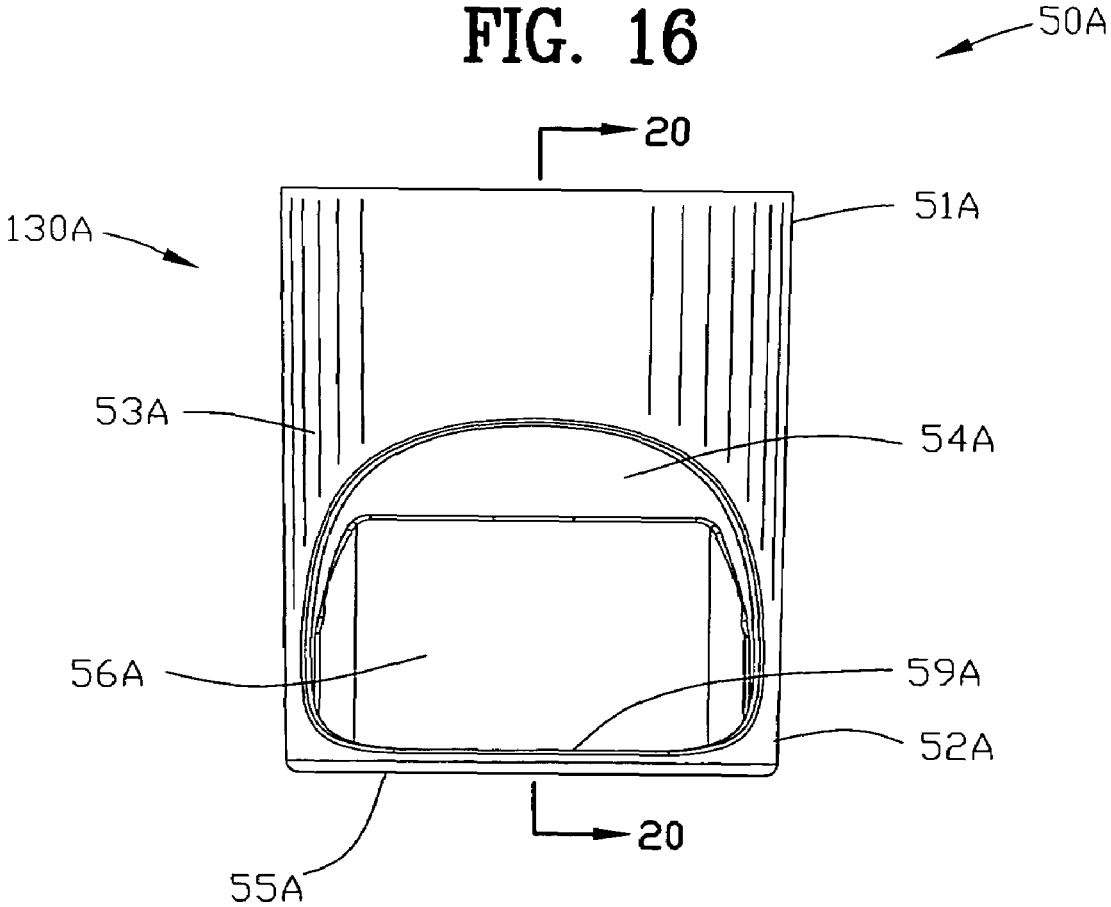
FIG. 17 is a front view of FIG. 16.
Figure 18:
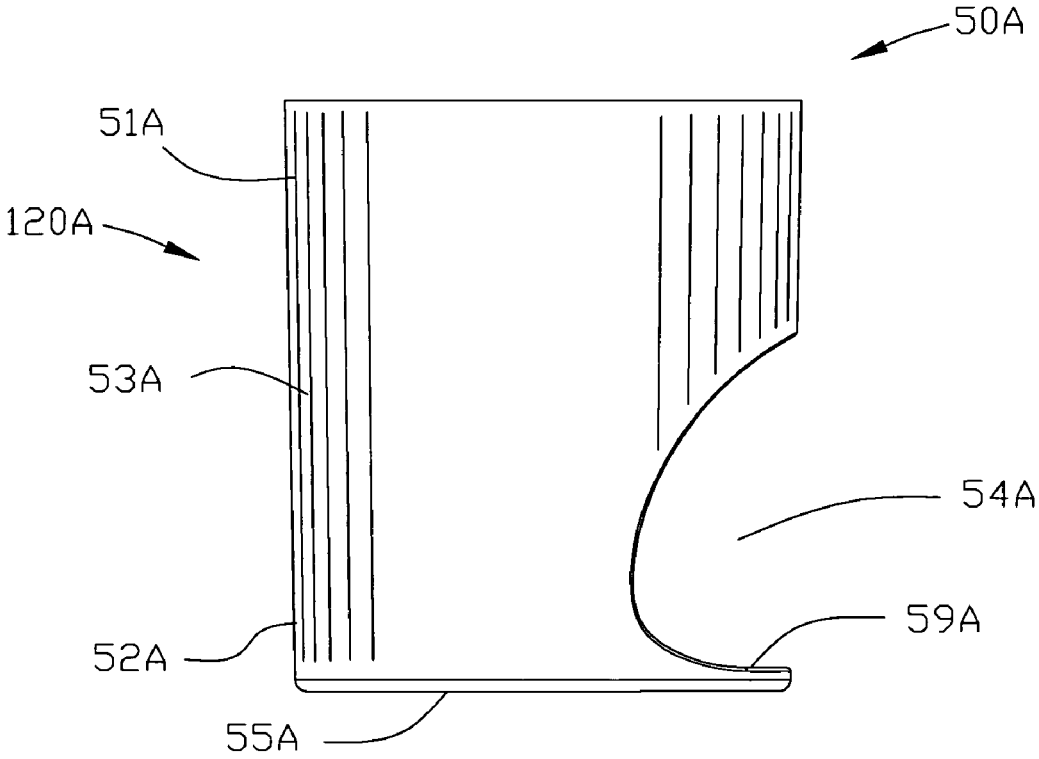
FIG. 18 is a side view of FIG. 17.
Figure 19:
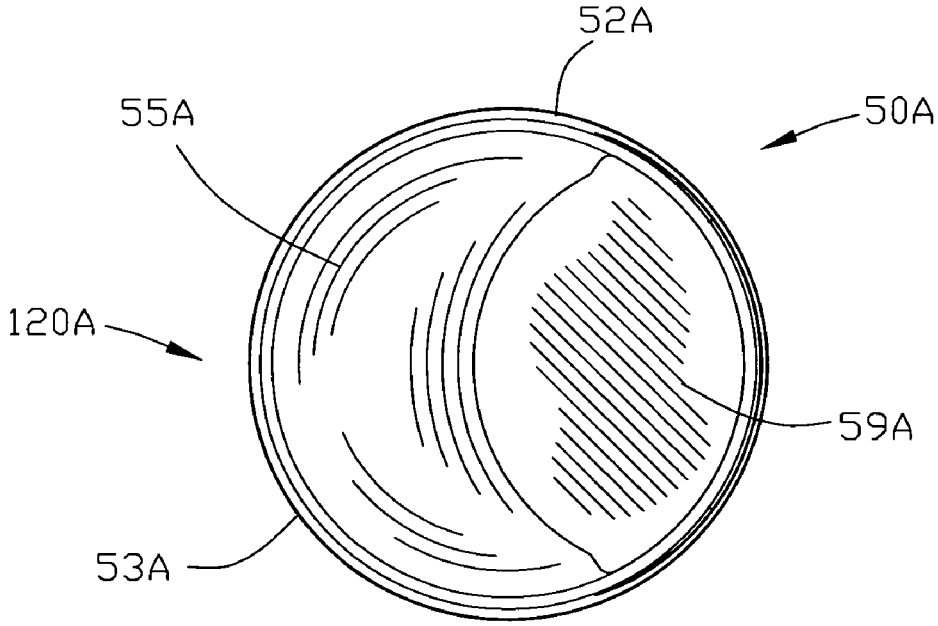
FIG. 19 is a bottom view of FIG. 18.
Figure 20:
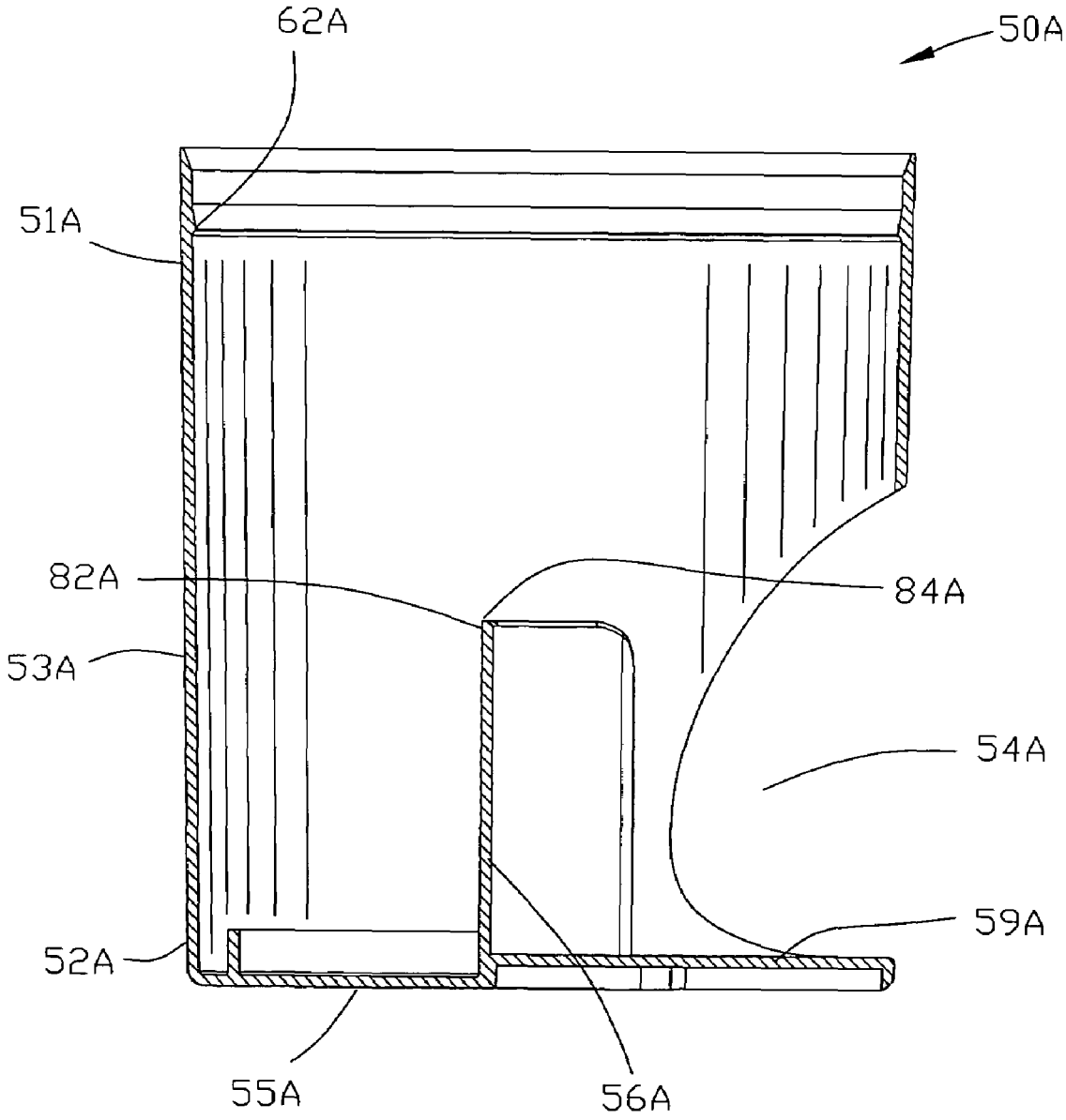
FIG. 20 is an enlarged sectional view along line 20—20 in FIG. 17.

FIG. 2 is a sectional view along line 2—2 in FIG. 1 illustrating the undercap 30A secured to the aerosol container 20A for supporting the aerosol container 20A on the supporting surface 18A. In this embodiment of the invention, the undercap 30A comprises a first undercap portion 40A and a second undercap portion 50A interconnected by a coupling 60A. The first undercap portion 40A is secured relative to the aerosol container 20A by a mounting 70A. The mounting 70A rotatably mounts the undercap 30A relative to the aerosol container 20A for rotational movement between an unlocked rotational position as shown in FIGS. 1 and 2 and a locked rotational position as shown in FIGS. 21 and 22.

FIG. 1 and 2 illustrate the bottom dispensing aerosol device 10A in an unattended condition. The bottom dispensing aerosol device 10A includes an actuator 80A and a nozzle 90A. The nozzle 90A is connected to an aerosol valve 100A secured to the aerosol container 20A by a mounting cup 110A.

The actuator 80A includes a first actuator surface 81A defined by the first undercap portion 40A and a second actuator surface 82A defined by the second undercap portion 50A. The engagement of the first actuator surface 81A with the second actuator surface 82A moves the valve stem 102A to actuate the aerosol valve 100A. The actuator 80A actuates the aerosol valve 100A for enabling the flow of the aerosol product 14A from the aerosol container 20A under the pressure of the aerosol propellant 16A to be discharged from the nozzle 90A. The bottom dispensing aerosol device 10A discharges the aerosol product 14A while the undercap 30A supports the aerosol container 20A in the inverted position on the supporting surface 18A.

Figure 21:
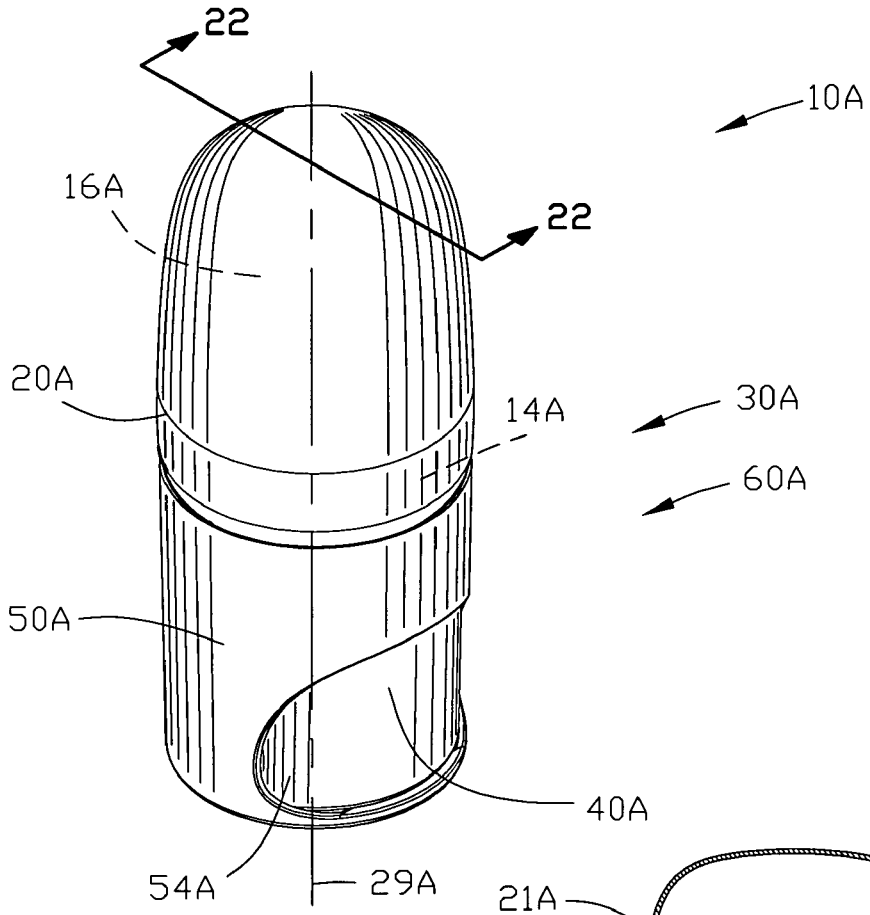
FIG. 21 is a top isometric view similar to FIG. 1 with the undercap being rotated into a locked rotational position.
Figure 22:
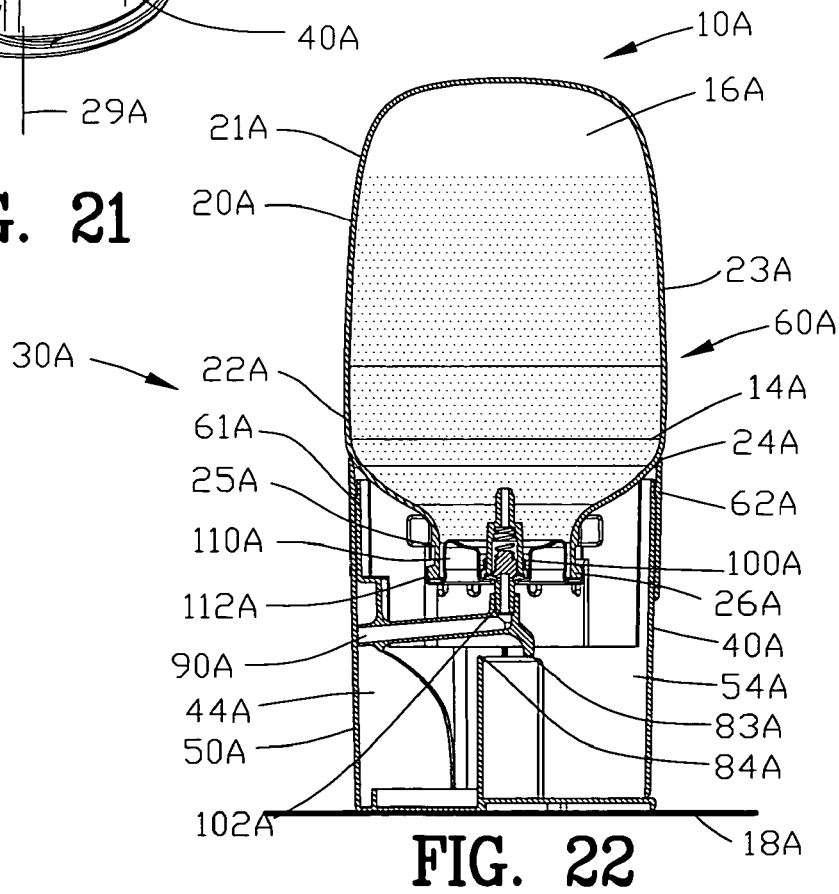
FIG. 22 is a sectional view along line 22—22 in FIG. 21.
Figure 23:
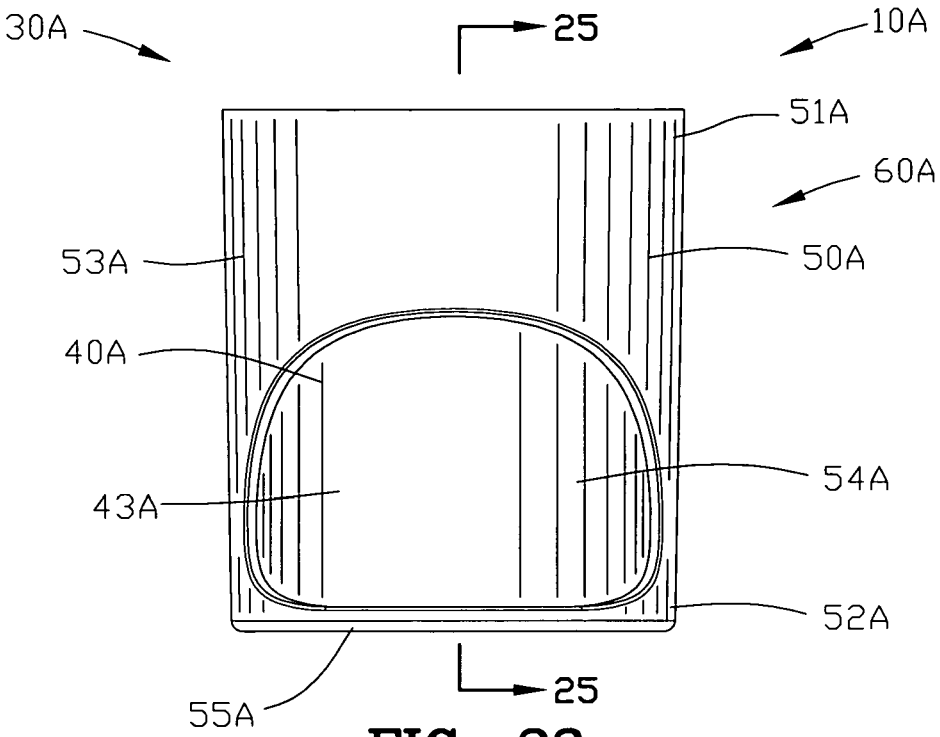
FIG. 23 is an enlarged front view of the undercap of FIG. 21.
Figure 24:
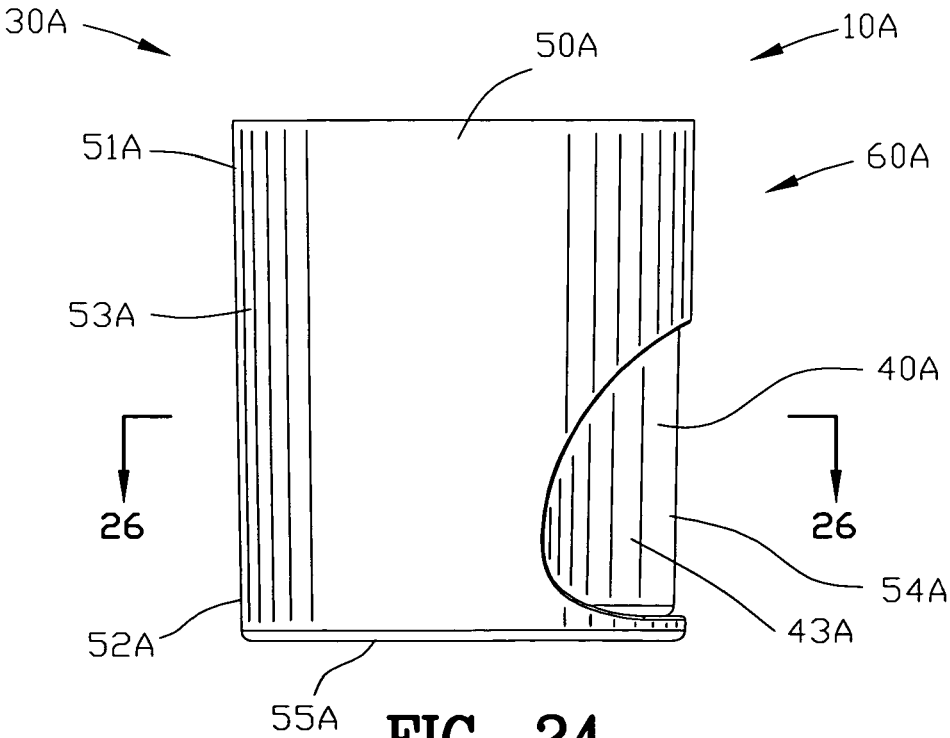
FIG. 24 is a side view of FIG. 23.
Figure 25:
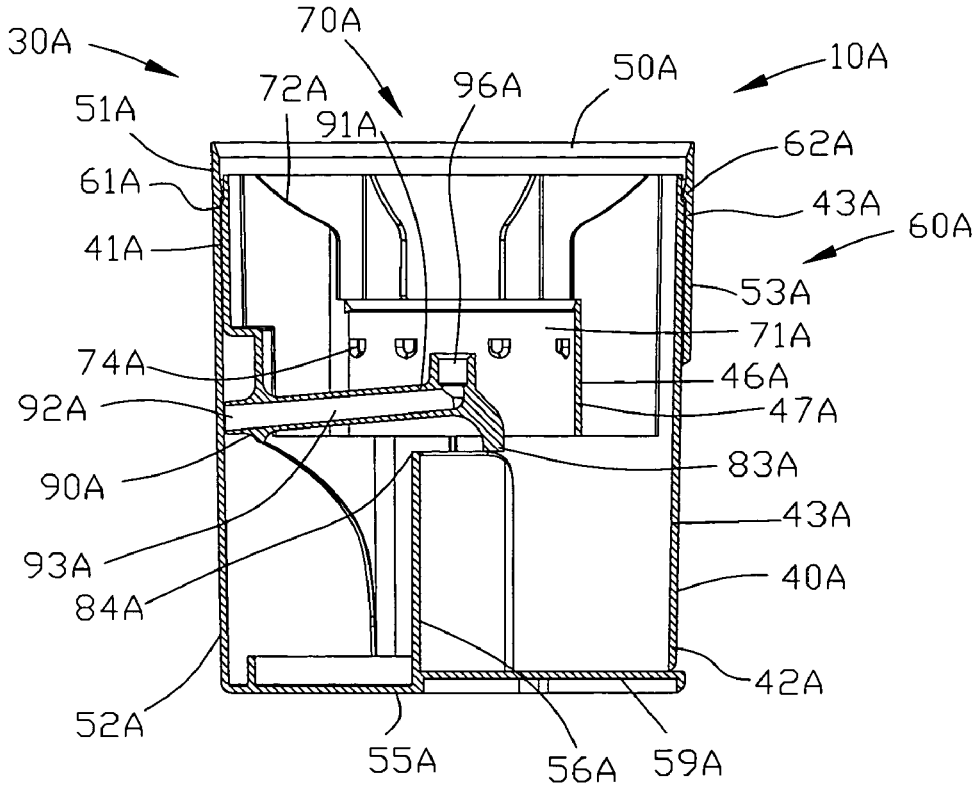
FIG. 25 is a sectional view along line 25—25 in FIG. 23.
Figure 26:
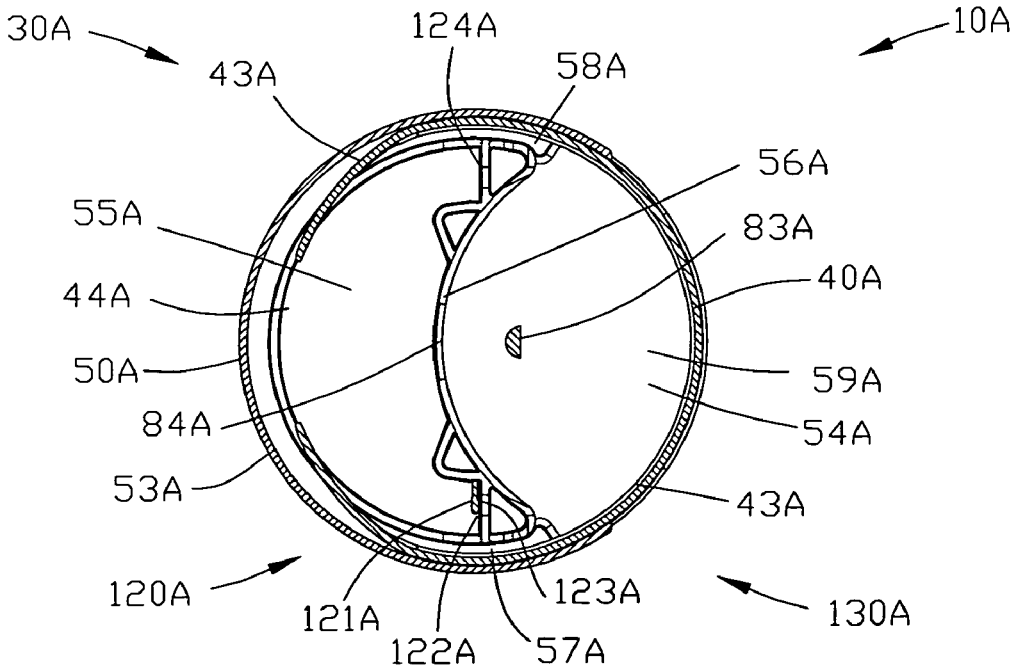
FIG. 26 is a sectional view along line 26—26 in FIG. 24.

Preferably, the bottom dispensing aerosol device 10A includes an undercap locator 120A for locating the undercap 30A in the unlocked rotational position as shown in FIGS. 1 and 2 and the locked rotational position as shown in FIGS. 21 and 22. When the undercap 30A in the unlocked rotational position, the actuator 80A may actuate the aerosol valve 100A to dispense the aerosol product 14A. When the undercap 30A in the locked rotational position, the actuator 80A is inhibited from actuating the aerosol valve 100A.

The container 20A is shown as a container of unique design disposed in an inverted orientation. The aerosol container 20A extends between a top portion 21A and a bottom portion 22A. The top portion 21A of the aerosol container 20A is closed by an endwall. The aerosol container 20A defines a cylindrical sidewall 23A defining a container rim 24A extending about an outer diameter of the aerosol container 20A. The bottom portion 22A of the aerosol container 20A tapers radially inwardly into a neck 25A terminating in a bead 26A. The aerosol container 20A defines an axis of symmetry 29A. The aerosol container 20A may be made of a metallic material or a non-metallic material. In this example, the aerosol container 20A is shown as a molded bottle formed from a polymeric material.

The bead 26A supports the aerosol mounting cup 110A for sealably securing the aerosol valve 100A to the aerosol container 20A. The aerosol valve 100A has a valve stem 102A extending therefrom. The aerosol valve 100A is secured into the aerosol mounting cup 110A in a conventional fashion. The aerosol mounting cup 110A includes a peripheral rim 112A that is crimped to the bead 26A of the container 20A for sealably securing the aerosol valve 100A to the aerosol container 20A. The aerosol valve 100A is located at the bottom portion 22A of the aerosol container 20A with the valve stem 102A extending downward from the aerosol container 20A. The valve stem 102A displaces the aerosol valve from a biased closed position to an open position upon a movement of the valve stem 112A to discharge the aerosol product 14A as should be well known to those skilled in the art.

The aerosol product 14A is contained near the bottom portion 22A of the aerosol container 20A whereas the aerosol propellant 16A is contained near the top portion 21A of the aerosol container 20A. The bottom dispensing aerosol device 10A is especially suited for dispensing viscous products like shampoo, hair conditioner, lotions, liquid soap, hair gel, hair mousse and non-foaming and foaming products such as a foaming dentifrice and the like. In addition, the aerosol dispensing device 10A is especially suited for dispensing viscous food products such as ketchup, mustard, mayonnaise and the like. The aerosol propellant 16A may be compressed gas, carbon dioxide or any other suitable propellant.

FIGS. 3–6 are enlarged views of portions of the first undercap portion 40A and second undercap portion 50A. The first undercap portion 40A has a top 41A and a bottom 42A with a sidewall 43A extending therebetween. A first access aperture 44A is defined in the sidewall 43A of the first undercap portion 40A. Preferably, the first undercap portion 40A is formed from a unitary and resilient polymeric material such as polypropylene, polyethylene, polyolyfin or any other suitable polymeric material.

The second undercap portion 50A has a top 51A and a bottom 52A with a sidewall 53A extending therebetween. A second access aperture 54A is defined in the sidewall 53A of the second undercap portion 50A. Preferably, the second undercap portion 50A is formed from a unitary and resilient polymeric material such as polypropylene, polyethylene, polyolyfin or any other suitable polymeric material.

The coupling 60A comprises a first coupling element 61A and second coupling element 62A defined by the first and second undercap portions 40A and 50A. In this embodiment of the invention, the first coupling element 61A comprises an annular depression extending inwardly within the first undercap portion 40A. The second coupling element 62A comprises an annular projection extending inwardly from the second undercap portions 50A.

The first undercap portion 40A is inserted into the second undercap portion 50A. Preferably, the annular projection of the second coupling element 62A is snapped over the sidewall 43A of the first undercap portion 40A to form a rotational snap locking engagement with the annular depression of the first coupling element 61A of the first undercap portion 40A. The first undercap portion 40A and/or the second undercap portion 50A is deformed when the second coupling element 62A passes over the sidewall 43A of the first undercap portion 40A.

FIGS. 7–13 are various views of the first undercap portion 40A shown in FIGS. 1–6. The first undercap portion 40A includes a central opening 46A surrounded by a first inner wall 47A disposed coaxial with the sidewall 43A. The first inner wall 47A is substantially cylindrical and extends upwardly from an intermediate location between the first and second ends 41A and 42A of the first undercap portion 40A.

A plurality of radial ribs 48A extend radially inwardly from the sidewall 43A to the first inner wall 47A. Each of the plurality of radial ribs 48A extends longitudinally past the first inner wall 47A to the first end 41A of the first undercap portion 40A. The plurality of radial ribs 48A support and coaxially align the first inner wall 47A with the sidewall 43A. Preferably, the plurality of radial ribs 48A are uniformly spaced about the axis of symmetry 29A.

The first coupling element 61A is shown as the annular depression located at the first end 41A of the first undercap portion 40A. The annular depression of the first coupling element 61A extends axially from the first end 41A toward the second end 42A of first undercap portion 40A. The annular depression defines an axial length sufficient for enabling longitudinal axial movement between the first and second undercap portions 40A and 50A as will be described in greater detail hereinafter.

The first undercap portion 40A is secured to the aerosol container 20A by a mounting shown generally as 70A. The mounting 70A mounts the first undercap portion 40A to the aerosol container 20A with the first end 41A of the first undercap portion 40A being adjacent to the second end 22A of the aerosol container 20A. In the example, the mounting 70A comprises the first inner wall 47A having recesses 71A in combination with each of the plurality of radial ribs 48A having a tapered end 72A. A plurality of stops 74A locate the first undercap portion 40A to the aerosol container 20A.

In this example of the invention, the recesses 71A of the first inner wall 47A secures the first undercap portion 40A to the peripheral rim 112A of the aerosol mounting cup 110A. Preferably, the recess 71A of the first undercap portion 40A is frictionally secured to the peripheral rim 112A of the aerosol mounting cup 110A while the tapered end 72A of the plurality of radial ribs 48A engage with the second end 22A of the aerosol container 20A. The plurality of stops 74A position the peripheral rim 112A of the aerosol mounting cup 110A within the first undercap portion 40A.

The nozzle 90A extends between a proximal end 91A and a distal end 92A interconnected by a channel 93A. The proximal end 91A of the nozzle 90A includes a socket 96A for frictionally receiving the valve stem 112A of the aerosol valve 100A. The distal end 92A of the nozzle 90A defines a terminal orifice 98A.

In this first embodiment of the invention, the nozzle 90A integrally formed with the first undercap portion 40A. The distal end 92A of the nozzle 90A is integrally secured to the sidewall 43A of the first undercap portion 40A. The flexibility of the sidewall 43A of the first undercap portion 40A provides a hinge 94A for the nozzle 90A. The hinge 94A has a pivot axis substantially perpendicular to the axis of symmetry 29A. The hinge 94A allows the proximal end 91A of the nozzle 90A to move vertically for operating the valve stem 102A to actuate the aerosol valve 100A. The nozzle 90A and the hinge 94A are integrally connected to the first undercap portion 40A.

The terminal orifice 98A is located in proximity to the sidewall 43A of the first undercap portion 40A. The location of the terminal orifice 98A in proximity to the sidewall 43A of the first undercap portion 40A allows the dispensing the aerosol product 14A outside of the undercap 30A.

The first actuator surface 81A is defined by a protrusion 83A extending from the proximal end 91A of the nozzle 90A. The protrusion 83A extends downwardly for selective engagement with the second actuator surface 82A defined by the second undercap portion 50A. Upon engagement with the second actuator surface 82A, the first actuator surface 81 A moves the proximal end 91A of the nozzle 90A about the hinge 94A for operating the valve stem 102A to actuate the aerosol valve 100A.

The undercap locator 120A comprises a first undercap locator 121A located in the first undercap portion 40A. The first undercap locator 121 A depends from the one of the plurality of radial ribs 48A of the first undercap portion 40A. The operation of the undercap locator 120A will be more fully explained hereinafter.

FIGS. 14–20 are various views of the second undercap portion 50A shown in FIGS. 1–6. The second undercap portion 50A includes a base 55A extending across the second end 52A of the second undercap portion 50A. The base 55A supports the aerosol container 20A on the supporting surface 18A in an inverted position. The bottom dispensing aerosol device 10A of the present invention is stored and used in an inverted position on the supporting surface 18A.

A second inner wall 56A is located within the interior of the second undercap portion 50A. The second inner wall 56A is a substantially arcuate wall extending upwardly from the base 55A to an intermediate location between the first and second ends 51A and 52A of the second undercap portion 50A.

The second inner wall 56A defines slots 57A and 58A between the opposed ends of the second inner wall 56A and the side wall 53A. The slots 57A and 58A provide a void for enabling the first undercap portion 40A to rotate within the second undercap portion 50A. The second inner wall 56A is integrally formed with the second undercap portion 50A.

The second coupling element 62A defined by the annular projection extending inwardly from the second undercap portions 50A and located at the first end 51A of the second undercap portion 50A. The annular projection of the second coupling element 62A has a shorter axial length than the axial length of the annular depression of the first undercap portion 40A. The shorter axial length of the annular projection relative to the axial length of the annular depression of the first undercap portion 40A enables longitudinal axial movement of the first undercap portions 40A relative to the second undercap portion 50A.

The coupling 60A rotatably mounts the first undercap portion 40A relative to the second undercap portion 50A. The coupling 60A linearly mounts the first undercap portion 40A relative to the second undercap portion 50A. The coupling 60A enables the combined rotational and linear movement between the first undercap portion 40A relative to the second undercap portion 50A.

The second inner wall 56A defines the second actuator surface 82A. A central portion 84A of the second inner wall 56A defines the second actuator surface 82A. The central portion 84A of the second inner wall 56A provides the selective engagement with the protrusion 83A extending from the proximal end 91A of the nozzle 90A. Upon an alignment of the protrusion 83A with the central portion 84A of the second inner wall 56A, the actuator 80A is positioned for actuating the aerosol valve 100A.

A platform 59A is disposed on the base 55A on a forward side of the second inner wall 56A. The platform 59A is raised relative to the base 55A for providing the locking function of the bottom dispensing aerosol device 10A as will be described in greater detail hereinafter.

The undercap locator 120A comprises a second undercap locator 122A located in the second undercap portion 50A. The second undercap locator 122A includes stops 123A and 124A extending from the second inner wall 56A. The stops 123A and 124A cooperate with the first undercap locator 121A for locating the unlocked and locked positions of the undercap 30A relative to the aerosol container 20A. The undercap locator 120A may be adapted to provide audible clicks upon reaching the unlocked and locked positions to further assist an operator.

FIGS. 21 and 22 are views similar to FIGS. 1 and 2 with the undercap 30A being rotated into a locked rotational position. The first undercap portion 40A is frictionally secured to the aerosol container 20A by the mounting 70A. The second undercap portion 50A is rotationally and linearly moveable relative to the first undercap portion 40A.

FIGS. 23–26 are various views of the first and second undercap portions 40A and 50A of FIGS. 21 and 22. The first undercap portion 40A and the aerosol container 20A is rotated into the locked rotational position relative to second undercap portion 50A.

The first undercap portion 40A and the aerosol container 20A is rotated in a counterclockwise direction relative to second undercap portion 50A until the first undercap locator 121 A engages with the stop 123A of the second undercap locator 122A to locate the locked position of the undercap 30A relative to the aerosol container 20A.

In the locked position, a portion of the sidewall 43A of the first undercap portion 40A is rotated to cover the second access aperture 54A of the second undercap portion 50A. The covering of the second access aperture 54A of the second undercap portion 50A inhibits access to the actuator 80A within the undercap 30A.

The second end 42A of the first undercap portion 40A is positioned over the platform 59A of the second undercap portion 50A. Since the platform 59A is elevated relative to the base 55A of the second undercap portion 50A, the platform 59A inhibits a downward linear movement of the first undercap portion 40A relative to the second undercap portion 50A. The inhibited downward linear movement of the first undercap portion 40A inhibits actuation of the aerosol valve 100A and the dispensing of the aerosol product 14A therefrom.

Figure 27:
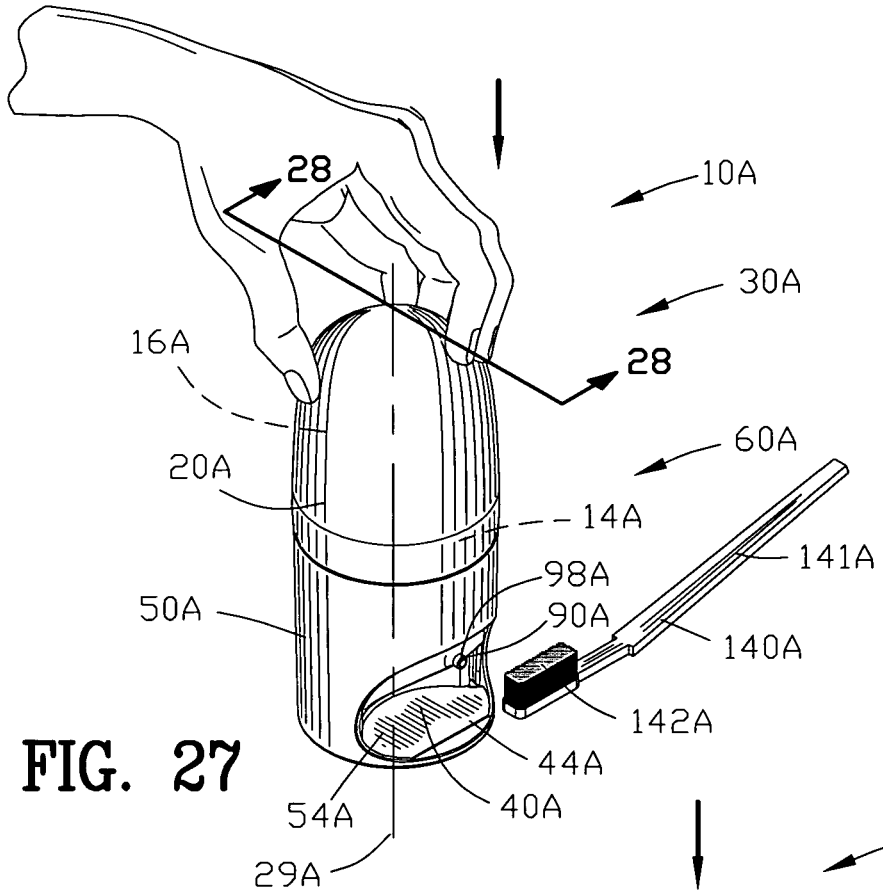
FIG. 27 is a top isometric view similar to FIG. 1 with the undercap being rotated into an unlocked rotational position and with the actuator shown in an actuated position.
Figure 28:
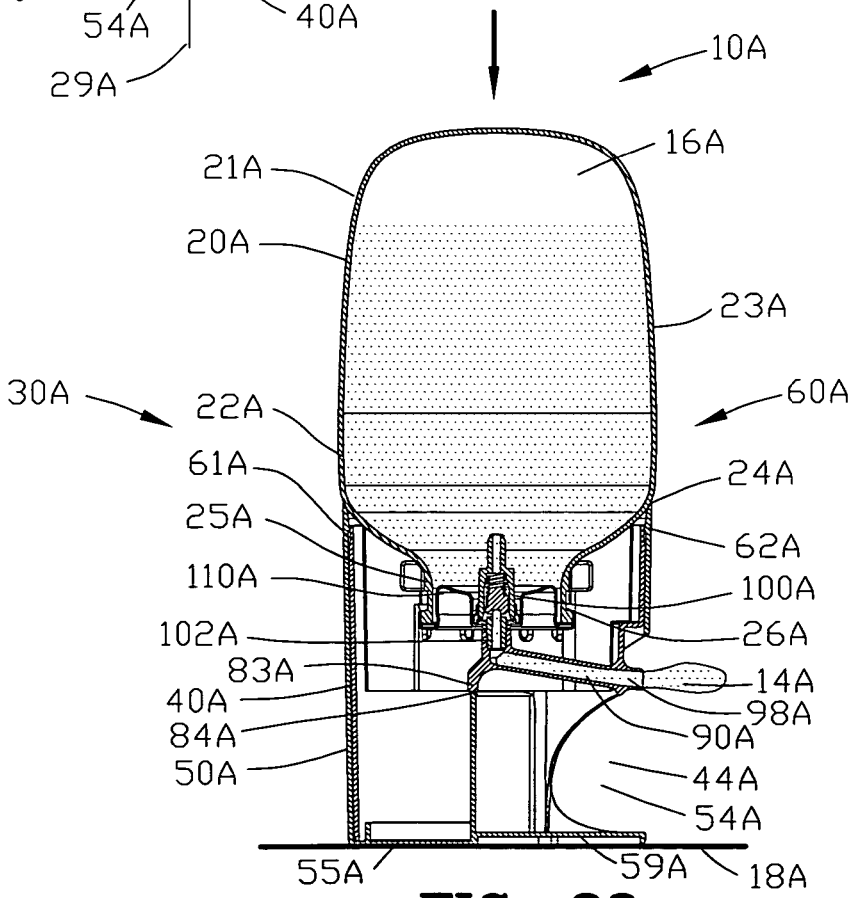
FIG. 28 is a sectional view along line 28—28 in FIG. 27.

FIGS. 27 and 28 are views similar to FIGS. 21 and 22 with the undercap 30A being rotated to return into the unlocked rotational position. The bottom dispensing aerosol device 10A is shown in an actuated condition for dispensing the aerosol product 14A from the terminal orifice 98A.

In the unlocked position, the first access aperture 44A of the first undercap portion 40A is rotated into alignment with the second access aperture 54A of the second undercap portion 50A. The alignment of the first access aperture 44A with the second access aperture 54A permits access to the to the actuator 80A within the undercap 30A.

In this example, the aerosol product 14A is shown as a foaming tooth dentifrice for use with a conventional toothbrush 140A having a handle 141A and bristles 142A. Although the aerosol product 14A is shown as a foaming tooth dentifrice for use with a conventional toothbrush 140A, it should be understood that various other aerosol products 14A may be dispensed by the bottom dispensing aerosol device 10A of the present invention. In addition, it should be understood that the aerosol product 14A may be dispensed directly onto a surface such as a dispensing a cream or a lotion onto a finger of a user and the like.

Figure 29:
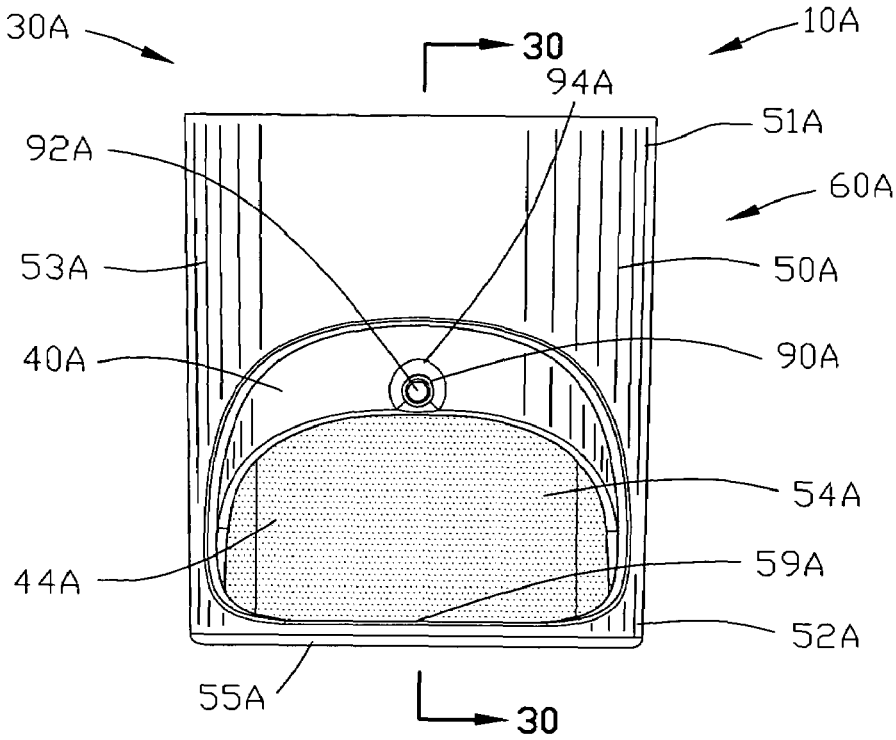
FIG. 29 is an enlarged front view of the undercap of FIG. 27.
Figure 30:
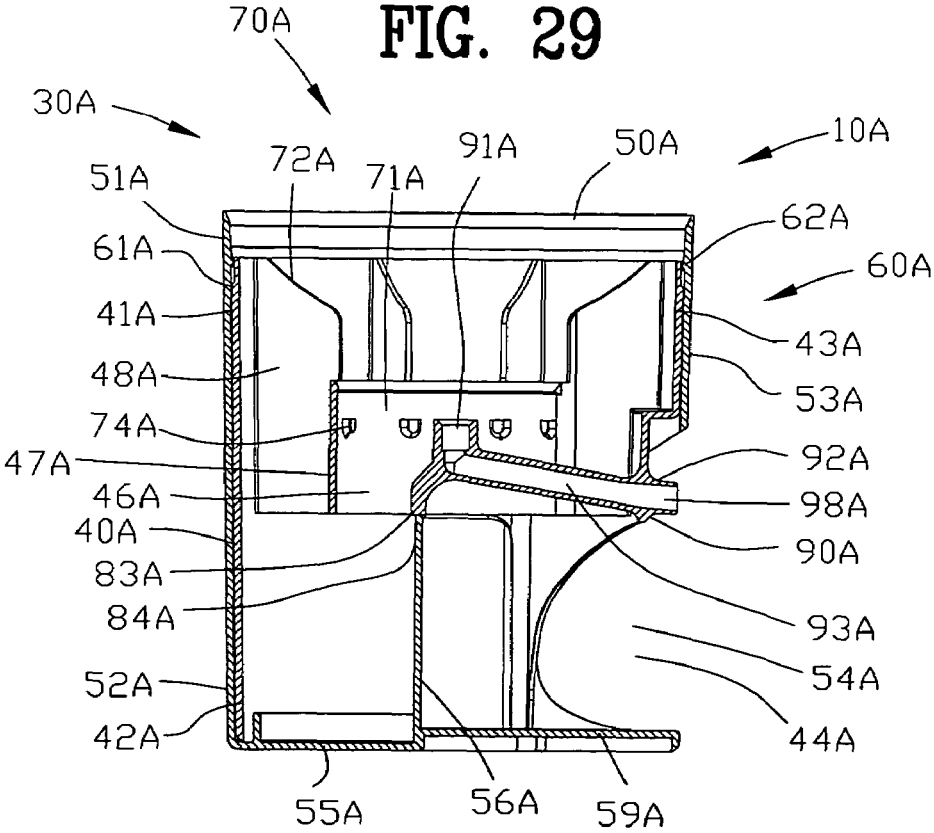
FIG. 30 is an enlarged sectional view of the undercap of FIG. 28.

FIGS. 29–30 are various views of the first and second undercap portions 40A and 50A of FIGS. 27 and 28. The first undercap portion 40A and the aerosol container 20A are rotated into the unlocked rotational position relative to second undercap portion 50A. The first undercap portion 40A and the aerosol container 20A are rotated in a clockwise direction relative to second undercap portion 50A until the first undercap locator 121A engages with the stop 124A of the second undercap locator 122A to locate the unlocked position of the undercap 30A relative to the aerosol container 20A.

The second end 42A of the first undercap portion 40A is positioned over the base 55A of the second undercap portion 50A. Since the base 55A is lower than the platform 59A of the second undercap portion 50A, the base 55A permits a downward linear movement of the first undercap portion 40A relative to the second undercap portion 50A.

A downward pressure applied by an operator to the first end 21A of the aerosol container 20A, moves the first undercap portion 40A downwardly relative to the second undercap portion 50A. The projection 83A of the first actuator surface 81A engages with the central portion 84A on the second inner wall 56A of the second actuator surface 82A A continued downward pressure applied by the operator to the engaging projection 83A and the central portion 84A causes movement of the proximal end 91A of the nozzle 90A about the hinge 94A to depress the valve stem 102A of the aerosol valve 100A. The depression of the valve stem 102A displaces the aerosol valve 100A from a biased closed position to an open position against the urging of a valve spring (not shown). When the valve stem 102A displaces the aerosol valve 100A into the open position, the aerosol product 14A is dispensed under the pressure of the aerosol propellant 16A from the terminal orifice 98A of the nozzle 90A.

Upon the removal of the downward pressure applied by the operator, a valve spring (not shown) within the aerosol valve 100A moves the returns the aerosol valve 100A into a closed position. Concomitantly therewith, the valve spring (not shown) within the aerosol valve 100A moves the first undercap portion 40A and the aerosol container 20A upwardly relative to the second undercap portion 50A to a position shown in FIGS. 1 and 2.

The aerosol valve 100A has been shown as a vertical action valve wherein a vertical depression of the valve stem 102A displaces the aerosol valve 100A from the biased closed position to the open position. However, it should be understood that the invention may be modified to function with a tilt action valve wherein a tilting movement of the valve stem 102A displaces the aerosol valve 100A from the biased closed position to the open position.

Figure 31:
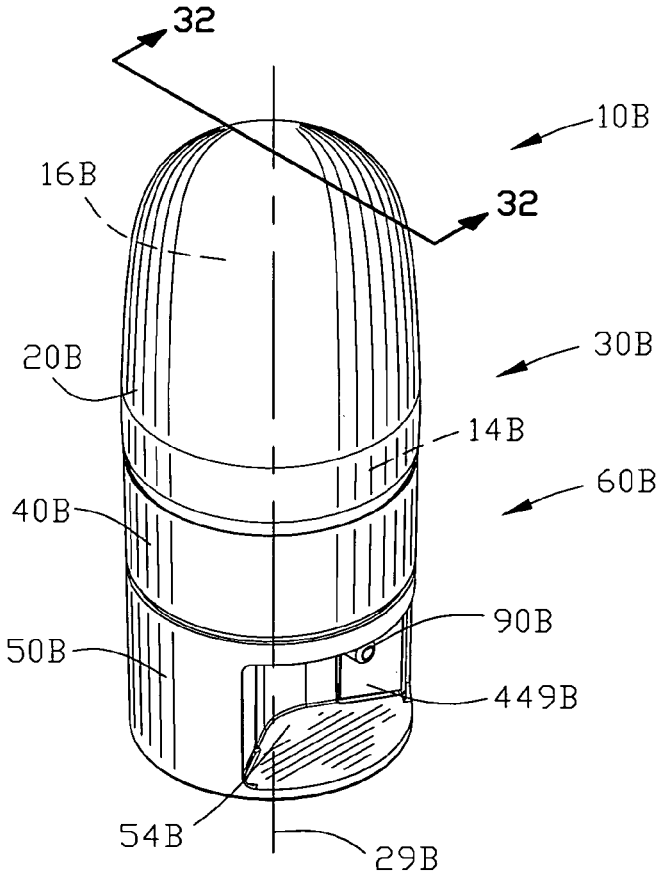
FIG. 31 is a top isometric view of a second embodiment of a bottom dispensing aerosol device incorporating the present invention with the undercap being rotated into an unlocked rotational position.
Figure 32:
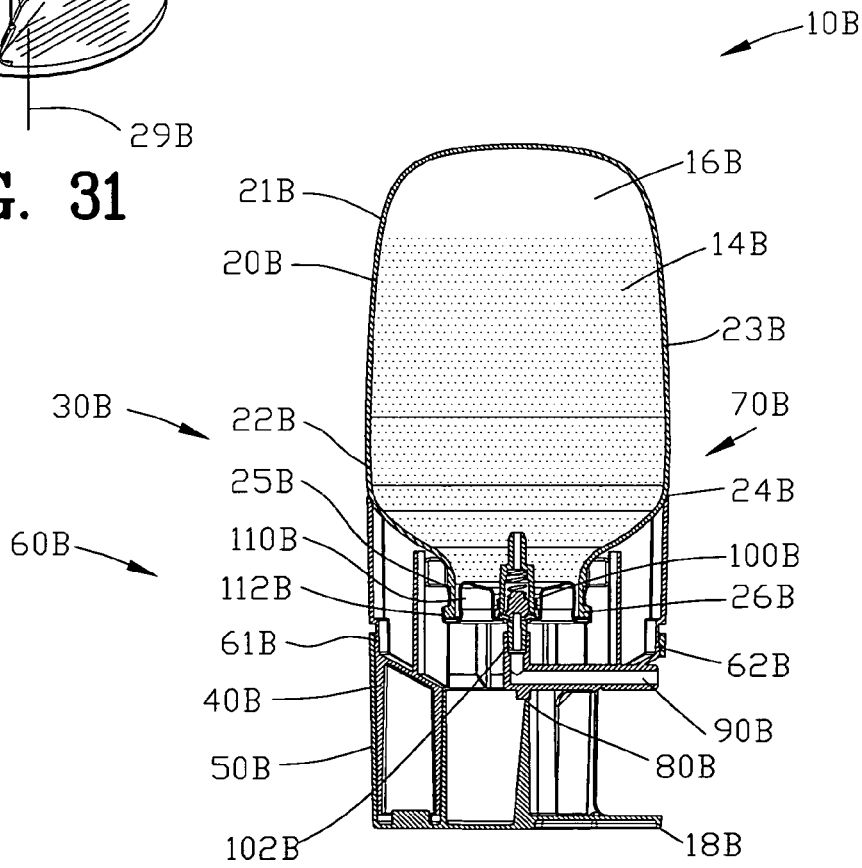
FIG. 32 is a sectional view along line 32—32 in FIG. 31.
Figure 33:
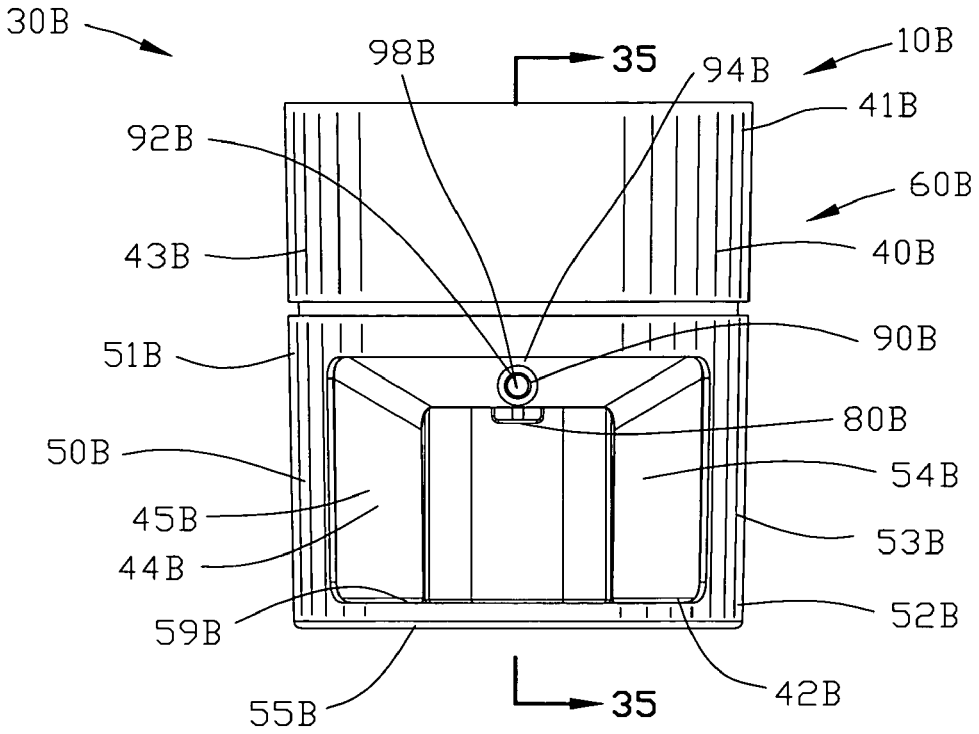
FIG. 33 is an enlarged front view of the undercap of FIG. 31.
Figure 34:
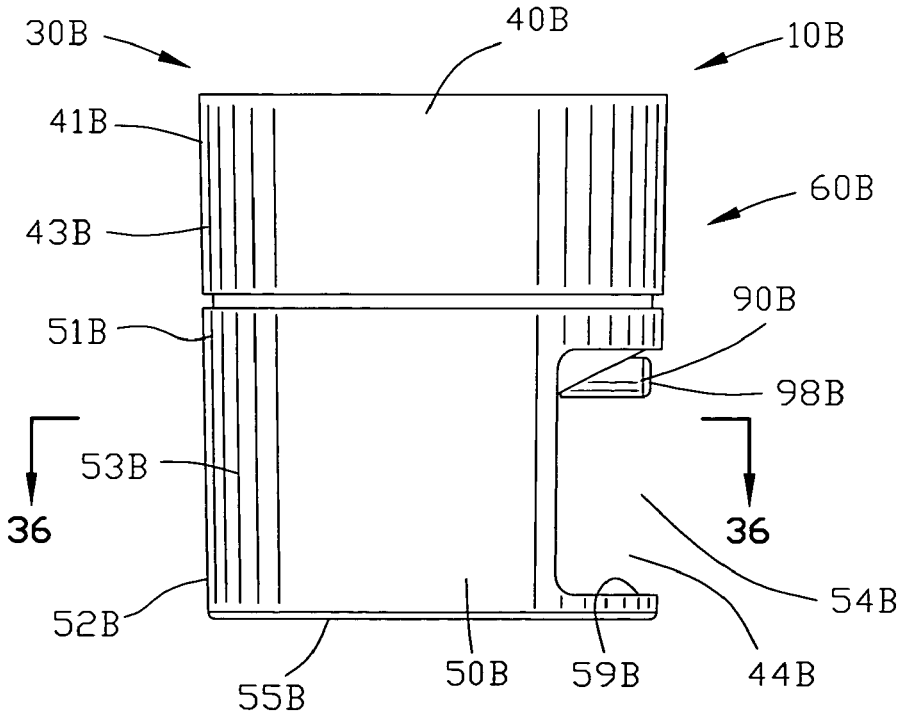
FIG. 34 is a side view of FIG. 33.
Figure 35:
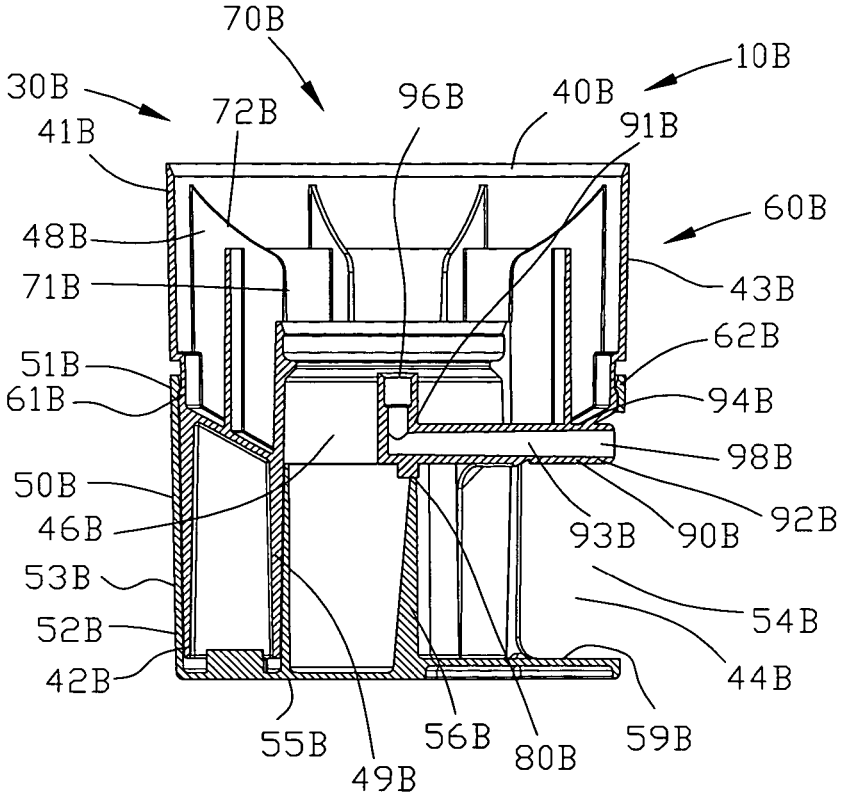
FIG. 35 is a sectional view along line 35—35 in FIG. 33.
Figure 36:
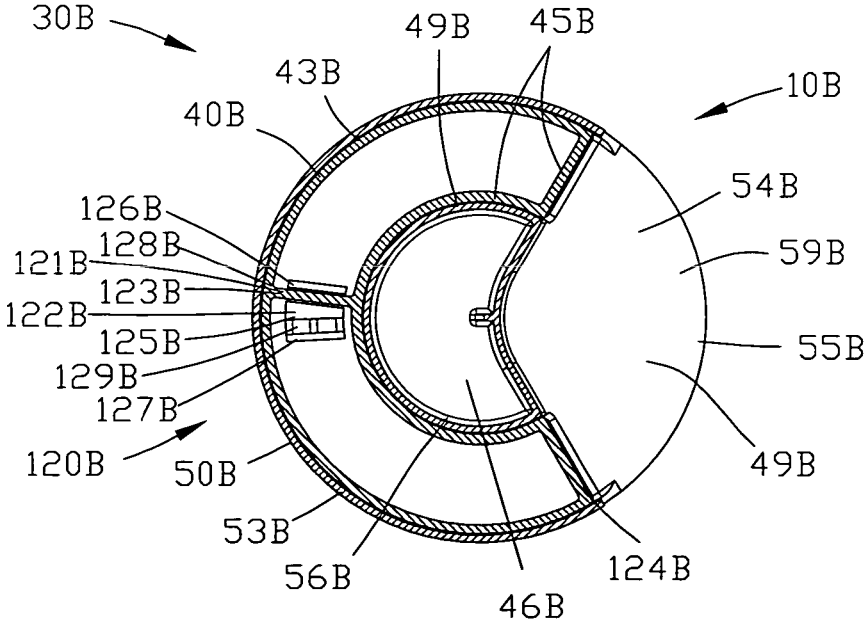
FIG. 36 is a sectional view along line 36—36 in FIG. 34.
Figure 37:
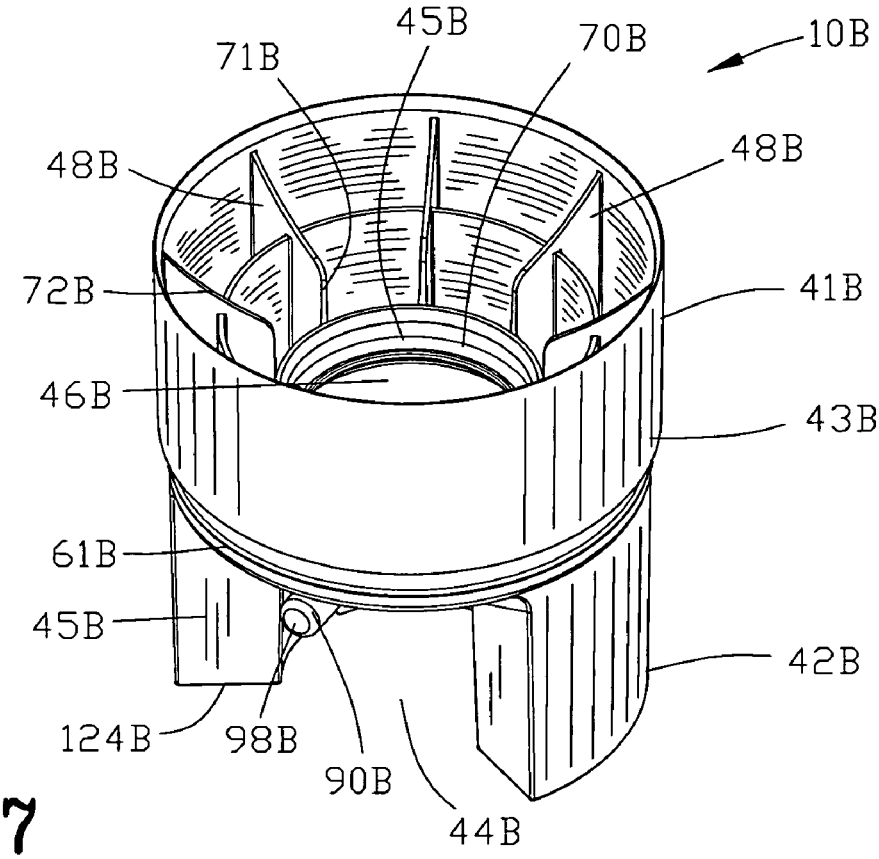
FIG. 37 is a top isometric view of a first undercap portion of the undercap of FIGS. 31–36.
Figure 38:
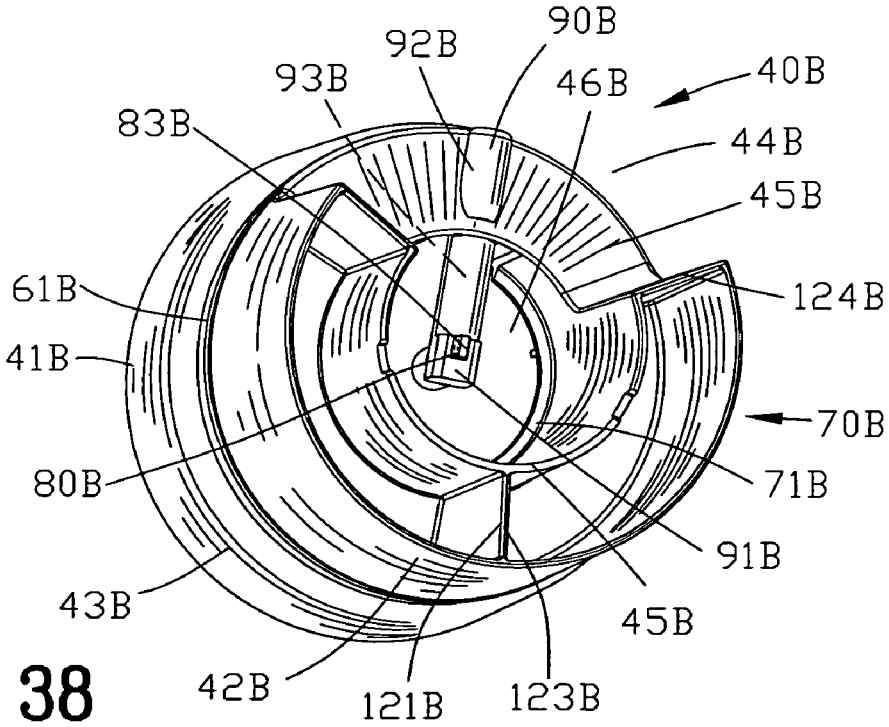
FIG. 38 is a bottom isometric view of the first undercap portion of FIG. 37.
Figure 39:
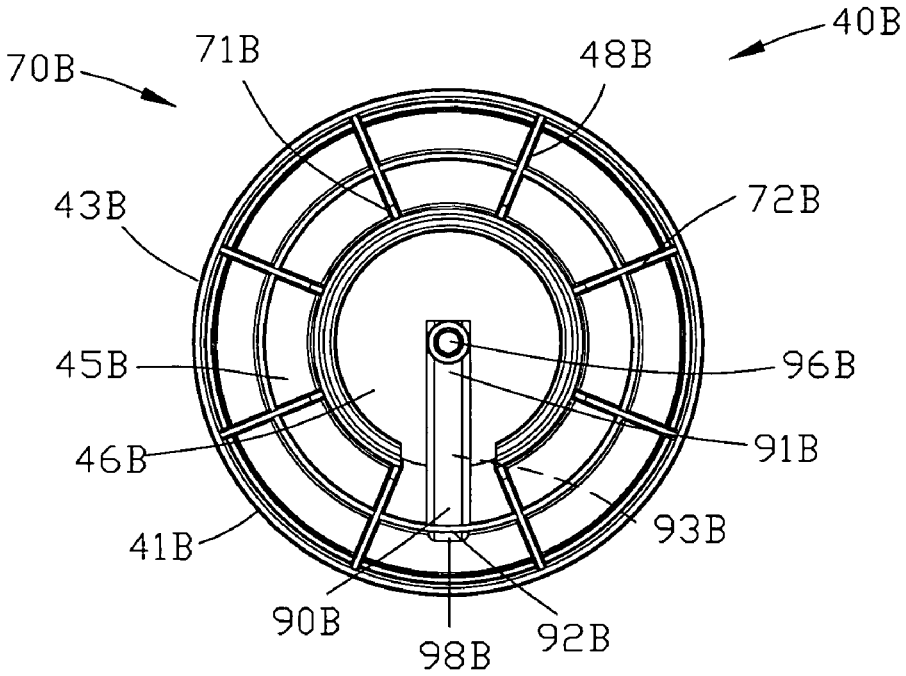
FIG. 39 is a top view of the first undercap portion of FIG. 37.
Figure 40:
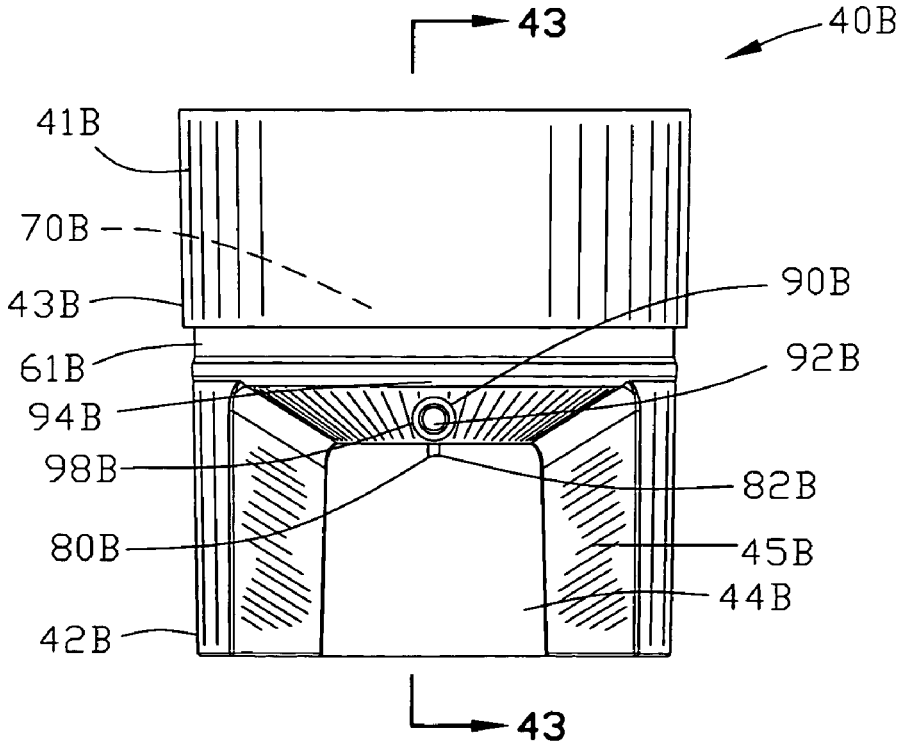
FIG. 40 is a front view of FIG. 39.
Figure 41:
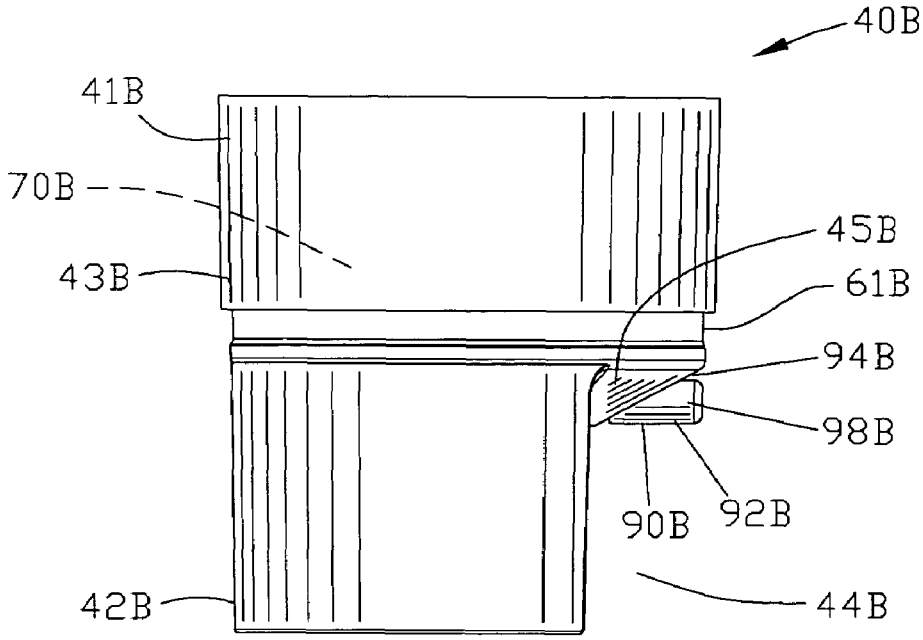
FIG. 41 is a side view of FIG. 40.
Figure 42:
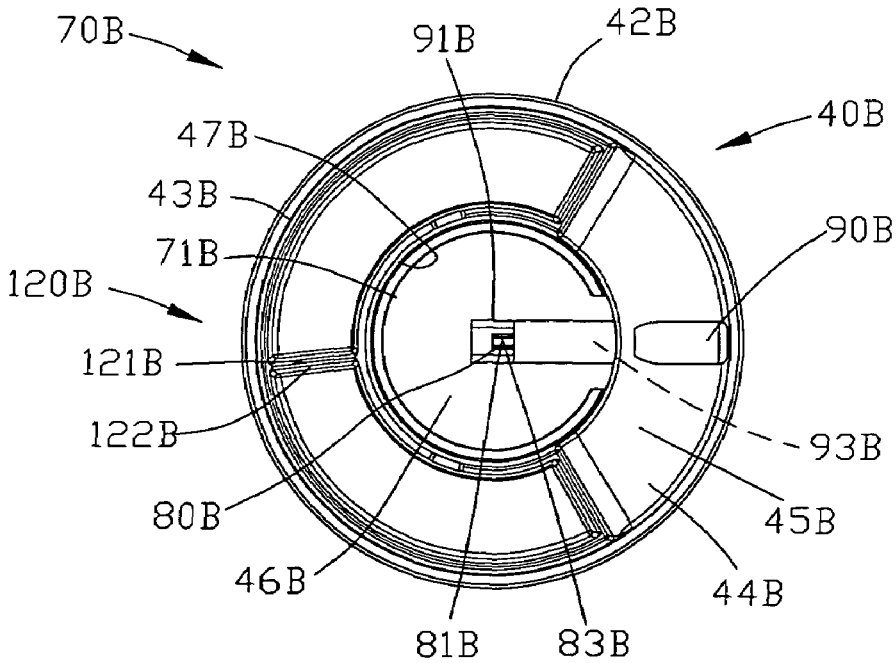
FIG. 42 is a bottom view of FIG. 42.
Figure 43:
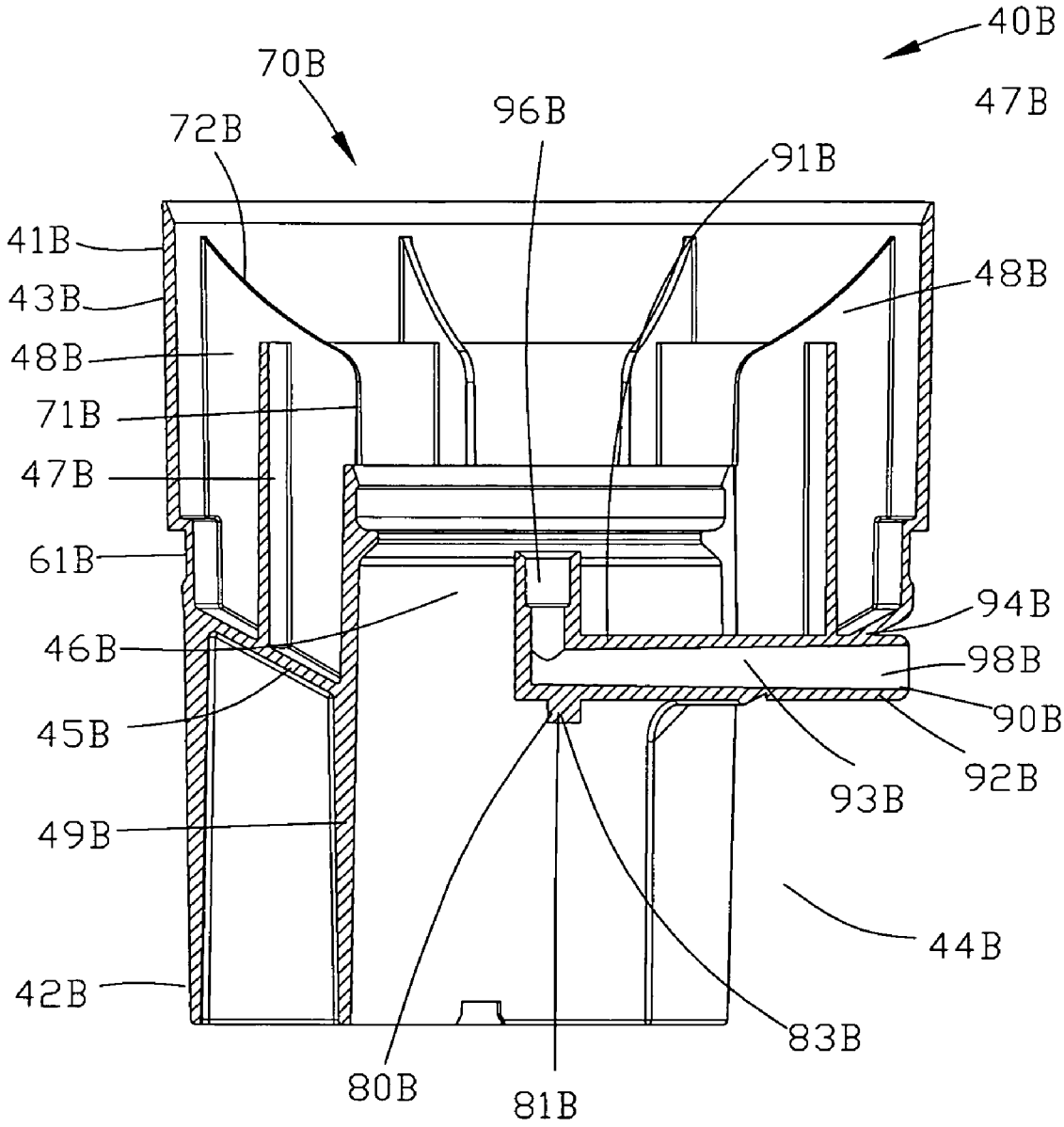
FIG. 43 is an enlarged sectional view along line 43—43 in FIG. 40.
Figure 44:
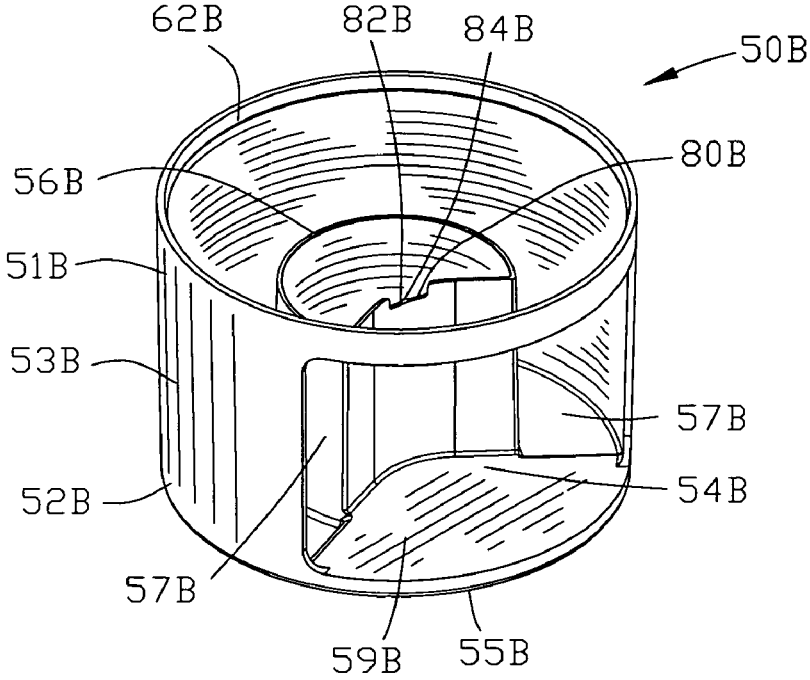
FIG. 44 is a top isometric view of a second undercap portion of the undercap of FIGS. 31–36.
Figure 45:
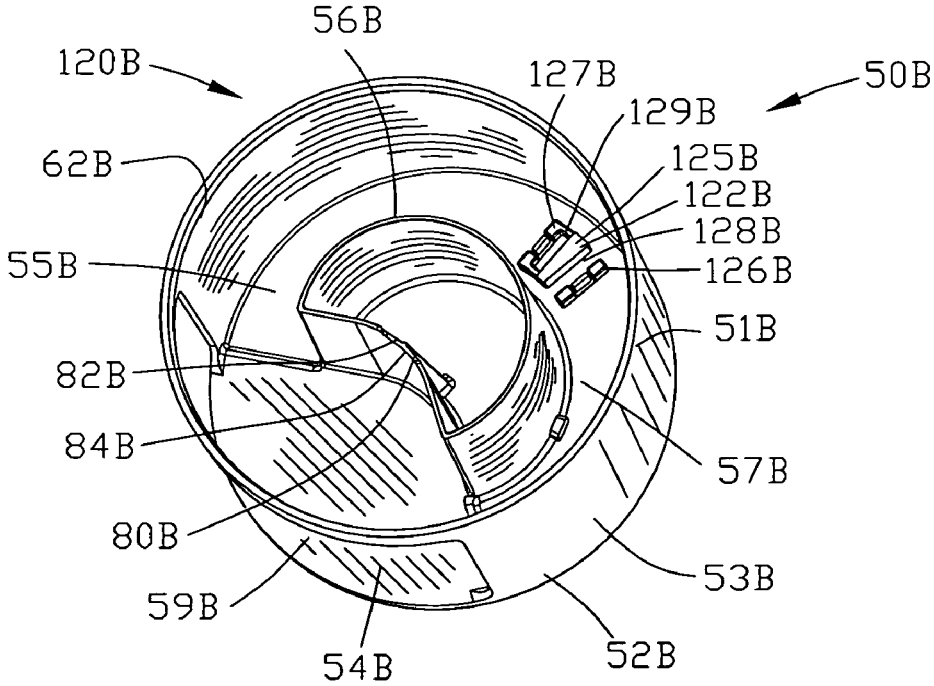
FIG. 45 is a further top isometric view of the first undercap portion of FIG. 44.
Figure 46:
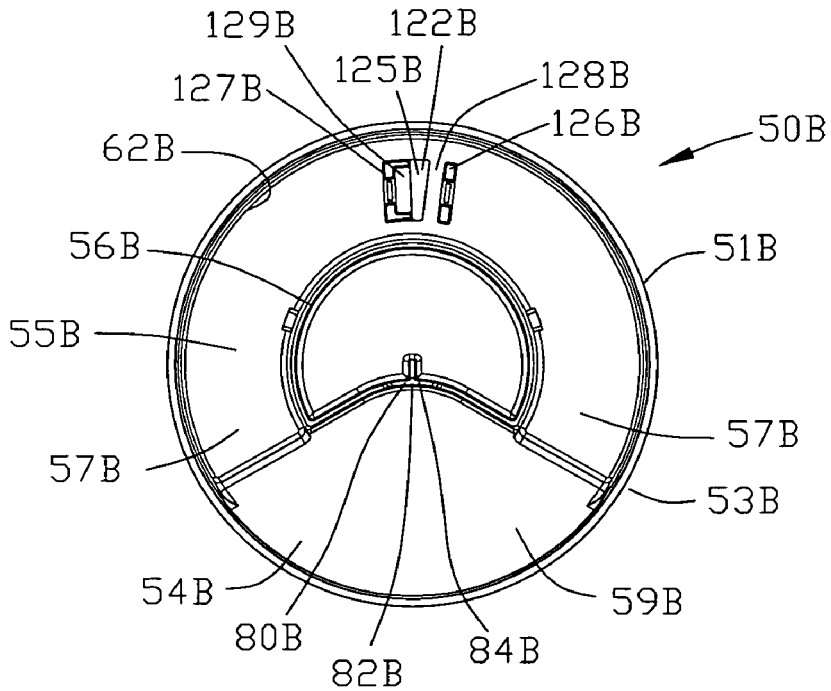
FIG. 46 is a top view of the first undercap portion of FIG. 44.
Figure 47:
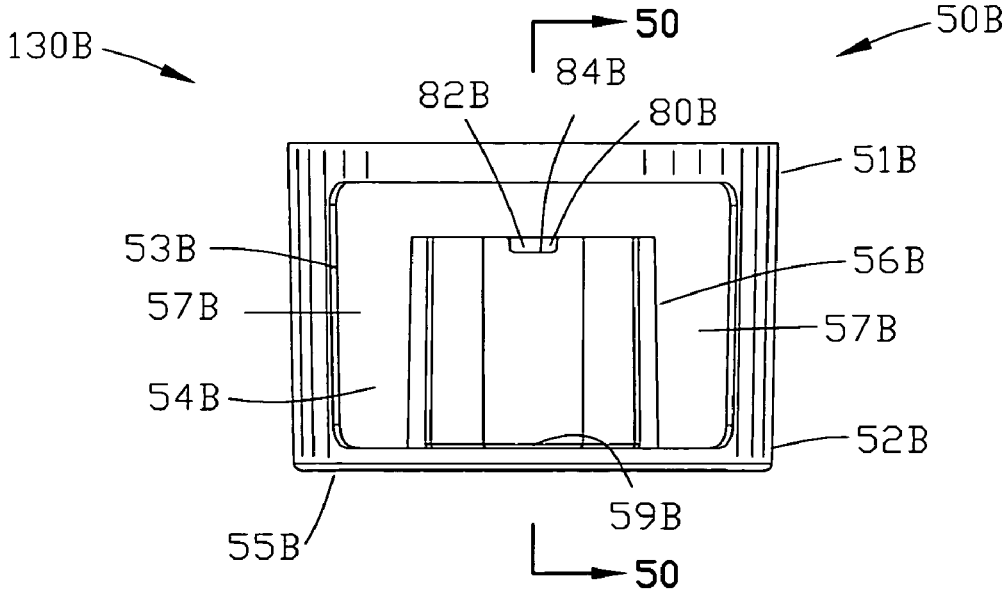
FIG. 47 is a front view of FIG. 46.
Figure 48:
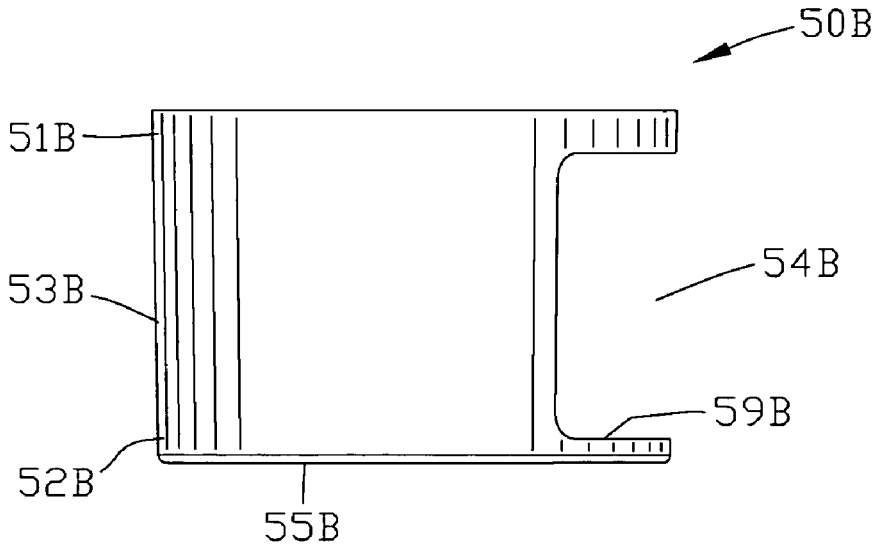
FIG. 48 is a side view of FIG. 47.
Figure 49:
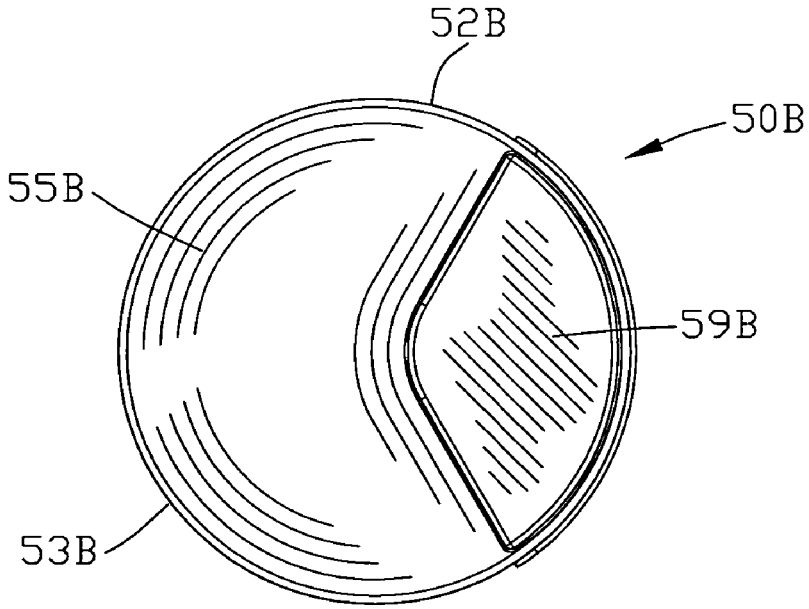
FIG. 49 is a top view of FIG. 48.
Figure 50:
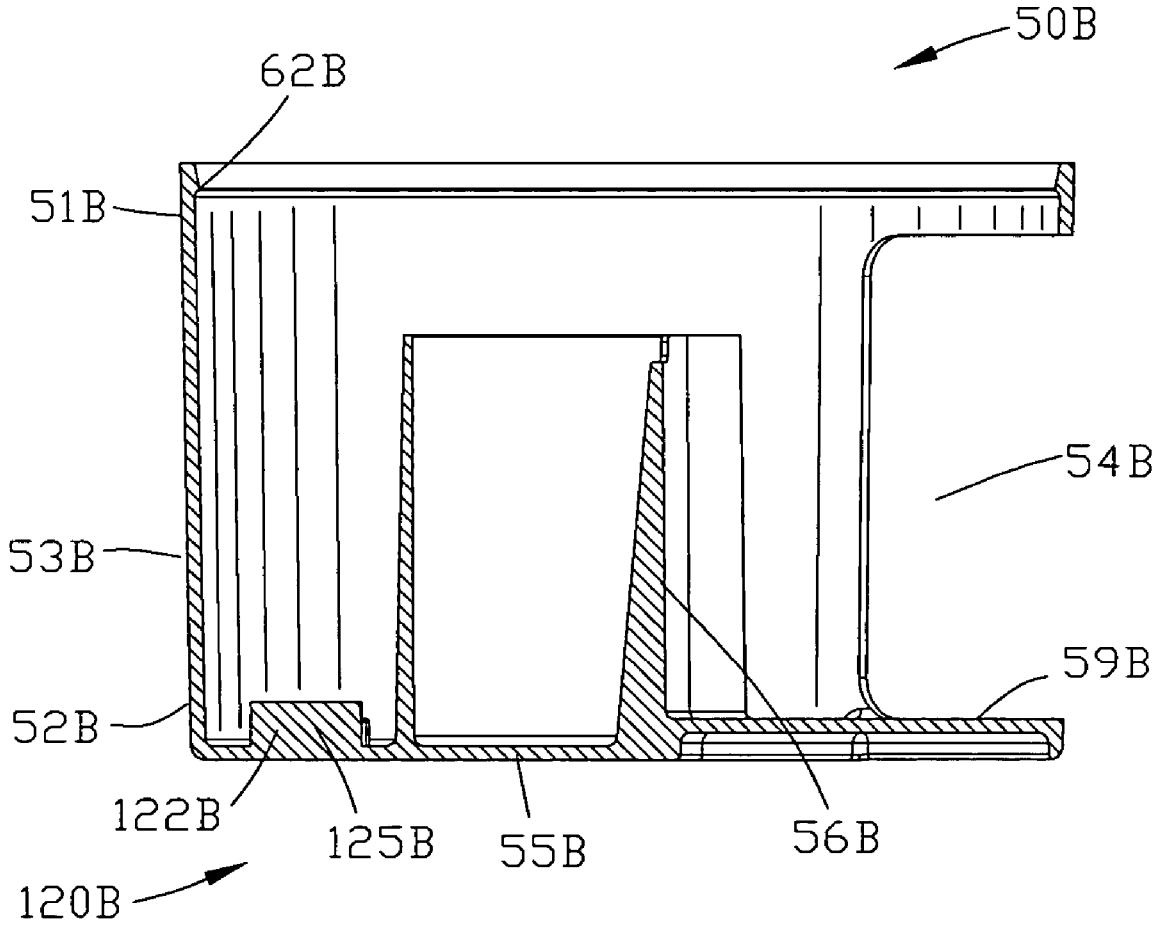
FIG. 50 is an enlarged sectional view along line 50—50 in FIG. 47.

FIGS. 31 and 32 are isometric and side sectional views of a second embodiment of a bottom dispensing aerosol device 10B for dispensing an aerosol product 14B from an aerosol container 20B. The second embodiment of the bottom dispensing aerosol device 10B is similar to the first embodiment of the bottom dispensing aerosol device 10A with similar structural parts having similar reference numerals.

The undercap 30B is secured to the aerosol container 20B for supporting the aerosol container 20B on the supporting surface 18B. In this embodiment of the invention, the undercap 30B comprises a first undercap portion 40B and a second undercap portion 50B interconnected by a coupling 60B.

Figure 51:
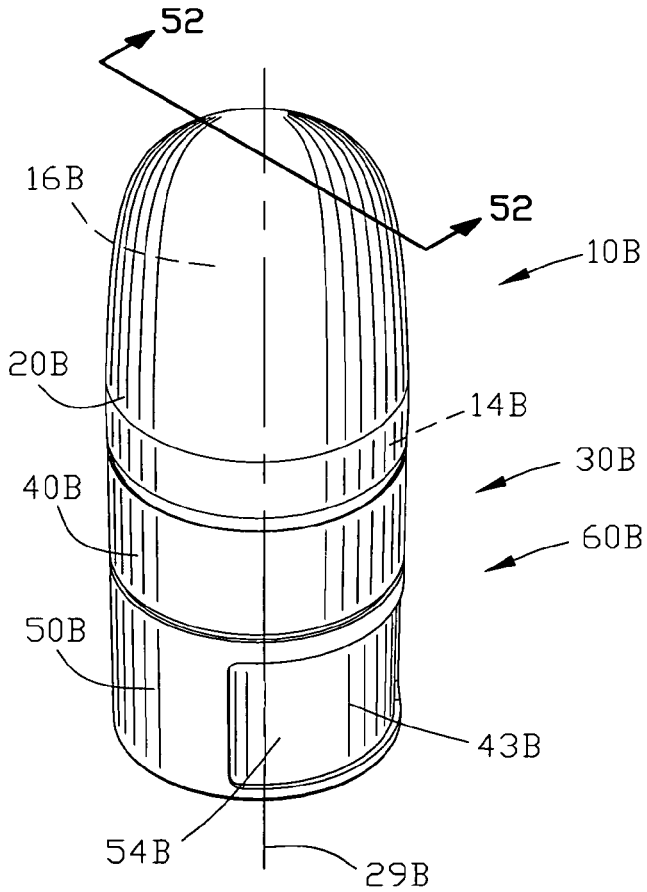
FIG. 51 is a top isometric view similar to FIG. 31 with the undercap being rotated into a locked rotational position.
Figure 52:
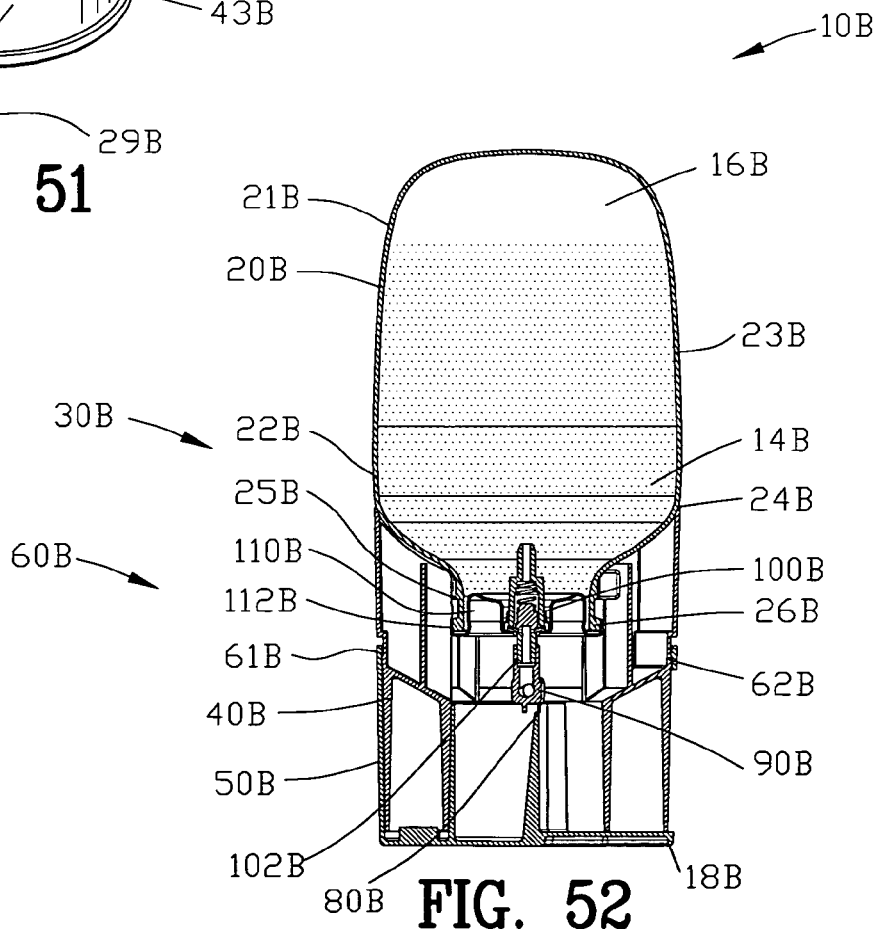
FIG. 52 is a sectional view along line 52—52 in FIG. 51.
Figure 53:
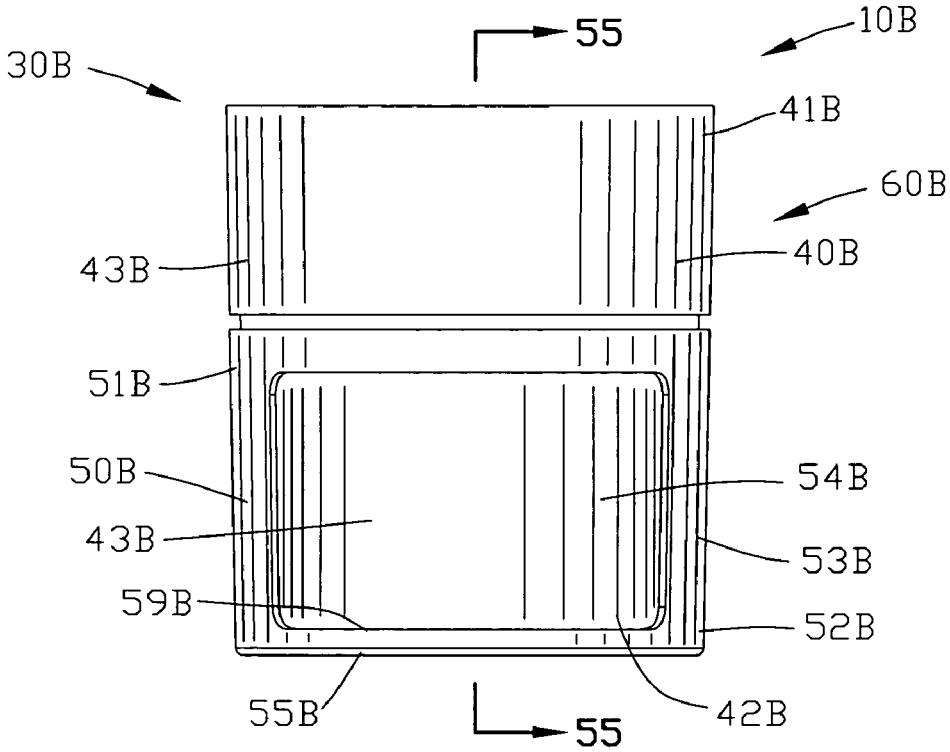
FIG. 53 is an enlarged front view of the undercap of FIG. 51.
Figure 54:
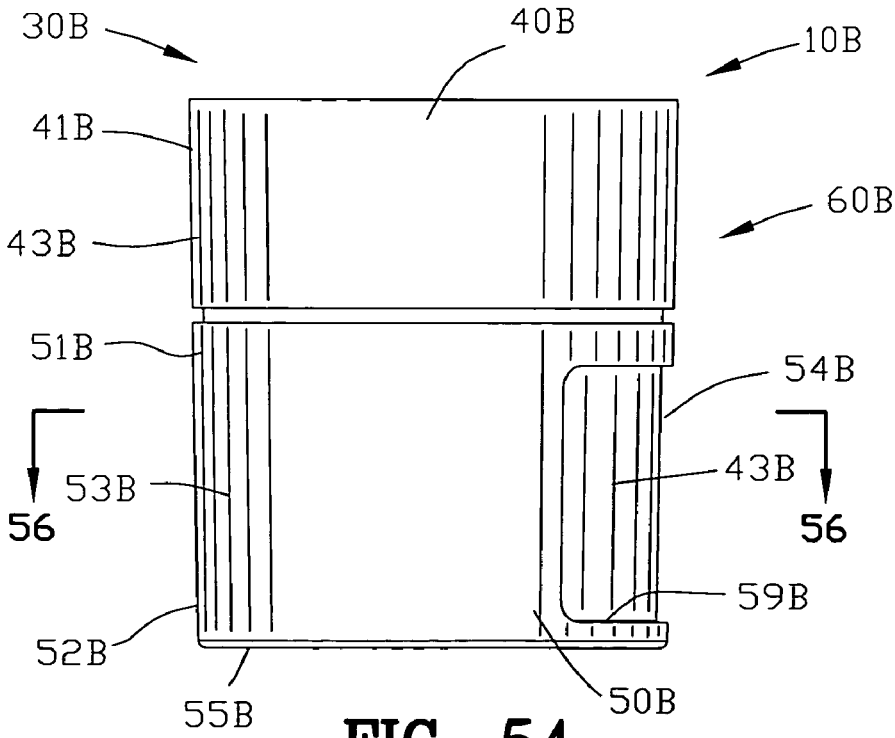
FIG. 54 is a side view of FIG. 53.
Figure 55:
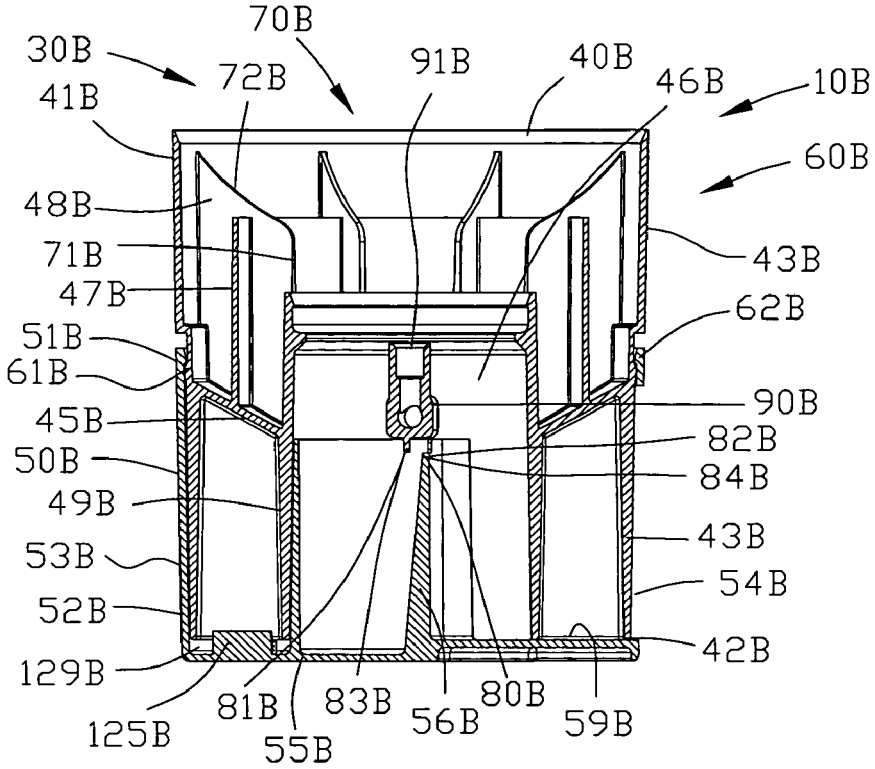
FIG. 55 is a sectional view along line 55—55 in FIG. 53.
Figure 56:
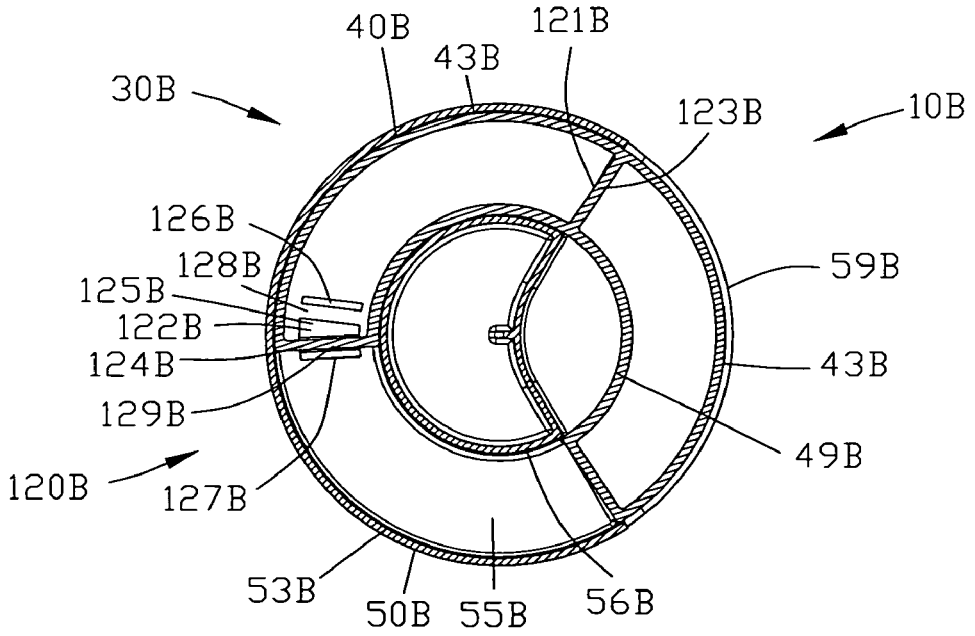
FIG. 56 is a sectional view along line 56—56 in FIG. 54.

The first undercap portion 40B is secured relative to the aerosol container 20B by a mounting 70B. The mounting 70B rotatably mounts the undercap 30B relative to the aerosol container 20B for rotational movement between an unlocked rotational position as shown in FIGS. 1 and 2 and a locked rotational position as shown in FIGS. 51 and 52.

The bottom dispensing aerosol device 10B includes an actuator 80B and a nozzle 90B. The nozzle 90B is connected to an aerosol valve 100B secured to the aerosol container 20B by a mounting cup 110B.

The actuator 80B includes a first actuator surface 81B defined by the first undercap portion 40B and a second actuator surface 82B defined by the second undercap portion 50B. The engagement of the first actuator surface 81B with the second actuator surface 82B moves the valve stem 102B to actuate the aerosol valve 100B. The actuator 80B actuates the aerosol valve 100B for enabling the flow of the aerosol product 14B from the aerosol container 20B under the pressure of the aerosol propellant 16B to be discharged from the nozzle 90B. The bottom dispensing aerosol device 10B discharges the aerosol product 14B while the undercap 30B supports the aerosol container 20B in the inverted position on the supporting surface 18B.

The bottom dispensing aerosol device 10B includes an undercap locator 120B for locating the undercap 30B in the unlocked rotational position and the locked rotational position. When the undercap 30B in the unlocked rotational position, the actuator 80B may actuate the aerosol valve 100B to dispense the aerosol product 14B. When the undercap 30B in the locked rotational position, the actuator 80B is inhibited from actuating the aerosol valve 100B.

The container 20B is identical to the container 20A shown in FIGS. 1–30 with similar parts being labeled with similar reference characters. The aerosol mounting cup 110B secures the aerosol valve 100B to the aerosol container 20B as set forth previously. The valve stem 102B displaces the aerosol valve from a biased closed position to an open position upon a movement of the valve stem 102B to discharge the aerosol product 14B.

FIGS. 33–36 are enlarged views of portions of the first undercap portion 40B and second undercap portion 50B. The first undercap portion 40B has a top 41B and a bottom 42B with a sidewall 43B extending therebetween. A first access aperture 44B is defined in the sidewall 43B of the first undercap portion 40B. The second undercap portion 50B has a top 51B and a bottom 52B with a sidewall 53B extending therebetween. A second access aperture 54B is defined in the sidewall 53B of the second undercap portion 50B.

The coupling 60B comprises a first coupling element 61B and second coupling element 62B defined by the first and second undercap portions 40B and 50B. In this embodiment of the invention, the first coupling element 61B comprises an annular depression extending inwardly within the first undercap portion 40B. The second coupling element 62B comprises an annular projection extending inwardly from the second undercap portions 50B.

FIGS. 37–43 are various views of the first undercap portion 40B shown in FIGS. 31–36. The first undercap portion 40B includes an intermediate wall 45B located between the first and second ends 41B and 42B of the first undercap portion 40B. The intermediate wall 45B extends inwardly from the first undercap portion 40B and defines an opening 46B. The intermediate wall 45B forms an acute angle with the axis of symmetry 29B.

The first undercap portion 40B includes a first upper inner wall 47B disposed coaxial with the sidewall 43B. The first upper inner wall 47B is substantially cylindrical and extends upwardly from the intermediate wall 45B.

A plurality of radial ribs 48B extend radially inwardly from the sidewall 43B for supporting the first upper inner wall 47B. Each of the plurality of radial ribs 48B extends longitudinally along the first upper inner wall 47B to the intermediate wall 45B. The plurality of radial ribs 48B extend radially inwardly beyond the first upper cylindrical wall 47B to the edge of the opening 46B defined in the intermediate wall 45B. Preferably, the plurality of radial ribs 48B are uniformly spaced about the axis of symmetry 29B.

The first undercap portion 40B includes a first lower inner wall 49B. The first lower inner wall 49B extends downwardly from the intermediate wall 45B to the second end 42B of the first undercap portion 40B. The first lower inner wall 49B is partially cylindrical and extends to join with the sidewall 43B of the first undercap portion 40B.

The first undercap portion 40B is secured to the aerosol container 20B by a mounting shown generally as 70B. In the example, the mounting 70B comprises each of the plurality of radial ribs 48B having recesses 71B and a tapered end 72B for securing the first undercap portion 40B to the aerosol container 20B.

In this example of the invention, the recesses 71B of the plurality of radial ribs 48B secures the first undercap portion 40B to the peripheral rim 112B of the aerosol mounting cup 110B crimped to the bead 26B of the container 20B. Preferably, the recesses 71B of the plurality of radial ribs 48B is frictionally secured to the peripheral rim 112B of the aerosol mounting cup 110B while the tapered end 72B of the plurality of radial ribs 48B engage with the second end 22B of the aerosol container 20B.

The first coupling element 61B is shown as the annular depression located adjacent to the intermediate wall 45B of the first undercap portion 40B. The annular depression of the first coupling element 61B extends axially from the first end 41B toward the second end 42B of first undercap portion 40 1B. T he annular depression defines an axial length sufficient for enabling longitudinal axial movement between the first and second undercap portions 40B and 50B as will be described in greater detail hereinafter.

The first undercap portion 40B is inserted into the second undercap portion 50B. Preferably, the annular projection of the second coupling element 62B is snapped over the sidewall 43B of the first undercap portion 40B to form a rotational snap locking engagement with the annular depression of the first coupling element 61B of the first undercap portion 40B. The first undercap portion 40B and/or the second undercap portion 50B are deformed when the second coupling element 62B passes over the sidewall 43B of the first undercap portion 40B.

In this first embodiment of the invention, the first undercap portion 40B includes the nozzle 90B integrally formed with the first undercap portion 40B. The nozzle 90B extends between a proximal end 91B and a distal end 92B interconnected by a channel 93B. The proximal end 91B of the nozzle 90B includes a socket 96B for frictionally receiving the valve stem 112B of the aerosol valve 100B. The distal end 92B of the nozzle 90B defines a terminal orifice 98B.

In this second embodiment of the invention, the nozzle 90B integrally formed with the first undercap portion 40B. The distal end 92B of the nozzle 90B is integrally secured to the wall 45B of the first undercap portion 40B. The flexibility of the sidewall 43B and the wall 45B of the first undercap portion 40B provides a hinge 94B for the nozzle 90B. The hinge 94B has a pivot axis substantially perpendicular to the axis of symmetry 29B. The hinge 94B allows the proximal end 91B of the nozzle 90B to move vertically for operating the valve stem 102B to actuate the aerosol valve 100B. The nozzle 90B and the hinge 94B are integrally connected to the first undercap portion 40B In this second embodiment of the invention, the terminal orifice 98B located in proximity to the sidewall 43B of the first undercap portion 40B. The location of the terminal orifice 98B in proximity to the sidewall 43B of the first undercap portion 40B allows the dispensing the aerosol product 14B outside of the undercap 30B.

The first actuator surface 81B is defined by a protrusion 83B extending from the proximal end 91B of the nozzle 90B. The protrusion 83B extends downwardly for selective engagement with the second actuator surface 82B defined by the second undercap portion 50B. Upon engagement with the second actuator surface 82B, the first actuator surface 81B moves the proximal end 91B of the nozzle 90B about the hinge 94B for operating the valve stem 102B to actuate the aerosol valve 100B.

The undercap locator 120B comprises a first undercap locator 121B located in the first undercap portion 40B. The first undercap locator 121B includes a first unlocked locator shown as a rib 123B extending between the sidewall 43A and the first lower inner wall 49B of the first undercap portion 40B. The first undercap locator 121B includes a first locked locator shown as a portion 124B of the first lower inner wall 49B extending between the sidewall 43A and the first lower inner wall 49B of the first undercap portion 40B. The operation of the undercap locator 120B will be more fully explained hereinafter.

FIGS. 44–50 are various views of the second undercap portion 50B shown in FIGS. 31–36. The second undercap portion 50B includes a base 55B extending across the second end 52B of the second undercap portion 50B. The base 55B supports the aerosol container 20B on the supporting surface 18B in an inverted position.

A second inner wall 56B is located within the interior of the second undercap portion 50B. The second inner wall 56B is a partially cylindrical wall extending upwardly from the base 55B to an intermediate location between the first and second ends 51B and 52B of the second undercap portion 50B.

The second inner wall 56B defines an annular channel 57B between the second inner wall 56B and the side wall 53B. The annular channel 57B provides a void for enabling the first undercap portion 40B to rotate within the second undercap portion 50B. The second inner wall 56B is integrally formed with the second undercap portion 50B.

The second coupling element 62B defined by the annular projection extending inwardly from the second undercap portions 50B and located at the first end 51B of the second undercap portion 50B. The annular projection of the second coupling element 62B has a shorter axial length than the axial length of the annular depression of the first undercap portion 40B. The shorter axial length of the annular projection relative to the axial length of the annular depression of the first undercap portion 40B enables longitudinal axial movement of the first undercap portions 40B relative to the second undercap portion 50B.

The coupling 60B rotatably mounts the first undercap portion 40B relative to the second undercap portion 50B. The coupling 60B linearly mounts the first undercap portion 40B relative to the second undercap portion 50B. The coupling 60B enables the combined rotational and linear movement between the first undercap portion 40B relative to the second undercap portion 50B.

The second inner wall 56B defines the second actuator surface 82B. A central portion 84B of the second inner wall 56B defines the second actuator surface 82B. The central portion 84B of the second inner wall 56B provides the selective engagement with the protrusion 83B extending from the proximal end 91B of the nozzle 90B. Upon an alignment of the protrusion 83B with the central portion 84B of the second inner wall 56B, the actuator 80B is positioned for actuating the aerosol valve 100B.

A platform 59B is disposed on the base 55B on a forward side of the second inner wall 56B. The platform 59B is raised relative to the base 55B for providing the locking function of the bottom dispensing aerosol device 10B as will be described in greater detail hereinafter.

The undercap locator 120B comprises a second undercap locator 122B located in the second undercap portion 50B. The second undercap locator 122B is shown as a stop 125B extending from the base 55B of the second undercap portion 50B. An unlocked tab 126B and a locked tab 127B extend from the base 55B of the second undercap portion 50B on opposite sides of the stop 125B. A relief 128B is located between the stop 125B and the unlocked tab 126B. A ledge 129B is located between the stop 125B and the locked tab 127B. The second undercap locator 122B cooperates with the first undercap, locator 121B for locating the unlocked and locked positions of the undercap 30B relative to the aerosol container 20B.

FIGS. 51 and 52 are views similar to FIGS. 31 and 32 with the undercap 30B being rotated into a locked rotational position. The first undercap portion 40B is frictionally secured to the aerosol container 20B by the mounting 70B. The second undercap portion 50B is rotationally and linearly moveable relative to the first undercap portion 40B.

In the locked position, a portion of the sidewall 43B of the first undercap portion 40B is rotated to cover the second access aperture 54B of the second undercap portion 50B. The covering of the second access aperture 54B of the second undercap portion 50B inhibits access to the actuator 80B within the undercap 30B.

FIGS. 53–56 are various views of the first and second undercap portions 40B and 50B of FIGS. 51 and 52. The first undercap portion 40B and the aerosol container 20B are rotated into the locked rotational position relative to second undercap portion 50B.

The first undercap portion 40B and the aerosol container 20B are rotated in a clockwise direction relative to the second undercap portion 50B until the portion 124B of the first lower inner wall 49B engages with the stop 125B. During the clockwise rotation, the portion 124B of the first lower inner wall 49B passes over the locked tab 127B and rests on the ledge 129B of the second undercap portion 50B. The portion 124B of the first lower inner wall 49B is retained on the ledge 129B by the stop 125B and the locked tab 127B. Preferably, an audible click is produced when the portion 124B of the first lower inner wall 49B passes over the locked tab 127B.

The second end 42B of the first undercap portion 40B is positioned over the platform 59B of the second undercap portion 50B. Similarly, the rib 123B of the first undercap portion 40B is positioned over the ledge 129B of the second undercap portion 50B. Since the platform 59B and the ledge 129B are elevated relative to the base 55B of the second undercap portion 50B, the platform 59B and the ledge 129B inhibit a downward linear movement of the first undercap portion 40B relative to the second undercap portion 50B. The inhibited downward linear movement of the first undercap portion 40B inhibits actuation of the aerosol valve 100B and the dispensing of the aerosol product 14B therefrom.

Figure 57:
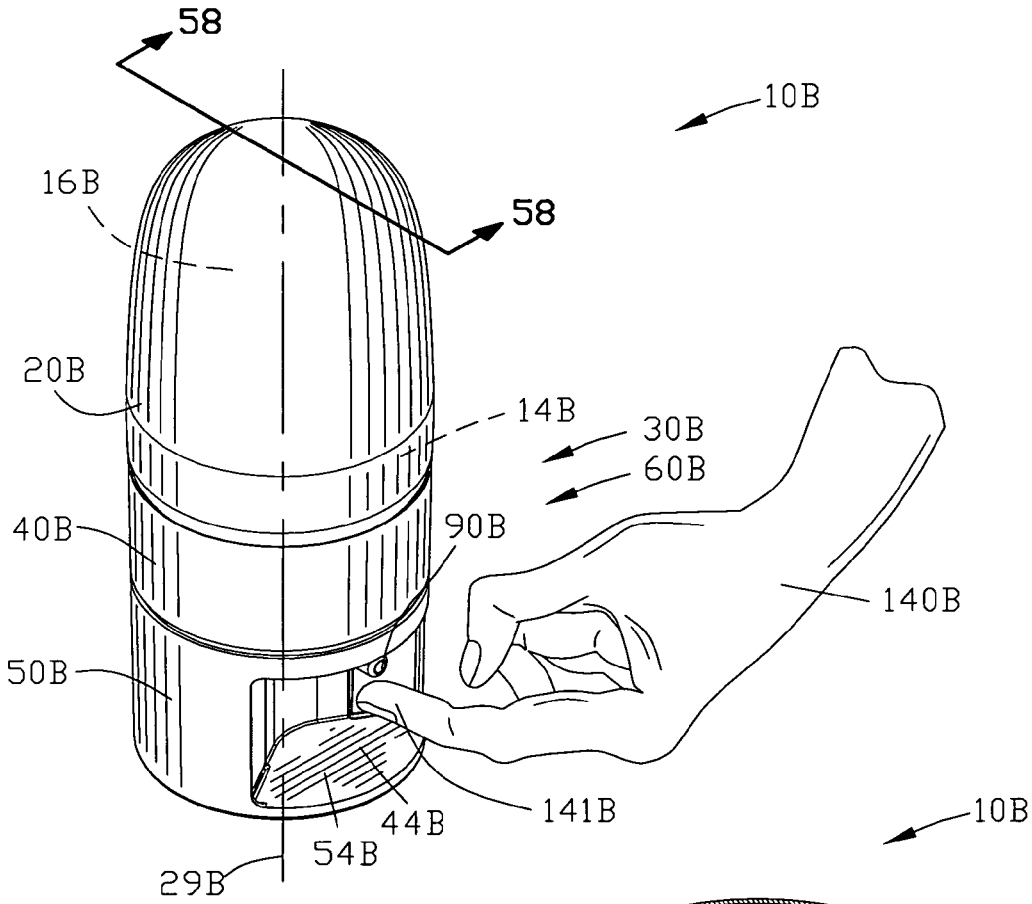
FIG. 57 is a top isometric view similar to FIG. 31 with the undercap being rotated into an unlocked rotational position and with the actuator shown in an actuated position.
Figure 58:
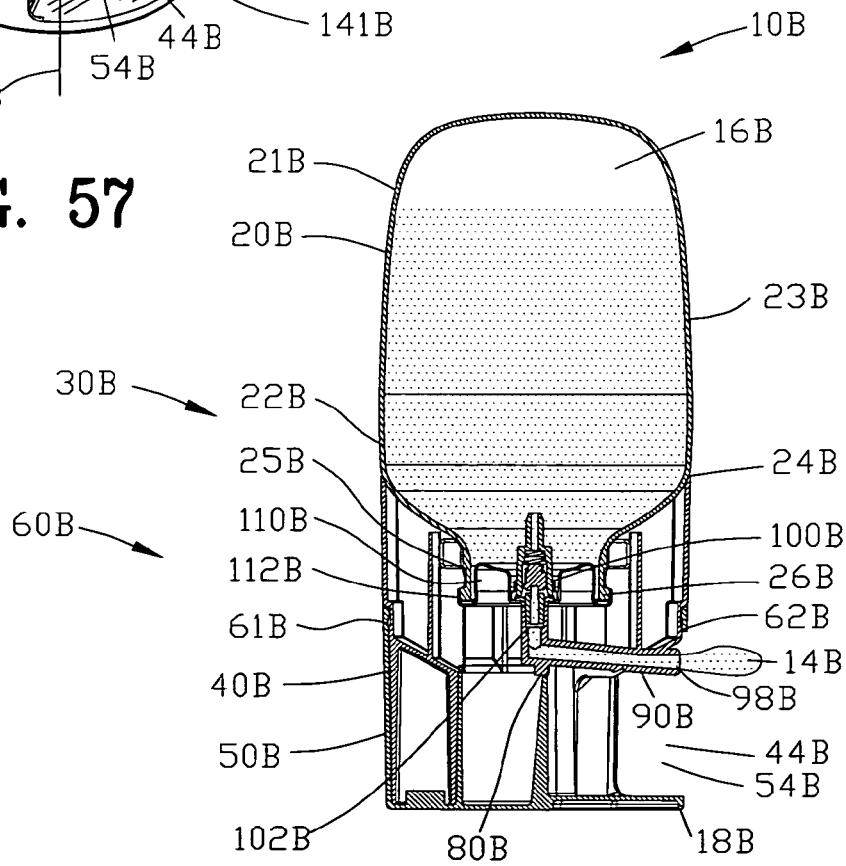
FIG. 58 is a sectional view along line 58—58 in FIG. 57.

FIGS. 57 and 58 are views similar to FIGS. 51 and 52 with the undercap 30B being rotated to return into the unlocked rotational position. The bottom dispensing aerosol device 10B is shown in an actuated condition for dispensing the aerosol product 14B from the terminal orifice 98B. In this example, the aerosol product 14B is shown as a hand lotion for dispensing directly onto a finger of a user operator.

Figure 59:
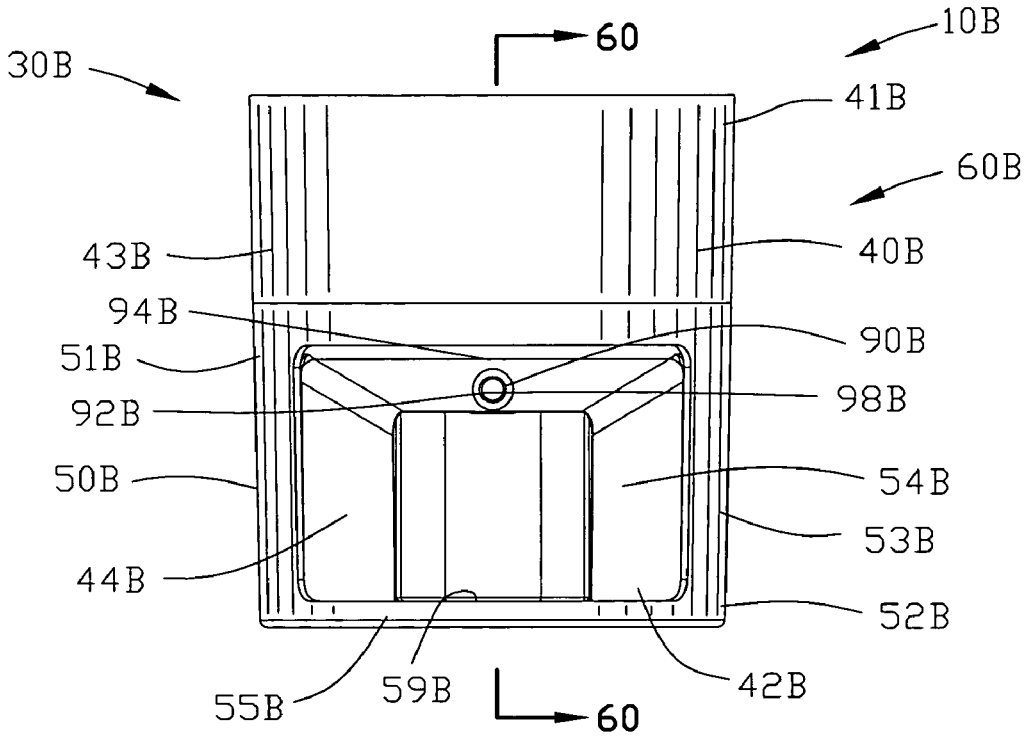
FIG. 59 is an enlarged front view of the undercap of FIG. 57.
Figure 60:
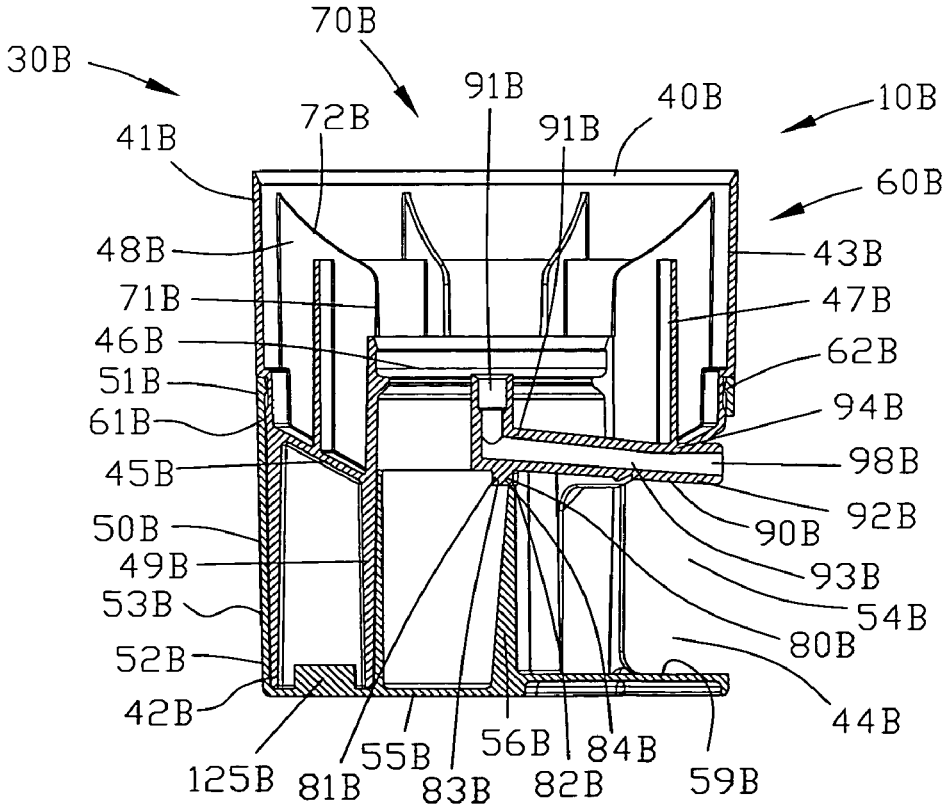
FIG. 60 is a sectional view along line 60—60 in FIG. 59.

FIGS. 59–60 are various views of the first and second undercap portions 40B and 50B of FIGS. 27 and 28. The first undercap portion 40B and the aerosol container 20B are rotated into the unlocked rotational position relative to second undercap portion 50B.

The first undercap portion 40B and the aerosol container 20B are rotated in a counterclockwise direction relative to second undercap portion 50B until the rib 123B of the first undercap locator 121B engages with the stop 125B of the second undercap locator 122B to locate the unlocked position of the undercap 30B relative to the aerosol container 20B. During the counterclockwise rotation, the rib 123B passes over the unlocked tab 126B and is aligned with the relief 128B of the second undercap portion 50B. The rib 123B is retained in alignment with the relief 128B by the stop 125B and the unlocked tab 126B. Preferably, an audible click is produced when the rib 123B passes over the unlocked tab 126B.

In the unlocked position, the first access aperture 44B of the first undercap portion 40B is rotated into alignment with the second access aperture 54B of the second undercap portion 50B. The alignment of the first access aperture 44B with the second access aperture 54B permits access to the to the actuator 80B within the undercap 30B.

The second end 42B of the first undercap portion 40B is positioned over the base 55B of the second undercap portion 50B. The lower position of the base 55B permits a downward linear movement of the first undercap portion 40B relative to the second undercap portion 50B.

A downward pressure applied by an operator to the first end 21B of the aerosol container 20B, moves the first undercap portion 40B downwardly relative to the second undercap portion 50B. The projection 83B of the first actuator surface 81B engages with the central portion 84B on the second inner wall 56B of the second actuator surface 82B.

A continued downward pressure applied by the operator to the engaging projection 83B and the central portion 84B causes movement of the proximal end 91B of the nozzle 90B about the hinge 94B to depress the valve stem 102B of the aerosol valve 100B. When the valve stem 102B displaces the aerosol valve 100B into the open position, the aerosol product 14B is dispensed under the pressure of the aerosol propellant 16B from the terminal orifice 98B of the nozzle 90B.

Upon the removal of the downward pressure applied by the operator, a valve spring (not shown) within the aerosol valve 100B returns the aerosol valve 100B into a closed position. Concomitantly therewith, the valve spring (not shown) within the aerosol valve 100B moves the first undercap portion 40B and the aerosol container 20B upwardly relative to the second undercap portion 50B to a position shown in FIGS. 1 and 2.

Figure 61:
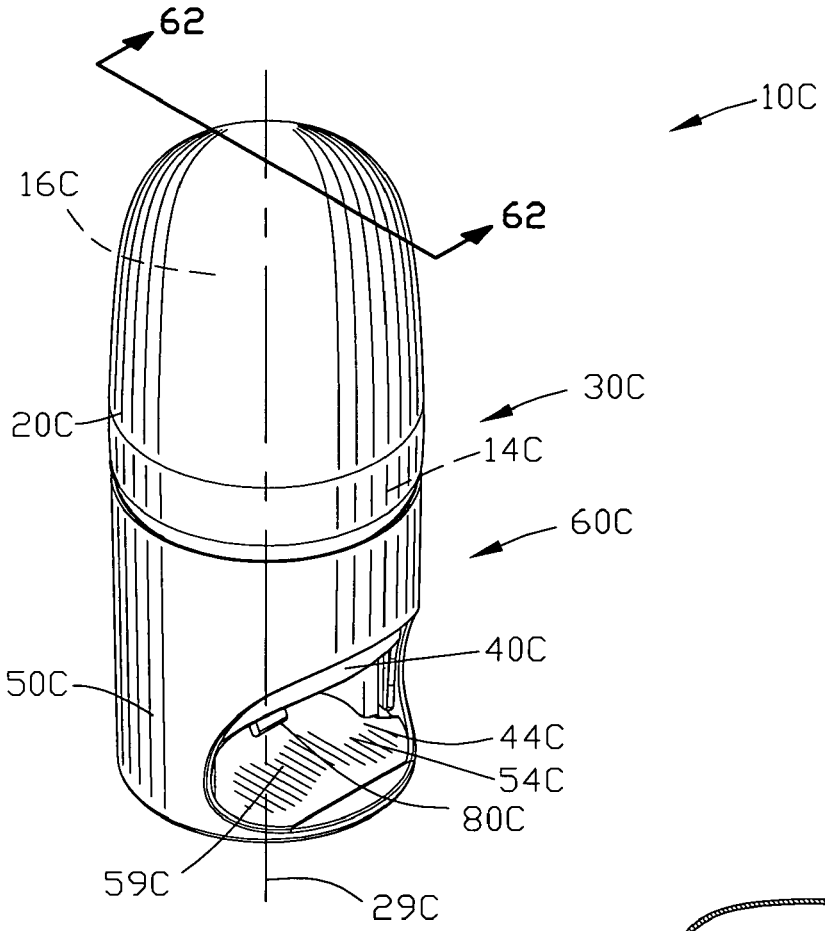
FIG. 61 is a top isometric view of a third embodiment of a bottom dispensing aerosol device incorporating the present invention with the undercap being rotated into an unlocked rotational position.
Figure 62:
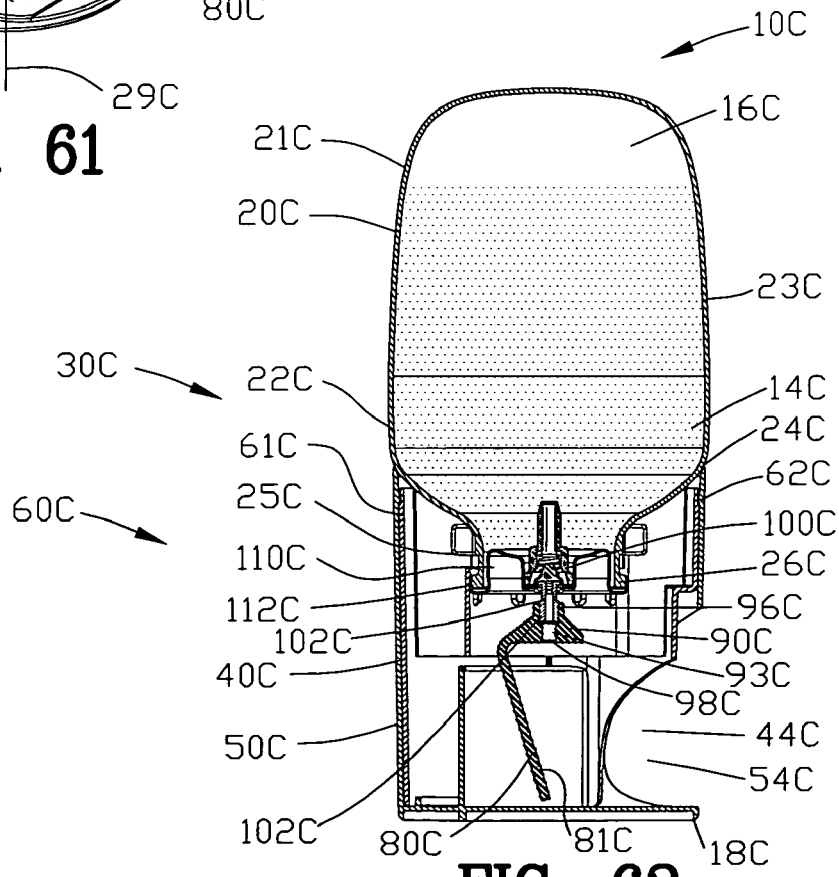
FIG. 62 is a sectional view along line 62—62 in FIG. 61.

FIGS. 61 and 62 are isometric and side sectional views of a third embodiment of a bottom dispensing aerosol device 10C for dispensing an aerosol product 14C from an aerosol container 20C. The bottom dispensing aerosol device 10C is shown in an unattended condition. The second embodiment of the bottom dispensing aerosol device 10C is similar to the first embodiment of the bottom dispensing aerosol device 10A with similar structural parts having similar reference numerals.

The aerosol container 20C along with the aerosol valve 100C and the mounting cup 100C are identical to the same structures shown in FIGS. 1 and 2. The first undercap portion 40C is identical to the first undercap portion 40A shown in FIGS. 1 and 2 except the first undercap portion 40C lacks the integral nozzle 90A shown in FIGS. 1 and 2.

The second undercap portion 50C is identical to the second undercap portion 50A shown in FIGS. 1 and 2. In contrast to rotational and linear movement provided by the coupling 60A of FIGS. 1–30, the coupling 60C provides only a rotational movement between the first undercap portion 40C and the second undercap portion 50C.

In contrast to FIGS. 1–30, the actuator 80C and the nozzle 90C in FIGS. 61–66 are independent of the first undercap portion 40C and the second undercap portion 50C. The nozzle 90C includes a channel 93C interconnecting a socket 96C to a terminal orifice 98C. The socket 96C frictionally secures the nozzle 90C to the valve stem 102C. The terminal orifice 98C of the nozzle 90C is established to dispense the aerosol product 14C under the pressure of the aerosol propellant 16C in a generally downward direction within the undercap 30C.

An actuator 80C includes an actuator surface 81C secured to the nozzle 90C. Preferably, the actuator 80C is integrally formed with the nozzle 90C as a one piece unit. The actuator 80C is designed for actuating a tilt aerosol valve 100C wherein a tilting of the valve stem 102C displaces the aerosol valve 100C from the biased closed position to the open position. However, it should b e understood that the invention may be modified to function with a vertical action valve as shown in FIGS. 1–60.

Figure 63:
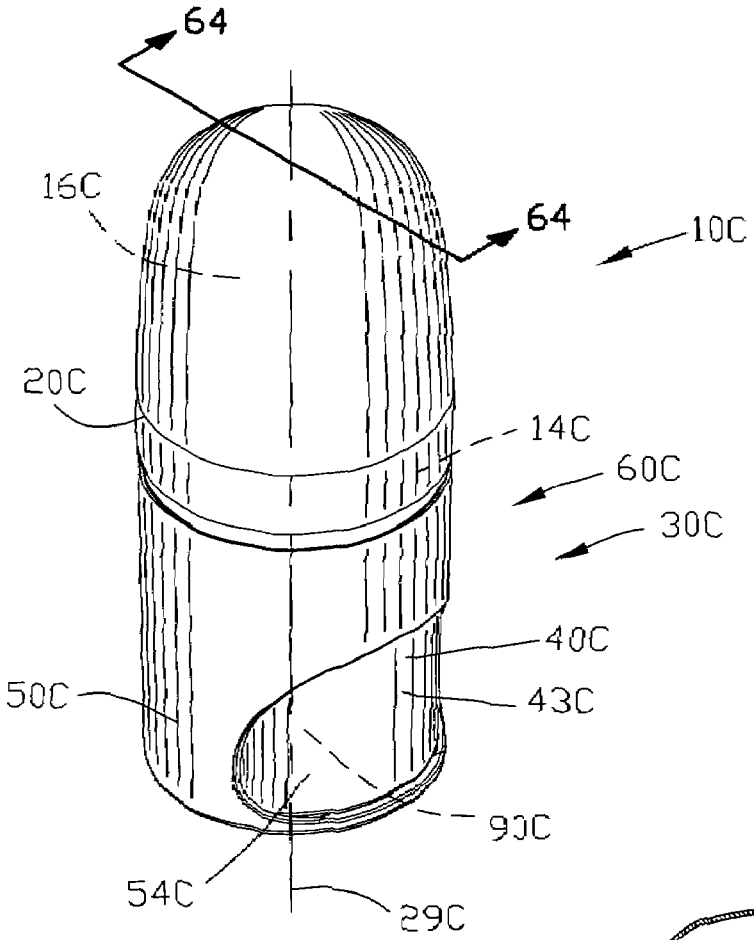
FIG. 63 is a top isometric view similar to FIG. 61 with the undercap being rotated into a locked rotational position.
Figure 64:
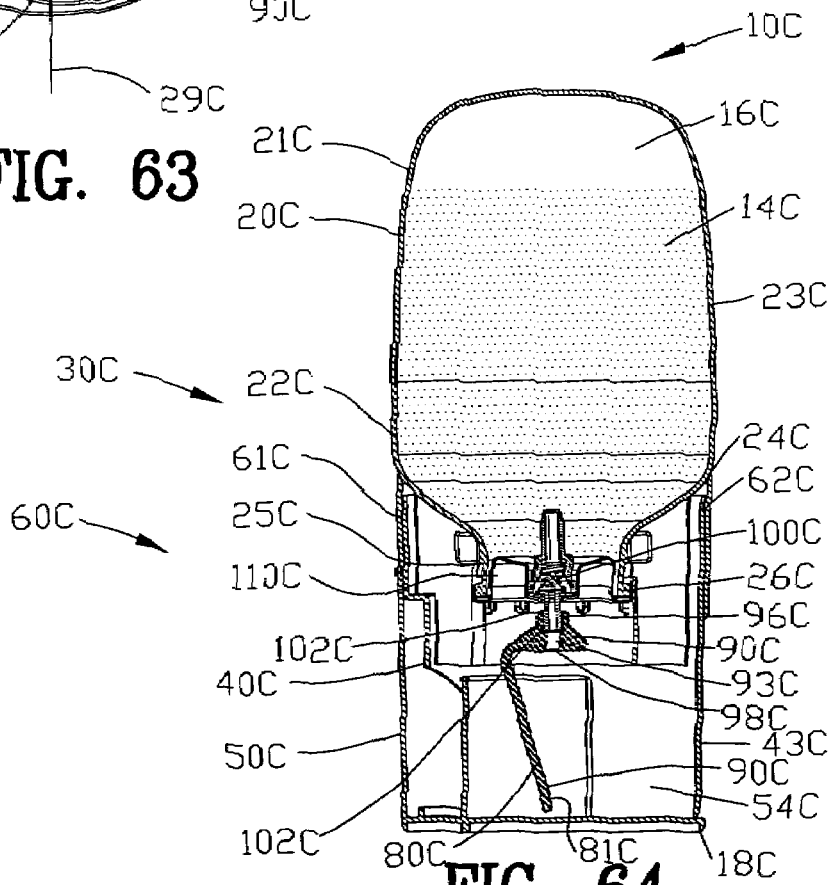
FIG. 64 is a sectional view along line 64—64 in FIG. 63.

FIGS. 63 and 64 are views of the bottom dispensing aerosol device 10C with the first undercap portion 40C and the aerosol container 20C being rotated into the locked rotational position relative to second undercap portion 50C. In the locked position, a portion of the sidewall 43C of the first undercap portion 40C is rotated to cover the second access aperture 54C of the second undercap portion 50C. The covering of the second access aperture 54C of the second undercap portion 50C inhibits access to the actuator 80C within the undercap 30C.

Figure 65:
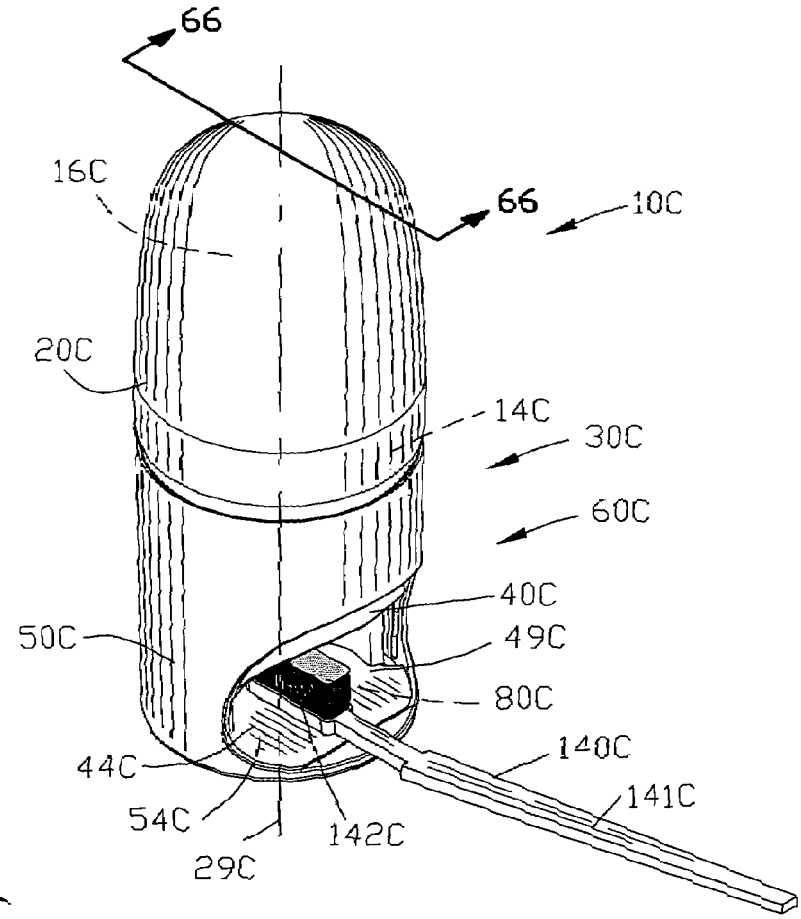
FIG. 65 is a top isometric view similar to FIG. 61 with the undercap being rotated into an unlocked rotational position and with the actuator shown in an actuated position.
Figure 66:
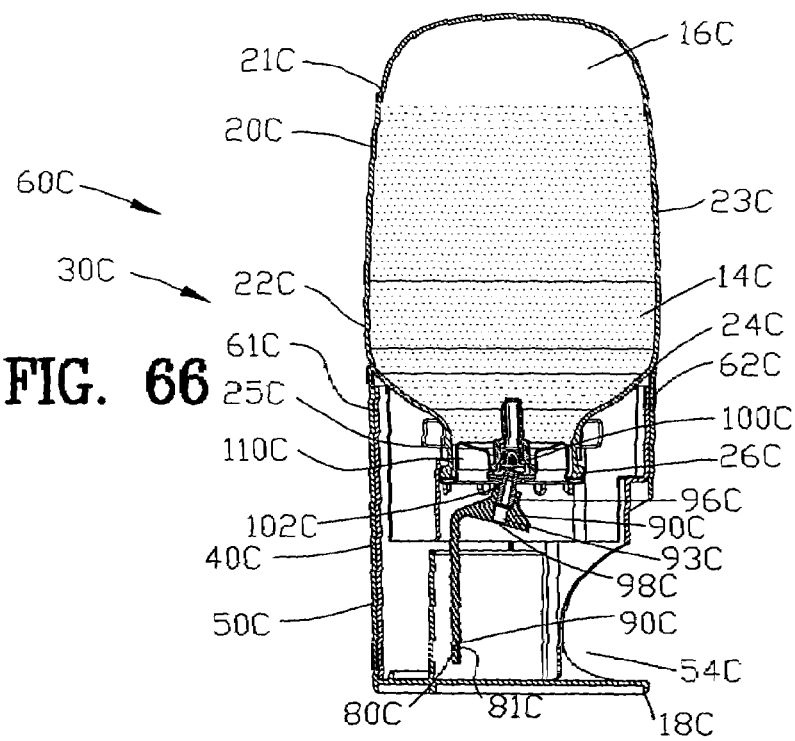
FIG. 66 is a sectional view along line 66—66 in FIG. 65.

FIGS. 65 and 66 are views similar to FIGS. 63 and 64 with the undercap 30C being rotated to return into the unlocked rotational position. The first undercap portion 40C and the aerosol container 20C are rotated into the unlocked rotational position relative to second undercap portion 50C. In the unlocked position, the first access aperture 44C of the first undercap portion 40C is rotated into alignment with the second access aperture 54C of the second undercap portion 50C. The alignment of the first access aperture 44C with the second access aperture 54C permits access to the to the actuator 80C within the undercap 30C.

A lateral pressure applied by an operator to the actuator surface 81C of the actuator 80C tilts the valve stem 102C of the aerosol valve 100C. The tilting of the valve stem 102C displaces the aerosol valve 100C from a biased closed position to an open position against the urging of a valve spring (not shown). When the valve stem 102C displaces the aerosol valve 100C into the open position, the aerosol product 14C is dispensed under the pressure of the aerosol propellant 16C from the terminal orifice 98C of the nozzle 90C.

The lateral pressure applied to the actuator surface 81C is applied by inserting an object through the first and second access apertures 44C and 54C to apply a lateral pressure to the actuator surface 81C of the actuator 80C.

In this example, the object inserted through the first and second access apertures 44C and 54C is shown as a conventional toothbrush 140C having a handle 141C and bristles 142C. Although the object inserted through the first and second access apertures 44C and 54C has been shown as a conventional toothbrush 140C, it should be understood that various objects may be inserted within the undercap 30C including a finger of a user and the like.

Upon the removal of the lateral pressure applied by the operator, a valve spring (not shown) within the aerosol valve 100C moves the returns the aerosol valve 100C into a closed position. Concomitantly therewith, the valve spring (not shown) within the aerosol valve 100C moves the actuator 80C and the nozzle 90C to the position shown in FIGS. 61 and 62.

Figure 67:
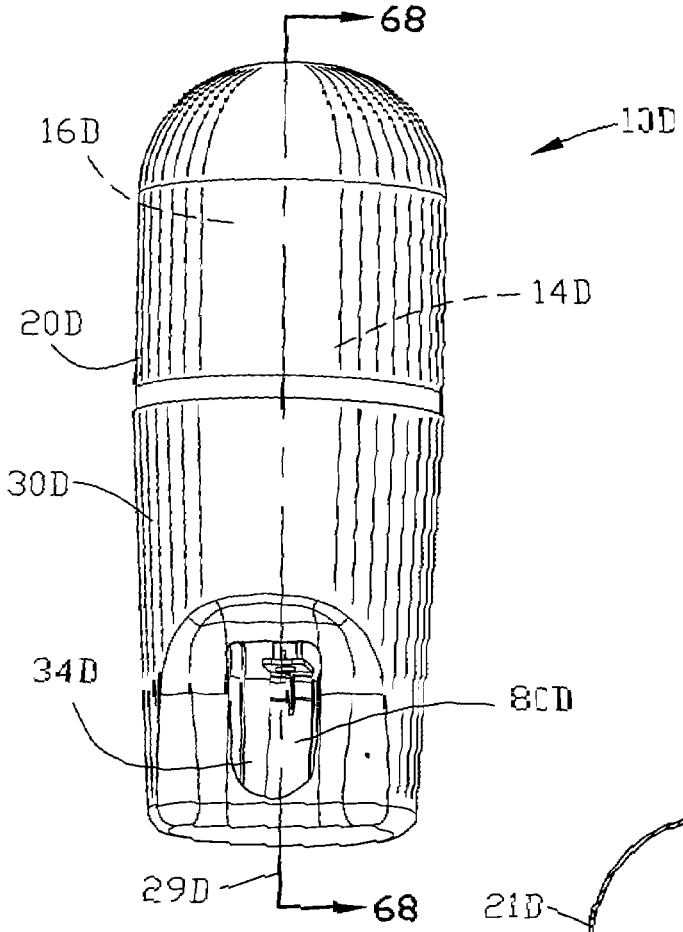
FIG. 67 is a top isometric view of a fourth embodiment of a bottom dispensing aerosol device incorporating the present invention.
Figure 68:
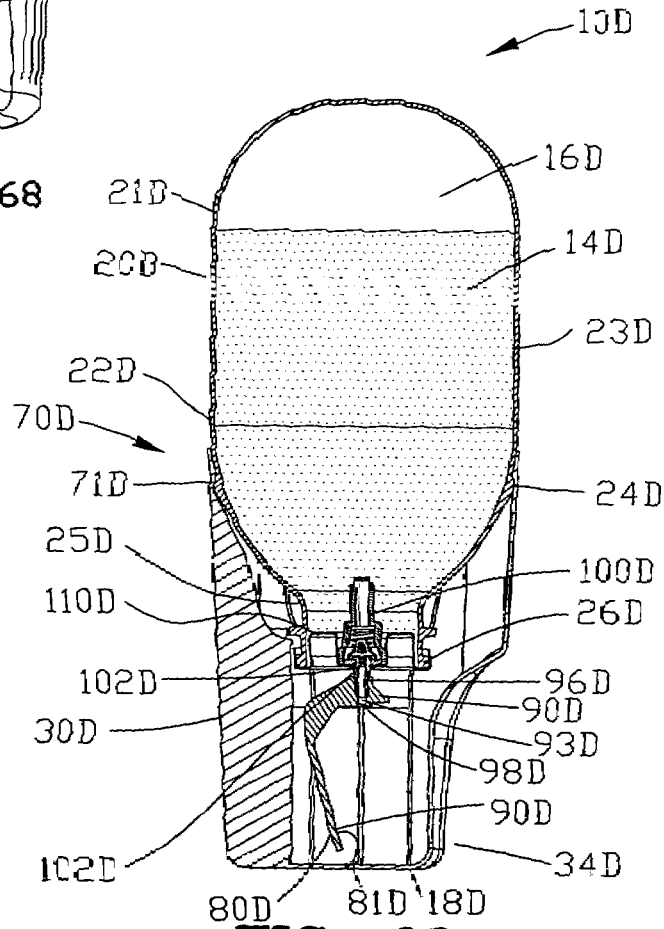
FIG. 68 is a sectional view along line 68—68 in FIG. 67.

FIGS. 67 and 68 are isometric and side sectional views of a fourth embodiment of a bottom dispensing aerosol device 10D for dispensing an aerosol product 14D from an aerosol container 20D. The bottom dispensing aerosol device 10D is shown in an unattended condition. The fourth embodiment of the bottom dispensing aerosol device 10D is similar to the prior embodiments of the bottom dispensing aerosol device 10A–10C with similar structural parts having similar reference numerals.

The aerosol container 20D includes a rim 24D molded into the sidewall 23D and in proximity to the second end 22D of the aerosol container 20D. The aerosol valve 100D and the mounting cup 10D are identical to the same structures shown in FIGS. 1 and 2.

In contrast to the prior embodiments of the bottom dispensing aerosol device 10A–10C, the undercap 30D is a unitary member. The undercap 30D is secured to the aerosol container 20D by a mounting 70D. The mounting 70D comprises an annular projection 71D extending inwardly from the undercap 30D. The annular projection 71D is snapped over the rim 24D molded into the sidewall 23D of the aerosol container 20D to form a snap locking engagement. The undercap 30D is deformed when the annular projection 71D passes over the rim 24D molded into the sidewall 23D of the aerosol container 20D.

Figure 69:
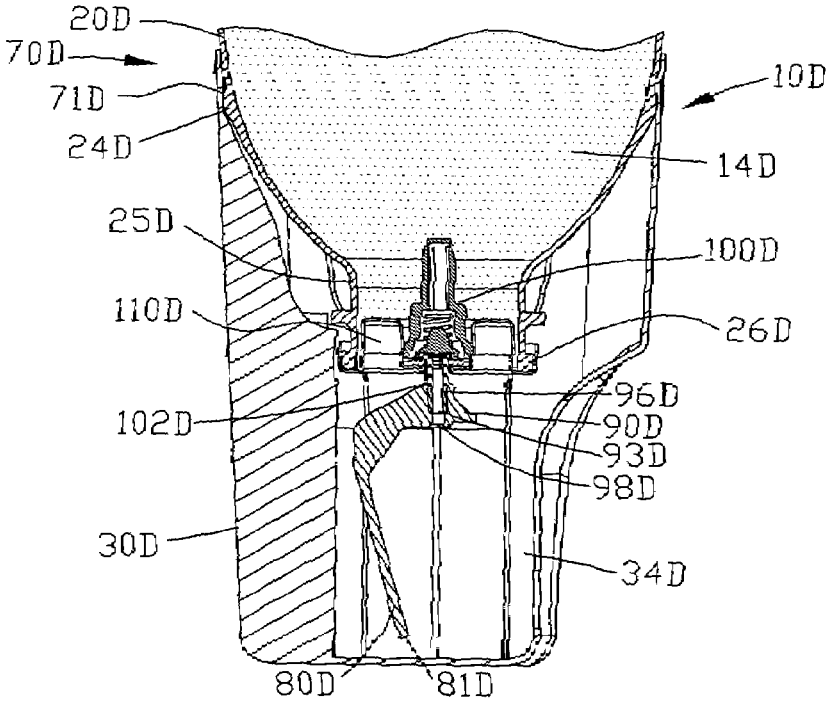
FIG. 69 is an enlarged view of a portion of FIG. 68 with the actuator shown in an unattended position.

FIG. 69 is an enlarged view of a portion of FIG. 68. The actuator 80D and the nozzle 90D are similar to the actuator 80C and the nozzle 90C of FIGS. 61–66. The nozzle 90D includes a channel 93D interconnecting a socket 96D to a terminal orifice 98D. The socket 96D frictionally secures the nozzle 90D to the valve stem 102D. The terminal orifice 98D of the nozzle 90D is established to dispense the aerosol product 14D under the pressure of the aerosol propellant in a generally downward direction within the undercap 30D.

An actuator 80D includes an actuator surface 81D secured to the nozzle 90D. Preferably, the actuator 80D is integrally formed with the nozzle 90D as a one piece unit. The actuator 80D is designed for actuating a tilt aerosol valve 100D wherein a tilting of the valve stem 102D displaces the aerosol valve 100D from the biased closed position to the open position.

Figure 70:
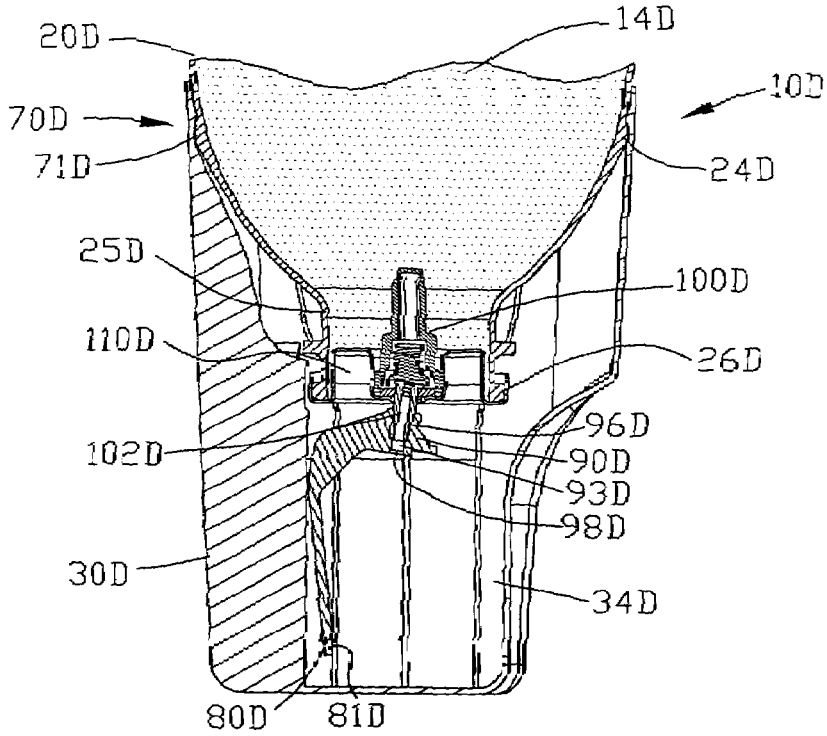
FIG. 70 is a view similar to FIG. 69 with the actuator shown in an actuated position.

FIG. 70 is a view similar to FIG. 69 with the actuator 80D being shown in an actuated position. A lateral pressure applied by an operator to the actuator surface 81D of the actuator tilts the valve stem 102D of the aerosol valve 100D. T he lateral pressure applied to the actuator surface 81D is applied by inserting an object through the access apertures 34D to apply a lateral pressure to the actuator surface 81D of the actuator 80D. The tilting of the valve stem 102D displaces the aerosol valve 100D from a biased closed position to an open position against the urging of a valve spring (not shown). When the valve stem 102D displaces the aerosol valve 100D into the open position, the aerosol product 14D is dispensed under the pressure of the aerosol propellant from the terminal orifice 98D of the nozzle 90D.

Upon the removal of the lateral pressure applied by the operator, a valve spring (not shown) within the aerosol valve 100D moves the returns the aerosol valve 100D into a closed position. Concomitantly therewith, the valve spring (not shown) within the aerosol valve 100D moves the actuator 80D and the nozzle 90D to the position shown in FIGS. 61 and 62.

Figure 71:
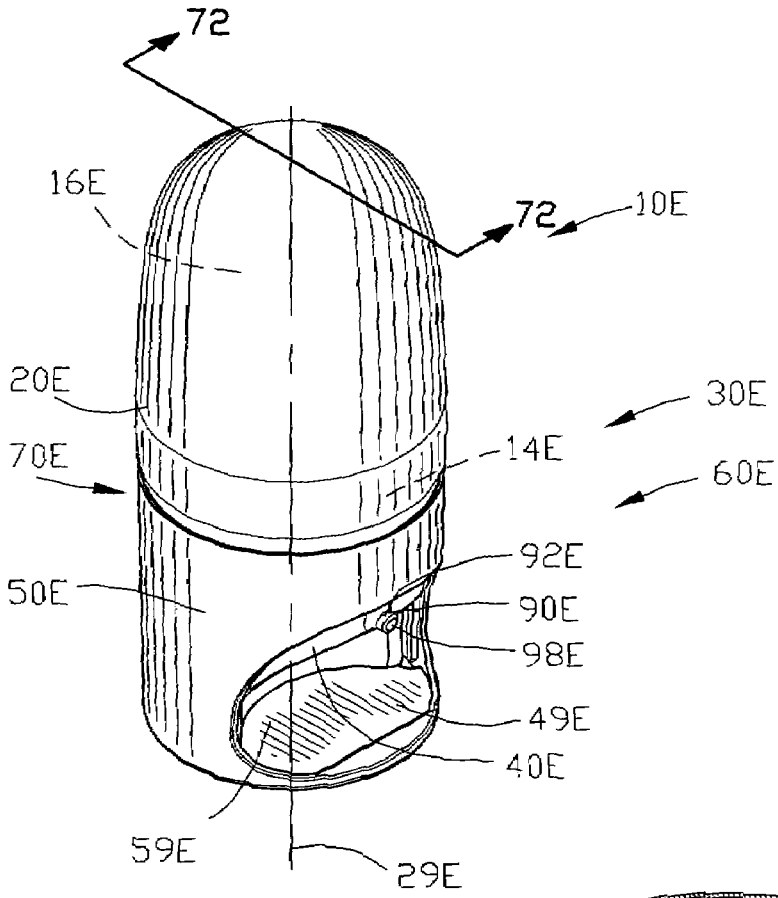
FIG. 71 is a top isometric view of a fifth embodiment of a bottom dispensing aerosol device incorporating the present invention.
Figure 72:
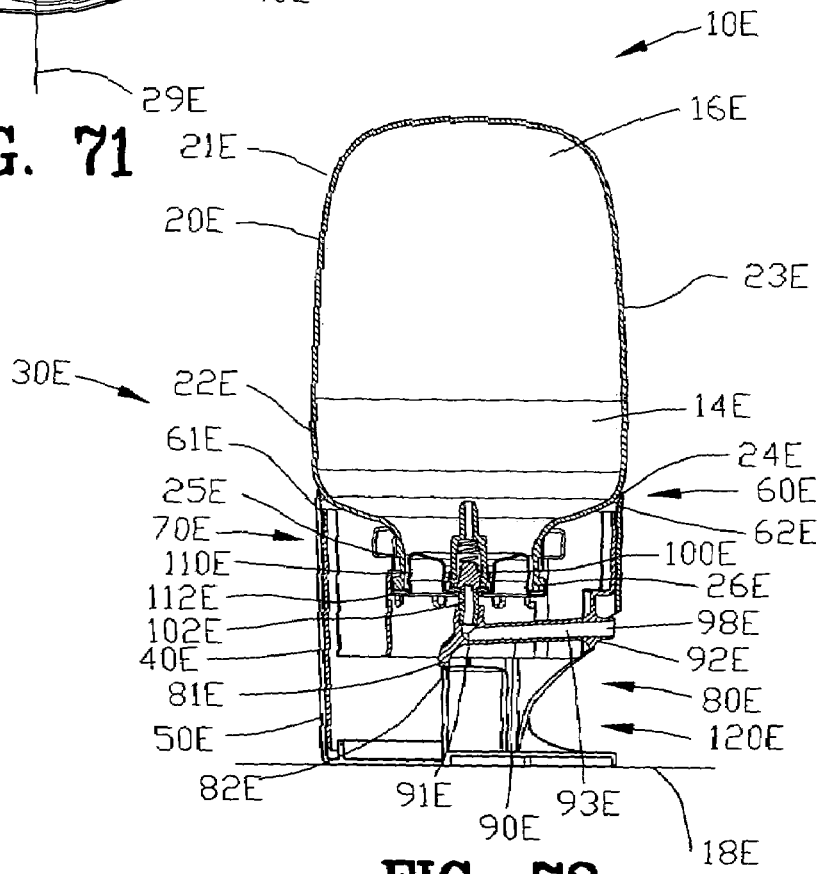
FIG. 72 is a sectional view along line 72—72 in FIG. 71.

FIGS. 71 and 72 are isometric and side sectional views of a fifth embodiment of a bottom dispensing aerosol device 10E for dispensing an aerosol product 14E from an aerosol container 20E. The bottom dispensing aerosol device 10E is shown in an unattended condition. The fifth embodiment of the bottom dispensing aerosol device 10E is similar to the first embodiments of the bottom dispensing aerosol device 10A with similar structural parts having similar reference numerals.

FIG. 71 illustrates the fifth embodiment of the bottom dispensing aerosol device 10E having a reduced overall height in contrast to the overall height of the first embodiment of the bottom dispensing aerosol device 10A shown in FIG. 1.

FIG. 72 is a sectional view along line 72—72 in FIG. 71 illustrating the nozzle 90E. In this fifth embodiment, the nozzle 90E extends between a proximal end 91E and a distal end 92E. A channel 93E extends from the proximal end 91E and communicates with a terminal orifice 98E located at the distal end 92E of the nozzle 90E.

In contrast to the previous embodiments, the nozzle 90E is angled upwardly from the proximal end 91E to the distal end 92E. The upwardly angled nozzle 90E elevates the terminal orifice 98E to be above the proximal end 91E of the nozzle 90E. The elevated terminal orifice 98E utilizes the force of gravity to reduce any leakage of the aerosol product 14E from the elevated terminal orifice 98E after the closing of the aerosol valve 100E. Any aerosol product 14E remaining in the channel 93E is urged by the force of gravity toward the proximal end 91E of the nozzle 90E.

The present invention provides a bottom dispensing aerosol device which provides a significant advancement for the aerosol industry. The bottom dispensing aerosol device incorporates an undercap mounted to a bottom portion of the aerosol container for storing and dispensing aerosol products in an inverted position. The bottom dispensing aerosol device is suitable for dispensing viscous aerosol products in downward direction while the bottom dispensing aerosol device is resting on a supporting surface.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A bottom dispensing aerosol device, comprising;

an aerosol container extending between a top portion and a bottom portion for containing an aerosol product and an aerosol propellant therein;

an aerosol valve located at said bottom portion of said aerosol container;

said aerosol valve having a valve stem for displacing said aerosol valve from a biased closed position to an open position upon a movement of said valve stem to discharge the aerosol product from a terminal orifice;

an undercap having a sidewall extending between a top portion and a bottom portion;

a coupling for mounting said undercap to said aerosol container with said top portion of said undercap being adjacent to said bottom portion of said aerosol container;

said bottom portion of said undercap terminating in a base surface for supporting said aerosol container on a supporting surface to store the aerosol dispensing device in an inverted position; and an actuator for moving said valve stem to actuate said aerosol valve for discharging the aerosol product from the valve stem when said base surface of said undercap is supporting said aerosol container in said inverted position on the supporting surface.

2. A bottom dispensing aerosol device as set forth in claim 1, wherein said aerosol container is formed from a polymeric material.

3. A bottom dispensing aerosol device as set forth in claim 1, wherein said terminal orifice is located within said undercap for dispensing the aerosol product inside said undercap when said base surface of said undercap is disposed on the supporting surface.

4. A bottom dispensing aerosol device as set forth in claim 1, wherein said terminal orifice is located within said undercap for dispensing the aerosol product inside said undercap when said base surface of said undercap is disposed on the supporting surface; and said undercap having an access aperture located in said sidewall of said undercap for enabling access to said terminal orifice.

5. A bottom dispensing aerosol device as set forth in claim 1, wherein said terminal orifice is located in proximity to said sidewall of said undercap for dispensing the aerosol product outside of said undercap when said base surface of said undercap is disposed on the supporting surface.

6. A bottom dispensing aerosol device as set forth in claim 1, including a nozzle for directing the aerosol product discharged from said valve stem to a terminal orifice.

7. A bottom dispensing aerosol device as set forth in claim 1, wherein said valve stem is located within said undercap;

a nozzle extending between a proximal end and a distal end; and said proximal end of said nozzle being connected to said valve stem with said distal end of said nozzle located in proximity to said sidewall of said undercap for dispensing the aerosol product outside of said undercap when said base surface of said undercap is disposed on the supporting surface.

8. A bottom dispensing aerosol device as set forth in claim 1, wherein said aerosol valve is a vertical action aerosol valve for discharging the aerosol product from said terminal orifice upon a vertical movement of said valve stem; and said actuator being connected for vertically moving said valve stem upon movement of said actuator.

9. A bottom dispensing aerosol device as set forth in claim 1, wherein said aerosol valve is a tilt aerosol valve for discharging the aerosol product from said terminal orifice upon a tilting of said valve stem; and said actuator being connected for tilting said valve stem upon a tilting movement of said actuator.

10. A bottom dispensing aerosol device as set forth in claim 1, wherein said aerosol valve is a tilt aerosol valve for discharging the aerosol product from said terminal orifice upon a tilting of said valve stem;

said actuator being connected for tilting said valve stem upon a tilting movement of said actuator;

said actuator being located within said undercap;

an access aperture defined in said sidewall of said undercap; and said actuator having an actuator surface for enabling an object inserted through said access aperture to move said actuator surface for actuating said aerosol valve.

11. A bottom dispensing aerosol device as set forth in claim 1, wherein said aerosol valve is a vertical action aerosol valve for discharging the aerosol product from said terminal orifice upon a linear movement of said valve stem; and said actuator being connected for linearly moving said valve stem upon movement of said actuator; and said actuator including said coupling enabling linear movement of said aerosol container relative to said undercap for discharging the aerosol product from said terminal orifice upon depression of said top end of said aerosol container when said base surface is located on the supporting surface.

12. A bottom dispensing aerosol device as set forth in claim 1, wherein said coupling rotatably mounts at least a portion of said undercap to said aerosol container for enabling rotational movement between said aerosol container and said undercap.

13. A bottom dispensing aerosol device as set forth in claim 1, wherein said coupling linearly mounts at least a portion of said undercap to said aerosol container for enabling linear movement between said aerosol container and said undercap.

14. A bottom dispensing aerosol device as set forth in claim 1, wherein said coupling rotatably and linearly mounts at least a portion of said undercap to said aerosol container for enabling rotational and linear movement between said aerosol container and said undercap.

15. A bottom dispensing aerosol device as set forth in claim 1, wherein said undercap comprises a unitary undercap having a first undercap portion and a second undercap portion.

16. A bottom dispensing aerosol device as set forth in claim 1, wherein said undercap comprises a distinct first undercap portion and a distinct second undercap portion; and said coupling interconnecting said first undercap portion to said second undercap portion.

17. A bottom dispensing aerosol device as set forth in claim 1, wherein said undercap comprises a first undercap portion and a second undercap portion; and said coupling interconnecting said first undercap portion to said second undercap portion for enabling relative movement between said first and second undercap portions.

18. A bottom dispensing aerosol device as set forth in claim 1, wherein said undercap comprises a first undercap portion and a second undercap portion;

said first undercap portion being connected to said aerosol container; and said coupling interconnecting said first undercap portion to said second undercap portion.

19. A bottom dispensing aerosol device as set forth in claim 1, wherein said aerosol valve comprises a mounting cup secured to said aerosol container;

said undercap comprises a first undercap portion and a second undercap portion;

said first undercap portion being secured to said mounting cup of said aerosol valve; and said coupling interconnecting said first undercap portion to said second undercap portion.

20. A bottom dispensing aerosol device as set forth in claim 1, wherein said undercap comprises a first undercap portion and a second undercap portion;

said first undercap portion being connected to said aerosol container;

second undercap portion defining said base surface for supporting said aerosol container on a supporting surface; and said coupling interconnecting said first undercap portion to said second undercap portion.

21. A bottom dispensing aerosol device, comprising:

an aerosol container extending between a top portion and a bottom portion for containing an aerosol product and an aerosol propellant therein;

an aerosol valve located at said bottom portion of said aerosol container;

said aerosol valve having a valve stem for displacing said aerosol valve from a biased closed position to an open position upon a movement of said valve stem to discharge the aerosol product from a terminal orifice;

an undercap having a sidewall extending between a top portion and a bottom portion;

a coupling for rotatably mounting said undercap to said aerosol container with said top portion of said undercap being adjacent to said bottom portion of said aerosol container;

said bottom portion of said undercap terminating in a base surface for supporting said aerosol container on a supporting surface to store the aerosol dispensing device in an inverted position;

an actuator for moving said valve stem to actuate said aerosol valve;

said undercap being rotatable into a unlocked rotational position relative to said aerosol container for enabling said actuator to move said valve stem upon movement of said actuator for discharging the aerosol product from the valve stem when said base surface of said undercap is supporting said aerosol container in said inverted position on the supporting surface; and said undercap being rotatable into a locked rotational position relative to said aerosol container for inhibiting said actuator from moving said valve stem.

* * * * *